US007395882B2

(12) United States Patent
Oldham et al.

(10) Patent No.: US 7,395,882 B2
(45) Date of Patent: Jul. 8, 2008

(54) CASING AND LINER DRILLING BITS

(75) Inventors: Jack T. Oldham, Willis, TX (US); L. Allen Sinor, Conroe, TX (US); Eric E. McClain, Montgomery, TX (US); Robert A. Laing, Montgomery, TX (US); Evan C. Turner, The Woodlands, TX (US); Mark W. Dykstra, Kingwood, TX (US); Eric C. Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 149 days.

(21) Appl. No.: 10/783,720

(22) Filed: Feb. 19, 2004

(65) Prior Publication Data

US 2005/0183892 A1 Aug. 25, 2005

(51) Int. Cl.
*E21B 17/14* (2006.01)
*E21B 10/46* (2006.01)
*E21B 7/20* (2006.01)

(52) U.S. Cl. ..... 175/402; 175/425; 175/171; 166/242.8

(58) Field of Classification Search ..... 175/402, 175/171, 425, 374; 166/242.8
See application file for complete search history.

(56) References Cited

U.S. PATENT DOCUMENTS 1,342,424 A 6/1920 Cotten
1,981,525 A 11/1934 Price
1,997,312 A 4/1935 Satre
2,215,913 A * 9/1940 Brown ..... 166/285
2,334,788 A 11/1943 O'Leary
2,869,825 A * 1/1959 Crawford ..... 175/4.5

(Continued)

FOREIGN PATENT DOCUMENTS

CA 1 222 448 6/1987

(Continued)

OTHER PUBLICATIONS

Galloway, Rotary Drilling with Casing—A field proven method of reducing wellbore construction cost, Mar. 6-7, 2003, whole document.*

(Continued)

*Primary Examiner*—Shane Bomar
(74) *Attorney, Agent, or Firm*—TraskBritt

(57) ABSTRACT

A casing bit, which may comprise a composite structure, for drilling a casing section into a subterranean formation, and which may include a portion configured to be drilled therethrough, is disclosed. Cutting elements and methods of use are disclosed. Adhesive, solder, electrically disbonding material, and braze affixation of a cutting element are disclosed. Differing abrasive material amount, characteristics, and size of cutting elements are disclosed. Telescoping casing sections and bits are disclosed. Aspects and embodiments are disclosed including: at least one gage section extending from the nose portion, at least one rotationally trailing groove formed in at least one of the plurality of blades, a movable blade, a leading face comprising superabrasive material, at least one of a drilling fluid nozzle and a sleeve, grooves for preferential failure, at least one rolling cone affixed to the nose portion, at least one sensor, discrete cutting element retention structures, and percussion inserts.

86 Claims, 44 Drawing Sheets

U.S. PATENT DOCUMENTS 2,940,731 A 6/1960 Poole
3,266,577 A 8/1966 Turner
3,565,192 A 2/1971 McLarty
3,624,760 A 11/1971 Bodine
3,997,009 A 12/1976 Fox
4,190,383 A 2/1980 Pryke et al.
4,255,165 A 3/1981 Dennis et al.
4,351,401 A * 9/1982 Fielder ..... 175/428
4,413,682 A 11/1983 Callihan et al.
4,618,010 A 10/1986 Falgout, Sr. et al.
4,624,316 A 11/1986 Baldridge et al.
4,673,044 A 6/1987 Bigelow et al.
4,682,663 A 7/1987 Daly et al.
4,759,413 A 7/1988 Bailey et al.
4,782,903 A 11/1988 Strange
4,842,081 A 6/1989 Parant
4,956,238 A * 9/1990 Griffin ..... 428/408
5,025,874 A 6/1991 Barr et al.
5,027,912 A 7/1991 Juergens
5,127,482 A 7/1992 Rector, Jr.
5,135,061 A 8/1992 Newton, Jr.
5,168,941 A 12/1992 Krueger et al.
5,186,265 A 2/1993 Henson et al.
5,259,469 A * 11/1993 Stjernstrom et al. ..... 175/385
5,271,472 A 12/1993 Leturno
5,285,204 A 2/1994 Sas-Jaworsky
5,289,889 A 3/1994 Gearhart et al.
5,311,954 A 5/1994 Quintana
5,322,139 A 6/1994 Rose et al.
5,341,888 A 8/1994 Deschutter
5,379,835 A 1/1995 Streich
5,402,856 A 4/1995 Warren et al.
5,423,387 A 6/1995 Lynde
5,443,565 A 8/1995 Strange, Jr.
5,450,903 A 9/1995 Budde
5,497,842 A 3/1996 Pastusek et al.
5,531,281 A 7/1996 Murdock
5,533,582 A 7/1996 Tibbitts
5,605,198 A 2/1997 Tibbitts et al.
5,706,906 A 1/1998 Jurewicz et al.
5,720,357 A 2/1998 Fuller et al.
5,765,653 A 6/1998 Doster et al.
5,787,022 A 7/1998 Tibbitts et al.
5,842,517 A 12/1998 Coone
5,887,655 A 3/1999 Haugen et al.
5,887,668 A * 3/1999 Haugen et al. ..... 175/79
5,950,747 A 9/1999 Tibbitts et al.
5,957,225 A 9/1999 Sinor
5,960,881 A 10/1999 Allamon et al.
5,979,571 A 11/1999 Scott et al.
5,992,547 A 11/1999 Caraway et al.
6,009,962 A 1/2000 Beaton
6,021,859 A 2/2000 Tibbitts et al.
6,050,354 A 4/2000 Pessier et al.
6,062,326 A 5/2000 Strong et al.
6,063,502 A * 5/2000 Sue et al. ..... 428/469
6,065,554 A 5/2000 Taylor et al.
6,073,518 A 6/2000 Chow et al.
6,098,730 A 8/2000 Scott et al.
6,131,675 A 10/2000 Anderson
6,298,930 B1 10/2001 Sinor et al.
6,360,831 B1 3/2002 Akesson et al.
6,401,820 B1 6/2002 Kirk et al.
6,408,958 B1 6/2002 Isbell et al.
6,415,877 B1 7/2002 Fincher et al.
6,439,326 B1 * 8/2002 Huang et al. ..... 175/334
6,443,247 B1 9/2002 Wardley
6,460,631 B2 10/2002 Dykstra et al.
6,497,291 B1 12/2002 Szarka
6,510,906 B1 * 1/2003 Richert et al. ..... 175/39
6,513,606 B1 2/2003 Krueger
6,540,033 B1 4/2003 Sullivan et al.
6,543,312 B2 4/2003 Sullivan et al.
6,568,492 B2 5/2003 Thigpen et al.
6,571,886 B1 6/2003 Sullivan et al.
6,612,383 B2 9/2003 Desai et al.
6,620,308 B2 * 9/2003 Gilbert ..... 205/702
6,620,380 B2 9/2003 Thomas et al.
6,626,251 B1 9/2003 Sullivan et al.
6,648,081 B2 11/2003 Fincher et al.
6,655,481 B2 * 12/2003 Findley et al. ..... 175/425
6,659,173 B2 12/2003 Kirk et al.
6,672,406 B2 1/2004 Beuershausen
6,702,040 B1 3/2004 Sensenig
6,702,045 B1 * 3/2004 Elsby ..... 175/93
6,708,769 B2 3/2004 Haugen et al.
6,747,570 B2 6/2004 Beique et al.
6,817,633 B2 * 11/2004 Brill et al. ..... 285/333
6,857,487 B2 2/2005 Galloway et al.
6,983,811 B2 1/2006 Wardley
7,025,156 B1 4/2006 Caraway
7,066,253 B2 6/2006 Baker
7,178,609 B2 2/2007 Hart et al.
7,219,752 B2 5/2007 Wassell et al.
2001/0045305 A1 11/2001 Fielder
2002/0069725 A1 6/2002 Watson et al.
2002/0189863 A1 12/2002 Wardley
2003/0029642 A1 2/2003 Dykstra et al.
2003/0164250 A1 9/2003 Wardley
2004/0026126 A1 2/2004 Angman
2004/0124010 A1 7/2004 Galloway et al.
2004/0188141 A1 * 9/2004 Slaughter et al. ..... 175/53
2004/0226751 A1 * 11/2004 McKay et al. ..... 175/57
2004/0245020 A1 * 12/2004 Giroux et al. ..... 175/61
2005/0072565 A1 4/2005 Segura et al.
2005/0103530 A1 * 5/2005 Wheeler et al. ..... 175/171
2005/0145417 A1 * 7/2005 Radford et al. ..... 175/57
2005/0152749 A1 7/2005 Anres et al.
2005/0183892 A1 8/2005 Oldham et al.
2006/0070771 A1 4/2006 McClain et al.
2007/0079995 A1 4/2007 McClain et al.
2007/0284148 A1 12/2007 Wassell et al.
2007/0289782 A1 12/2007 Clark et al.

FOREIGN PATENT DOCUMENTS

CA 2 411 856 12/2001
DE 4432710 C1 4/1996
EP 0 028 121 A1 5/1981
EP 1006260 B1 4/2004
GB 2 086 451 A 5/1982
GB 2 170 528 A 8/1986
GB 2 396 870 A 7/2004
WO WO 93/25794 12/1993
WO WO 96/28635 9/1996
WO WO 98/13572 4/1998
WO 9937881 A2 7/1999
WO WO 00/50730 8/2000
WO 0142617 A1 6/2001
WO WO 01/46550 A1 6/2001
WO WO 01/94738 A1 12/2001
WO WO 02/46564 A2 6/2002
WO WO 03/087525 A1 10/2003
WO WO 2004/076800 A1 9/2004
WO WO 2004/097168 11/2004
WO 2005071210 A1 8/2005
WO 2005083226 A1 9/2005

OTHER PUBLICATIONS

McKay et al, New Developments in the Technology of Drilling with Casing:Utilizing a Displaceable DrillShoe Tool, Mar. 6-7, 2003, whole document.*

U.S. Appl. No. 10/624,952, filed Jul. 22, 2003 entitled "Expandable Reamer Apparatus for Enlarging Boreholes Whiles Drilling and Methods of Use."
Partial International Search Report dated May 27, 2005, (6 pages).
International Search Report, dated Jul. 15, 2005 (6 pages).
Written Opinion of the International Searching Authority, dated Jul. 15, 2005 (11 pages).
Partial International Search Report dated May 27, 2005 (6 pages).
PCT International Search Report for PCT Application No. PCT/US2006/036855, mailed Feb. 1, 2007.
Baker Oil Tools Drill Down Float Shoes, 6 pages, various dates prior to May 23, 1997.
Caledus BridgeBuster Product Information Sheet, 3 pages, 2004.
Downhole Products plc, Davis-Lynch, Inc. Pen-o-trator, 2 pages, no date indicated.
Ray Oil Tool, The Silver Bullet Float Shoes & Collars, 2 pages, no date indicated.
Weatherford Cementation Products, BBL Reamer Shoes, 4 pages, 1998.
PCT International Search Report for PCT Application No. PCT/US2007/011543, mailed Nov. 19, 2007.
U.S. Appl. No. 11/764,008, filed Jun. 15, 2007, entitled "Cutting Elements for Casing Component Drill Out and Subterranean Drilling, Earth Boring Drag Bits and Tools Including Same and Methods of Use," by Danny E. Scott.
U.S. Appl. No. 11/928,956, filed Oct. 30, 2007, entitled "Earth Boring Drill Bits with Casing Component Drill Out Capability and Methods of Use," by Eric E. McClain et al.

* cited by examiner

CASING AND LINER DRILLING BITS

BACKGROUND OF THE INVENTION

1. Field of the Invention

The present invention relates generally to drilling a subterranean borehole and, more specifically, drilling structures disposed on the end of a casing or liner.

2. State of the Art

The drilling of wells for oil and gas production conventionally employs longitudinally extending sections or so-called "strings" of drill pipe to which, at one end, is secured a drill bit of a larger diameter. After a selected portion of the borehole has been drilled, the borehole is usually lined or cased with a string or section of casing. Such a casing or liner usually exhibits a larger diameter than the drill pipe and a smaller diameter than the drill bit. Therefore, drilling and casing according to the conventional process typically requires sequentially drilling the borehole using drill string with a drill bit attached thereto, removing the drill string and drill bit from the borehole, and disposing casing into the borehole. Further, often after a section of the borehole is lined with casing, which is usually cemented into place, additional drilling beyond the end of the casing may be desired.

Unfortunately, sequential drilling and casing may be time consuming because, as may be appreciated, at the considerable depths reached during oil and gas production, the time required to implement complex retrieval procedures to recover the drill string may be considerable. Thus, such operations may be costly as well, since, for example, the beginning of profitable production can be greatly delayed. Moreover, control of the well may be difficult during the period of time that the drill pipe is being removed and the casing is being disposed into the borehole.

Some approaches have been developed to address the difficulties associated with conventional drilling and casing operations. Of initial interest is an apparatus which is known as a reamer shoe that has been used in conventional drilling operations. Reamer shoes have become available relatively recently and are devices that are able to drill through modest obstructions within a borehole that has been previously drilled. In addition, the reamer shoe may include an inner section manufactured from a material which is drillable by drill bits. Accordingly, when cemented into place, reamer shoes usually pose no difficulty to a subsequent drill bit. For instance, U.S. Pat. No. 6,062,326 to Strong et al. discloses a casing shoe or reamer shoe in which the central portion thereof may be configured to be drilled through. In addition, U.S. Pat. No. 6,062,326 to Strong et al. discloses a casing shoe that may include diamond cutters over the entire face thereof, if it is not desired to drill therethrough.

As a further extension of the reamer shoe concept, in order to address the problems with sequential drilling and casing, drilling with casing is gaining popularity as a method for initially drilling a borehole, wherein the casing is used as the drilling conduit and, after drilling, the casing remains downhole to act as the borehole casing. Drilling with casing employs a conventional drill bit attached to the casing string, so that the drill bit functions not only to drill the earth formation, but also to guide the casing into the wellbore. This may be advantageous as the casing is disposed into the borehole as it is formed by the drill bit, and therefore eliminates the necessity of retrieving the drill string and drill bit after reaching a target depth where cementing is desired.

While this procedure greatly increases the efficiency of the drilling procedure, a further problem is encountered when the casing is cemented upon reaching the desired depth. While one advantage of drilling with casing is that the drill bit does not have to be retrieved from the wellbore, further drilling may be required. For instance, cementing may be done for isolating certain subterranean strata from one another along a particular extent of the wellbore, but not at the desired depth. Thus, further drilling must pass through or around the drill bit attached to the end of the casing.

In the case of a casing shoe that is drillable, further drilling may be accomplished with a smaller diameter drill bit and casing section attached thereto that passes through the interior of the first casing to drill the further section of hole beyond the previously attained depth. Of course, cementing and further drilling may be repeated as necessary, with correspondingly smaller and smaller components, until the desired depth of the wellbore is achieved.

However, drilling through the previous drill bit in order to advance may be difficult as drill bits are required to remove rock from formations and accordingly often include very drilling resistant, robust structures typically manufactured from materials such as tungsten carbide, polycrystalline diamond, or steel. Attempting to drill through a drill bit affixed to the end of a casing may result in damage to the subsequent drill bit and bottom-hole assembly deployed or possibly the casing itself. It may be possible to drill through a drill bit or a casing with special tools known as mills, but these tools are unable to penetrate rock formations effectively and the mill would have to be retrieved or "tripped" from the hole and replaced with a drill bit. In this case, the time and expense saved by drilling with casing would have been lost. Therefore, other approaches have been developed to allow for intermittent cementing in combination with further drilling.

In one approach, a drilling assembly, including a drill bit and one or more hole enlargement tools such as, for example, an underreamer, is used which drills a borehole of sufficient diameter to accommodate the casing. The drilling assembly is disposed on the advancing end of the casing. The drill bit can be retractable, removable, or both, from the casing. For example, U.S. Pat. No. 5,271,472 to Leturno discloses a drill bit assembly comprising a retrievable central bit insertable in an outer reamer bit and engageable therewith by releasable lock means which may be pressure fluid operated by the drilling fluid. Upon completion of drilling operations, the motor and central retrievable bit portion may be removed from the wellbore so that further wellbore operations, such as cementing of the drillstring or casing in place, may be carried out or further wellbore extending or drilling operations may be conducted. Since the central portion of the drill bit is removable, it may include relatively robust materials that are designed to withstand the rigors of a downhole environment, such as, for example, tungsten carbide, diamond, or both. However, such a configuration may not be desirable since, prior to performing the cementing operation, the drill bit has to be removed from the wellbore and thus the time and expense to remove the drill bit is not eliminated.

Another approach for drilling with casing involves a casing drilling shoe or bit adapted for attachment to a casing string, wherein the drill bit comprises an outer drilling section constructed of a relatively hard material and an inner section constructed of a drillable material. For instance, U.S. Pat. No. 6,443,247 to Wardley discloses a casing drilling shoe comprising an outer drilling section constructed of relatively hard material and an inner section constructed of a drillable material such as aluminum. In addition, the outer drilling section may be displaceable, so as to allow the shoe to be drilled through using a standard drill bit.

Also, U.S. Patent Application 2002/0189863 to Wardley discloses a drill bit for drilling casing into a borehole, wherein the proportions of materials are selected such that the drill bit provides suitable cutting and boring of the wellbore while being able to be drilled through by a subsequent drill bit. Also disclosed is a hard-wearing material coating applied to the casing shoe as well as methods for applying the same.

However, as a further consideration, the prior art cutting elements may be difficult to drill through when disposed in a region of a casing shoe that is configured to be drilled through. Accordingly, there exists a need for improved cutting elements for use with casing shoes or bits that are configured to drill a borehole.

Moreover, casing bits that are configured to drill a casing section into a subterranean borehole have not, prior to the present invention, included features that may be advantageous. For instance, wear knots, as described with respect to U.S. Pat. No. 6,460,631, assigned to the assignee of the present invention and the disclosure of which is incorporated in its entirety by reference herein, have been limited to use on rotary drill bits for drilling a drill string into a subterranean formation. Also, while reaming drill bits have been used in the past, the inventors are unaware of a casing bit for drilling a casing section into a borehole and having the capability to enlarge or ream an initially smaller borehole, prior to the present invention. Conventional expandable reamers may include blades pivotably or hingedly affixed to a tubular body and actuated by way of a piston disposed therein as disclosed by U.S. Pat. No. 5,402,856 to Warren. Further, U.S. Pat. No. 6,360,831 to Åkesson et al. discloses a conventional borehole opener comprising a body equipped with at least two hole-opening arms having cutting means that may be moved from a position of rest in the body to an active position by way of a face thereof that is directly subjected to the pressure of the drilling fluid flowing through the body. In addition, there exists a need for improved fluid delivery configurations for delivering drilling fluid to the face of a casing shoe.

In addition, conventional casing shoes have not employed stress-related engineered cutting element placement. For instance, U.S. Pat. Nos. 6,021,859, 5,950,747, 5,787,022, and 5,605,198 to Tibbitts et al., assigned to the assignee of the present invention and the disclosures of which are incorporated in their entirety by reference herein, each disclose selective placement of cutting elements engineered to accommodate differing loads such as are experienced at different locations on the bit crown.

Further, conventional casing shoes have not employed depth-of-cut limiting structures. Particularly, U.S. Pat. No. 6,298,930 to Sinor et al., assigned to the assignee of the present invention and the disclosure of which is incorporated in its entirety by reference herein, discloses exterior features disposed on a drill bit that preferably precede, taken in the direction of bit rotation, cutters with which they are associated, and provide sufficient bearing area so as to support the bit against the bottom of the borehole under weight-on-bit without exceeding the compressive strength of the rock formation.

Therefore, it would be desirable to provide a casing bit design for drilling a casing section into a subterranean formation that encompasses the attendant advantages of wear knots, fluid delivery technology, and reaming technology. It would also be desirable to provide a casing bit for drilling a casing section into a subterranean formation effectively, but which is also capable of being drilled by conventional oilfield drill bits.

BRIEF SUMMARY OF THE INVENTION

The present invention contemplates a casing bit configured for drilling a casing section into a subterranean formation. The casing bit of the present invention may include a connection structure for connecting the casing bit to a casing section, an inner profile, an outer profile, and a nose portion. Further, the casing bit may include a plurality of generally radially extending blades disposed on the nose portion, wherein at least one of the plurality of blades carries one or more cutting elements and at least one aperture formed in the nose portion of the casing bit and is configured for delivering drilling fluid from an interior of the casing bit to an exterior thereof. Also, the casing bit may include at least one gage section, the at least one gage section extending longitudinally from the adjacent nose portion of the casing bit.

The casing bit of the present invention may comprise at least one metal, metal alloy, or both, such as, for instance, steel, aluminum, brass, bronze, and may comprise tungsten carbide composites, such as tungsten carbide infiltrated with a hardenable binder, such as a copper-based binder. Further, a casing bit of the present invention may comprise an outer shell exhibiting a reasonably high compressive strength as well as at least one inner core that is relatively ductile material and more readily drillable than the outer shell. For instance, a casing bit of the present invention may comprise a steel outer shell and a phenolic inner core. Alternatively or additionally, the casing bit of the present invention may comprise an impregnated material that includes one or more of natural diamond, synthetic diamond, and carbide. The present invention also contemplates that the casing bit of the present invention may include a coating applied to the exterior thereof and is configured to inhibit adhesion between formation cuttings and the surfaces of the casing bit, inhibit wear, abrasion, or erosion to the surfaces of the casing bit, or both.

The casing bit of the present invention may include a plurality of blades that extend generally radially outwardly in a generally spiral fashion from the centerline to the radial outer extent of the casing bit. Also, the gage regions of each blade may extend longitudinally from the nose portion of the casing bit in a generally helical fashion. Alternatively, the casing bit of the present invention may comprise a bit body that does not include blades, but rather has a substantially symmetrical profile, with respect to the longitudinal axis thereof, that forms the outer surface of the casing bit and cutting elements may be affixed thereto. More particularly, polycrystalline diamond cutting elements, polycrystalline diamond stud-type cutting elements, percussion cutting elements, tungsten carbide cutting elements, or other cutting elements as known in the art may be installed upon such a casing bit.

In another aspect of the casing bit of the present invention, at least one rotationally trailing groove may be formed in at least one of the plurality of blades. For example, the at least one rotationally trailing groove may exhibit a tapered geometry in which the width of the at least one rotationally trailing groove increases along a direction of rotation of the casing bit, or, alternatively, the at least one rotationally trailing groove may exhibit a constant width along a direction of rotation of the casing bit.

As a further facet of the casing bit of the present invention, at least one aperture formed in the casing bit of the present invention may include a retention structure for disposing at least one of a nozzle and a sleeve. Of course, the at least one of a nozzle and a sleeve may be affixed within the retention structure via at least one of welding, brazing, and threaded surfaces and may be replaceable.

Also, the casing bit of the present invention may include an integral stem section which further comprises a float valve mechanism, a cementing stage tool, a float collar mechanism, a landing collar structure, other cementing equipment, or combinations thereof, as known in the art.

In another embodiment of the casing bit of the present invention, at least one rolling cone may be affixed to the nose portion thereof.

At least a portion of the casing bit may be configured to be drilled therethrough by way of a drilling tool having a drilling profile. Moreover, at least a portion of at least one of the inner profile and the outer profile of the casing bit may substantially correspond to the drilling profile of the drilling tool. Such a configuration may facilitate drilling into the casing bit, into the formation from the casing bit, or both.

In addition, cutting elements associated with a portion of the casing bit that is configured to be drilled through may differ from cutting elements associated with a region peripheral thereto. For instance, a majority of the cutting elements associated with a portion of the casing bit that is configured to be drilled through may differ from a majority of the cutting elements associated with a region peripheral thereto. In one example, the size of a majority of the cutting elements of a first portion of the plurality of cutting elements disposed in a casing bit region to be drilled through may be smaller than the size of a majority of the cutting elements of a second portion of the plurality of cutting elements disposed in a peripheral region. Alternatively, the average amount of abrasive material contained by each of the cutting elements of a region that is configured to be drilled through may be less than the average amount of abrasive material contained by each of the cutting elements of a peripheral region. As another alternative, each of, or a majority of, the cutting elements of a region of the casing bit that is configured to be drilled through may be substantially carbide-free. In addition, at least one of the cutting elements generally within a region of the casing bit that is configured to be drilled through may comprise a first grade of cutting element based upon at least one inherent quality related to wear characteristics, while at least one of the cutting elements in a peripheral region may comprise a second grade of cutting element based upon at least one inherent quality related to wear characteristics, wherein the inherent quality of the second grade of cutting element is generally different than the inherent quality of the first grade of cutting element.

The present invention also contemplates that a first plurality of cutting elements disposed upon a casing bit may be more exposed than the second plurality of cutting elements disposed thereon. Further, the first plurality of cutting elements may be configured to initially engage and drill through materials and regions that are different from subsequent materials and regions that the second plurality of cutting elements is configured to engage and drill through. Particularly, the first plurality of cutting elements may comprise tungsten carbide cutting elements and the second plurality of cutting elements may comprise polycrystalline diamond cutting elements.

In addition, cutting elements may be placed upon a casing bit of the present invention according to above-mentioned and incorporated U.S. Pat. Nos. 6,021,859, 5,950,747, 5,787,022, and 5,605,198 to Tibbitts et al.

The present invention also contemplates cutting elements for use upon a casing bit of the present invention. Particularly, a cutting element of the present invention may comprise a superabrasive layer bonded to a substrate wherein the substrate may be substantially free of carbide. For instance, a cutting element substrate may comprise steel, tungsten, titanium-zirconium-molybdenum (TZM), molybdenum, bronze, brass, aluminum, or ceramic. In addition, a substantially carbide free cutting element of the present invention may be formed in response to drilling a subterranean formation, wherein the drilling removes at least a portion of the carbide within the substrate. Also, the superabrasive table of a cutting element may also be sized and configured to wear away in relation to drilling a subterranean formation, so that a relatively small amount of superabrasive material remains, and may exist upon a casing bit employing same at the time that a drilling tool is employed to drill therethrough. In addition, the present invention contemplates that a cutting element material exhibiting relatively high resistance to one or more of abrasion, erosion, and wear may be removed by one or more of mechanical, thermal, or chemical degradation.

In yet another embodiment of a cutting element of the present invention, the superabrasive material included therein may be sized and positioned to facilitate drilling through a casing bit employing same with a drilling tool. More particularly, the abrasive volume of the cutting element may be sized and configured so as to reduce the damage that may be caused in drilling through a casing bit employing one or more of the cutting elements.

The present invention also contemplates a casing bit that is configured as a reamer. More particularly, the casing bit reamer of the present invention may include a pilot drill bit at the lower longitudinal end thereof and an upper reaming structure that is centered with respect to the pilot drill bit and includes a plurality of blades spaced about a substantial portion of the circumference, or periphery, of the reamer. Alternatively, the casing bit reamer of the present invention may be configured as a bicenter bit assembly, which employs two longitudinally superimposed bit sections with laterally offset axes in which usually a first, lower and smaller diameter pilot bit section is employed to commence the drilling, and rotation of the pilot bit section may cause the rotational axis of the bit assembly to transition from a pass-through diameter to a reaming diameter.

Additionally, a casing bit of the present invention may be configured with at least one of an explosive agent and an incendiary agent. As may be appreciated, use of an explosive agent, an incendiary agent, or both, in proximity to a casing bit may facilitate a drilling tool drilling therethrough or passing therethrough. Particularly, a destructive element may be configured to substantially remove, destroy, perforate, degrade, weaken, or otherwise render more drillable a casing bit proximate thereto.

In another aspect of the present invention, a substance delivery assembly may be provided, sized, and configured for selectively delivering a substance to interact with a casing bit to abrade, erode, perforate, dissolve, degrade, weaken, or otherwise render more drillable, a casing bit proximate thereto. For instance, acid or a particulate abrasive may be selectively delivered proximate a casing bit.

In a further facet of the present invention, a casing bit of the present invention may be configured to be preferentially frangible, preferentially weakened, or preferentially fractured. Particularly, grooves or recesses disposed upon the interior, exterior, or both the interior and exterior of the casing bit may be sized and configured to provide selective failure characteristics. For instance, a casing bit may be preferentially weakened to allow failure into sections, or which may allow preferential deformation. Such a configuration may facilitate drilling through the casing bit by removing relatively small pieces thereof by way of drilling fluid, or by deforming the casing bit advantageously for drilling therethrough.

The present invention also contemplates that a casing bit of the present invention may be fabricated from a fiber-reinforced composite, wherein the fiber-reinforced composite comprises one or more fibers disposed within a matrix material. Further, the one or more fibers may extend in a generally circumferential fashion. More specifically, the one or more fibers may be oriented in a concentric fashion or, alternatively, in a spiral fashion.

Also, a casing bit of the present invention, as mentioned above, may comprise one or more shells of differing materials, without limitation. Thus, at least one of the shells of a casing bit of the present invention may comprise a fiber-reinforced composite.

The present invention further contemplates that cutting elements associated with a portion of the casing bit that is configured to be drilled through may be affixed differently from cutting elements associated with a region peripheral thereto. Explaining further, cutting elements associated with a portion of the casing bit that is configured to be drilled through may be configured to be released from the casing bit. For instance, at least one cutting element associated with a portion of the casing bit that is configured to be drilled through may be affixed thereto by way of adhesive. The adhesive may exhibit sufficient strength for drilling operations, but may, in the presence of one or more of heating, impact loading, or increased forces not present during drilling, fail and release cutting elements affixed therewith. Also, a solder may be used to affix at least one cutting element to a casing bit. Alternatively, an electrically disbonding material may affix at least one cutting element to a casing bit that is configured to be drilled through. Accordingly, the electrically disbonding material may fail or weaken in response to electric current flowing therethrough, which may allow the at least one cutting element to be released or removed from the casing bit. In another example, a fastening element may affix at least one cutting element to a casing bit, wherein the at least one cutting element is associated with a portion of the casing bit that is configured to be drilled through. Particularly, an end region of the cutting element may be positioned to allow drilling thereinto, prior to drilling into the abrasive material of the cutting element, by a drilling tool drilling into the inner profile of the casing bit. Alternatively, the cutting element may comprise a stud body that has an end region that extends so as to allow a drilling tool to drill thereinto prior to drilling the abrasive material of the cutting element. The end region of a fastening element or of a stud body of a cutting element may be threaded, welded, pinned, brazed, deformed, or otherwise affixed to the casing bit.

In yet another aspect of the present invention, at least two casing bits of different diameter and having associated casing sections may be assembled to form a drilling assembly for drilling into subterranean formations, wherein radially adjacent casing sections are selectively releasably affixed to one another and wherein the at least two casing bits and casing section are arranged in a telescoping relationship. The smaller casing bit(s) of the at least two casing bits may be configured to drill through the next larger casing bit.

Also, at least two casing sections of different diameter disposed in a telescoping relationship may comprise an assembly for drilling into a subterranean formation. Particularly, a drilling tool which is sized and configured to drill a diameter exceeding the largest diameter of the casing sections may be disposed at the longitudinally preceding end of the at least two casing sections, in relation to the direction of drilling, and radially adjacent casing sections may be selectively releasably affixed to one another.

In another aspect of the present invention, at least a portion of the leading face of a blade of a casing bit may comprise a superabrasive material. For instance, at least a portion of the leading face of a blade of a casing bit may comprise polycrystalline diamond compact (PDC) or thermally stable polycrystalline diamond (TSP) material.

In yet another embodiment of the present invention, at least one reaming blade of a casing bit reamer may be movable or expandable. The at least one expandable blade may be held in place by one or more frangible elements that are failed by a force developed by drilling fluid flowing through an orifice.

In a further aspect of the casing bit of the present invention, at least one sensor configured for measuring a condition of drilling, a condition of the casing bit, or a formation characteristic may be included by the present invention.

The present invention also contemplates that the casing bit of the present invention may include discrete cutting element retention structures for carrying cutting elements. Therefore, the casing bit of the present invention may not include blades or blade-like structures at all. Further, the casing bit of the present invention may be configured to percussion drilling. Thus, accordingly, a casing bit of the present invention may include a plurality of percussion inserts configured for percussion drilling.

Other features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1A:
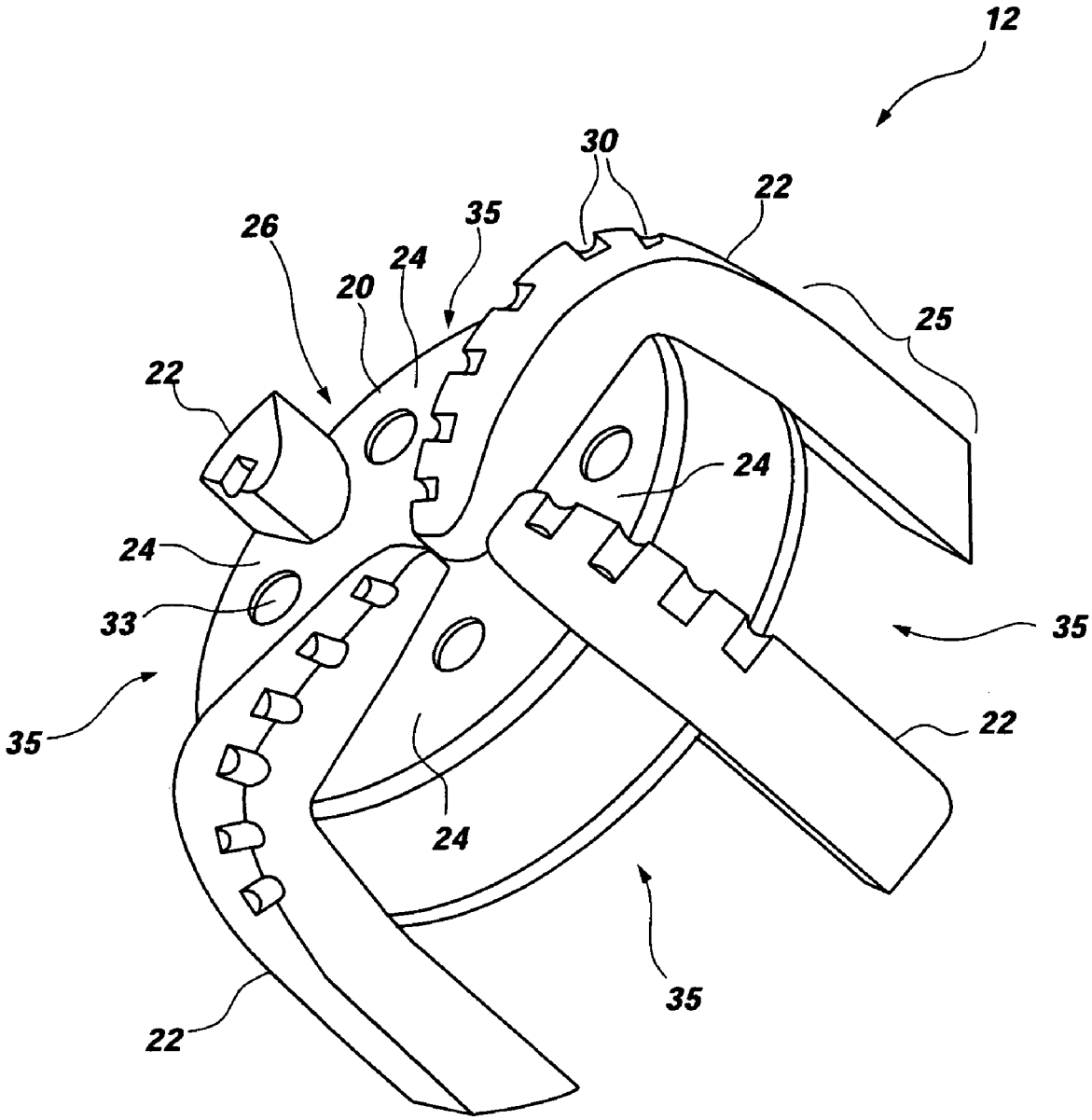
FIG. 1A shows a perspective view of an exemplary casing bit of the present invention.

FIGS. 1A-1D illustrate a casing bit 12 according to the present invention. As shown in FIG. 1A, casing bit 12 includes a nose portion 20 and generally radially extending blades 22, forming fluid courses 24 therebetween extending to junk slots 35 between circumferentially adjacent blades 22. Blades 22 may also include pockets 30, which may be configured to carry cutting elements (not shown), such as, for instance, polycrystalline diamond cutting elements. Generally, a cutting element may comprise a superabrasive region that is bonded to a substrate. A particular cutting element that is used in rotary drill bits is a polycrystalline diamond compact ("PDC") cutter. Rotary drag bits employing PDC cutters have been employed for several decades. PDC cutters are typically comprised of a disc-shaped diamond "table" formed on and bonded under a high-pressure and high-temperature (HPHT) process to a supporting substrate such as cemented tungsten carbide (WC), although other configurations are known. Drill bits carrying PDC cutters, which, for example, may be brazed into pockets in the bit face, pockets in blades extending from the face, or mounted to studs inserted into the bit body, are known in the art. Thus, cutting elements may be affixed upon the blades 22 of casing bit 12 by way of brazing, welding, or as otherwise known in the art. Also, each of blades 22 may include a gage region 25 which is configured to define the outermost radius of the casing bit 12 and, thus the radius of the wall surface of the borehole. Gage regions 25 comprise longitudinally upward (as the casing bit 12 is oriented during use) extensions of blades 22, extending from nose portion 20 and may have wear-resistant inserts or coatings, such as cutters, natural or synthetic diamond, or hardfacing material, on radially outer surfaces thereof as known in the art to inhibit excessive wear thereto.

Figure 1B:
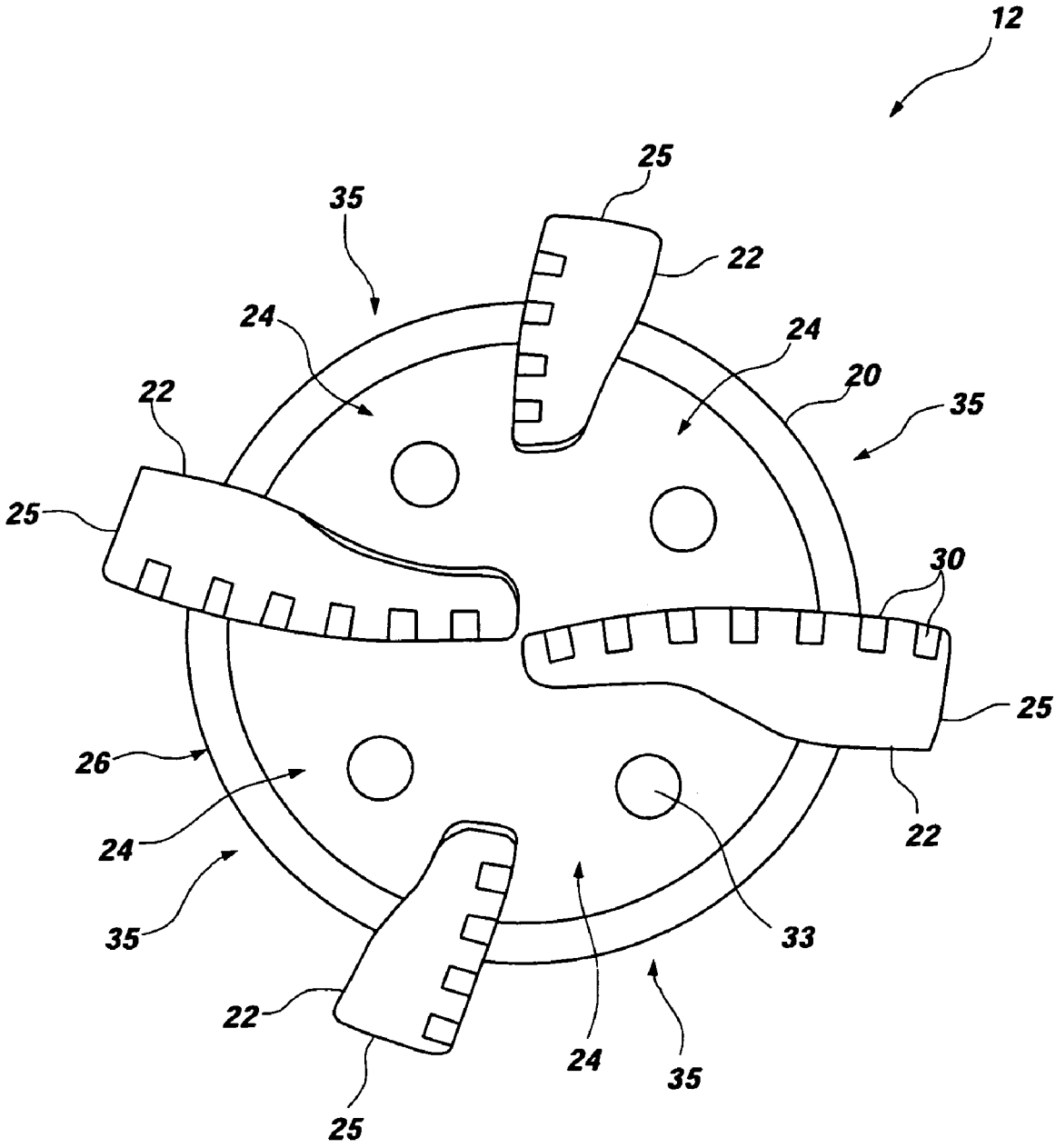
FIG. 1B shows a top view of the casing bit shown in FIG. 1A.
Figure 1C:
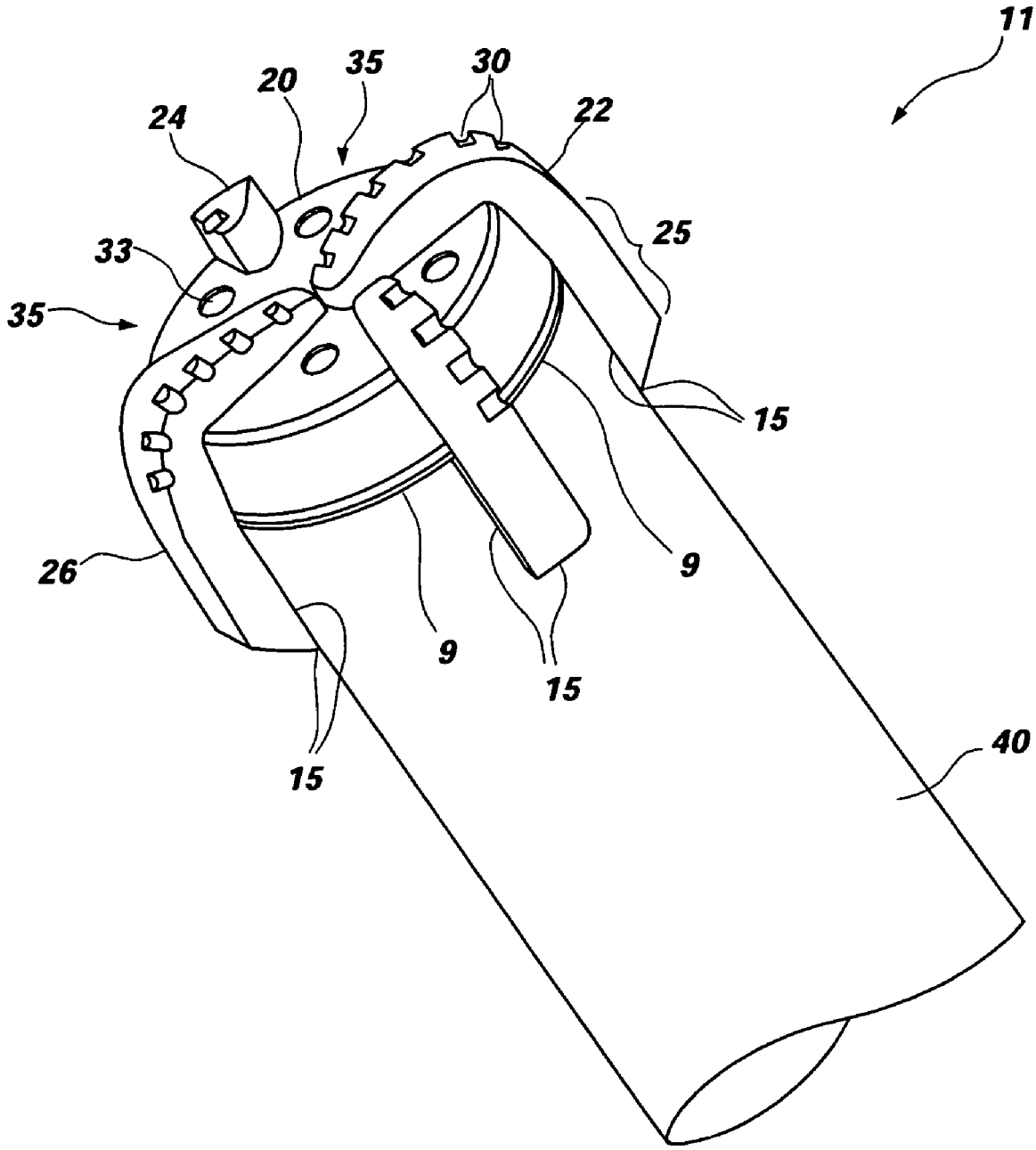
FIG. 1C shows a perspective view of a casing bit assembly including the casing bit as shown in FIGS. 1A and 1B disposed on a casing section.
Figure 1D:
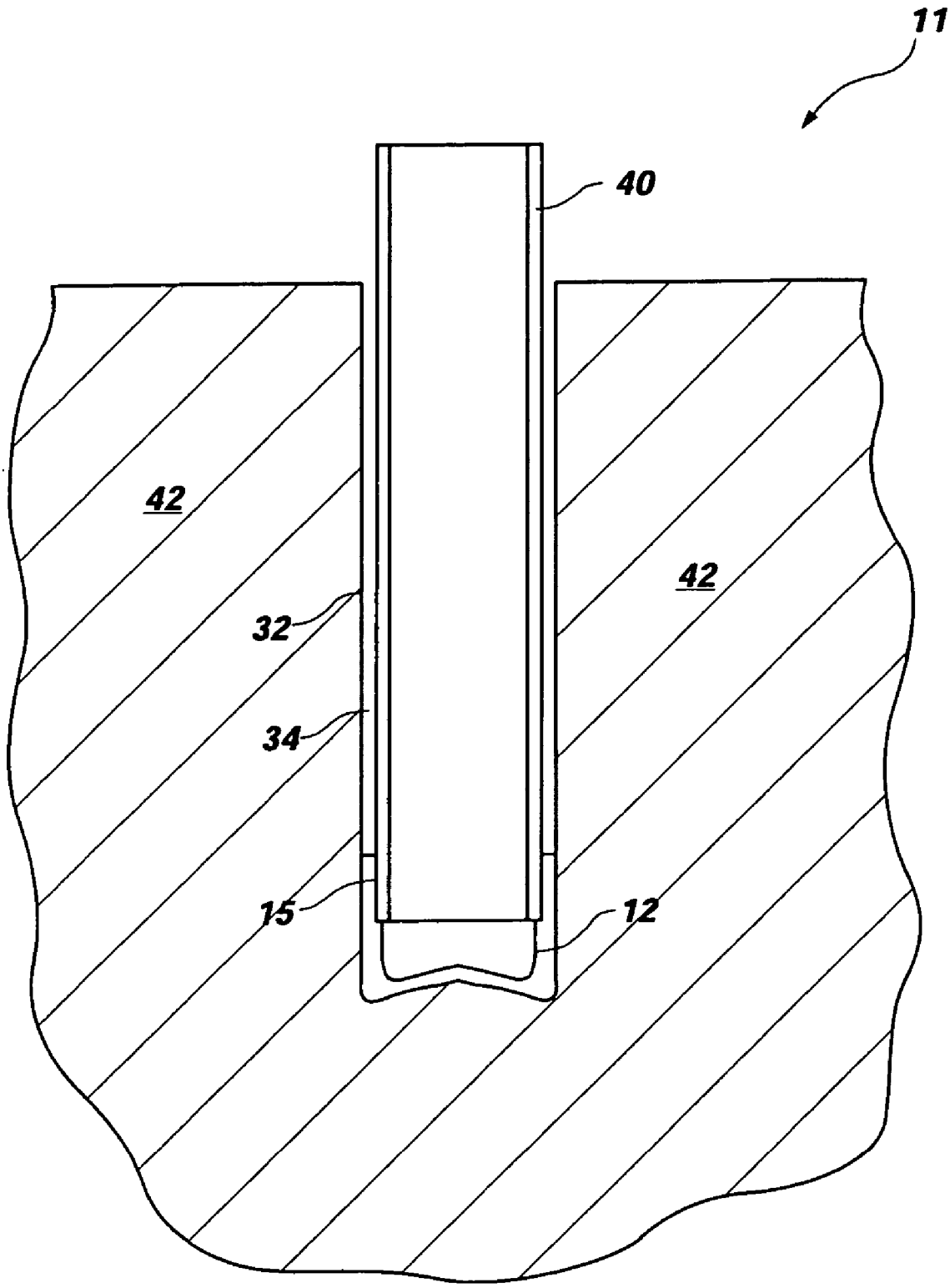
FIG. 1D shows the casing assembly as shown in FIG. 1C within a borehole.

FIG. 1B shows casing bit 12 from an upwardly looking perspective in relation to its face 26, which generally refers to the surface of the nose portion 20 shown in FIG. 1B, as if viewing the casing bit 12 from the bottom of a borehole 32 (FIG. 1D). Casing bit 12 may include a plurality of cutting elements (not shown) bonded by their substrates, as by brazing, into pockets 30 formed in blades 22 extending above the face 26, as is known in the art with respect to the fabrication of so-called "fixed cutter" drill bits. Also, casing bit 12 may comprise metals, metal alloys, or both, such as, for instance, steel, aluminum, brass, and bronze. Further, casing bit 12 may comprise tungsten carbide composites, such as, particularly, tungsten carbide infiltrated with a hardenable binder, such as a copper-based binder as employed to fabricate so called "matrix body" drill bits.

During drilling, fluid courses 24 between circumferentially adjacent blades 22 may be provided with drilling fluid flowing through apertures 33 that extend between the interior of the casing bit 12 and the face 26 thereof. Formation cuttings are swept away from the cutting elements (not shown) by drilling fluid emanating from apertures 33, the fluid moving generally radially outwardly through fluid courses 24 and then upwardly through junk slots 35 to an annulus between the casing section 40 (FIGS. 1C-1E) from which the casing bit 12 is suspended and the borehole 32 (FIG. 1D) and upwardly to the surface of the earth above subterranean formation 42 (FIG. 1D).

FIG. 1C illustrates a casing bit assembly 11 wherein casing bit 12 is disposed on the end of casing section 40. Casing bit 12 may be affixed to casing section 40 by way of welding, threaded connection, pins, brazing, or as otherwise known in the art. Such an affixation may be effected along affixation region 15, wherein gage regions 25 of blades 22 overlap casing section 40 or along circumferential contact region 9 between the casing bit 12 and the casing section 40. For instance, partial circumferential welds may be formed along the circumferential contact region 9 between the casing bit 12 and the casing section 40. In addition, the radially inner surfaces of gage regions 25 of the casing bit 12 may be threaded in order to affix the casing bit 12 to exterior threads (not shown) on the end of casing section 40. The sides and ends of gage regions 25 may also be welded to the casing section 40 to affix the casing bit 12 thereto. However, it should be understood that there are many different configurations that may be employed for affixing the casing bit 12 to the casing section 40. For instance, at least a portion of the casing section 40 may fit inside of the casing bit 12. In addition, the casing bit 12 and casing section 40 may comprise complementary threaded surfaces.

Once the casing bit 12 and the casing section 40 are affixed to one another, the casing bit assembly 11 may be rotated so as to cause casing bit 12 to drill through subterranean formation 42, forming borehole 32, as shown in FIG. 1D which illustrates a side cross-sectional view of casing bit assembly 11 within borehole 32. During drilling, drilling fluid or "mud" may be forced downward through the internal bore of casing section 40 to remove formation cuttings as well as lubricate and cool cutting elements disposed upon the casing bit 12, as explained above. As shown in FIG. 1D, the diameter of the borehole 32 is somewhat larger than the diameter of the casing section 40. The difference in size between the diameter of the borehole 32 as drilled by casing bit 12 and the diameter of the casing section 40 may be configured for disposing cement 34 therebetween.

Accordingly, as shown in FIG. 1D, casing section 40 and casing bit 12 may be surrounded by cement 34, or other hardenable material, so as to cement the casing bit 12 and casing section 40 within borehole 32, after borehole 32 is drilled. Cement 34 may be forced through the interior of casing section 40, through the apertures 33 formed in casing bit 12, about the junk slots 35 (FIGS. 1A and 1B), and into the annulus formed between the wall of borehole 32 and the outer surface of the casing section 40. Of course, conventional float equipment may be used for controlling and delivering the cement to the casing bit 12. Cementing the casing bit assembly 11 into the borehole 32 may stabilize the borehole 32 and seal formations penetrated by borehole 32. In addition, it may be desirable to drill past the casing bit 12, so as to extend the borehole 32, as described in more detail hereinbelow.

Figure 1E:
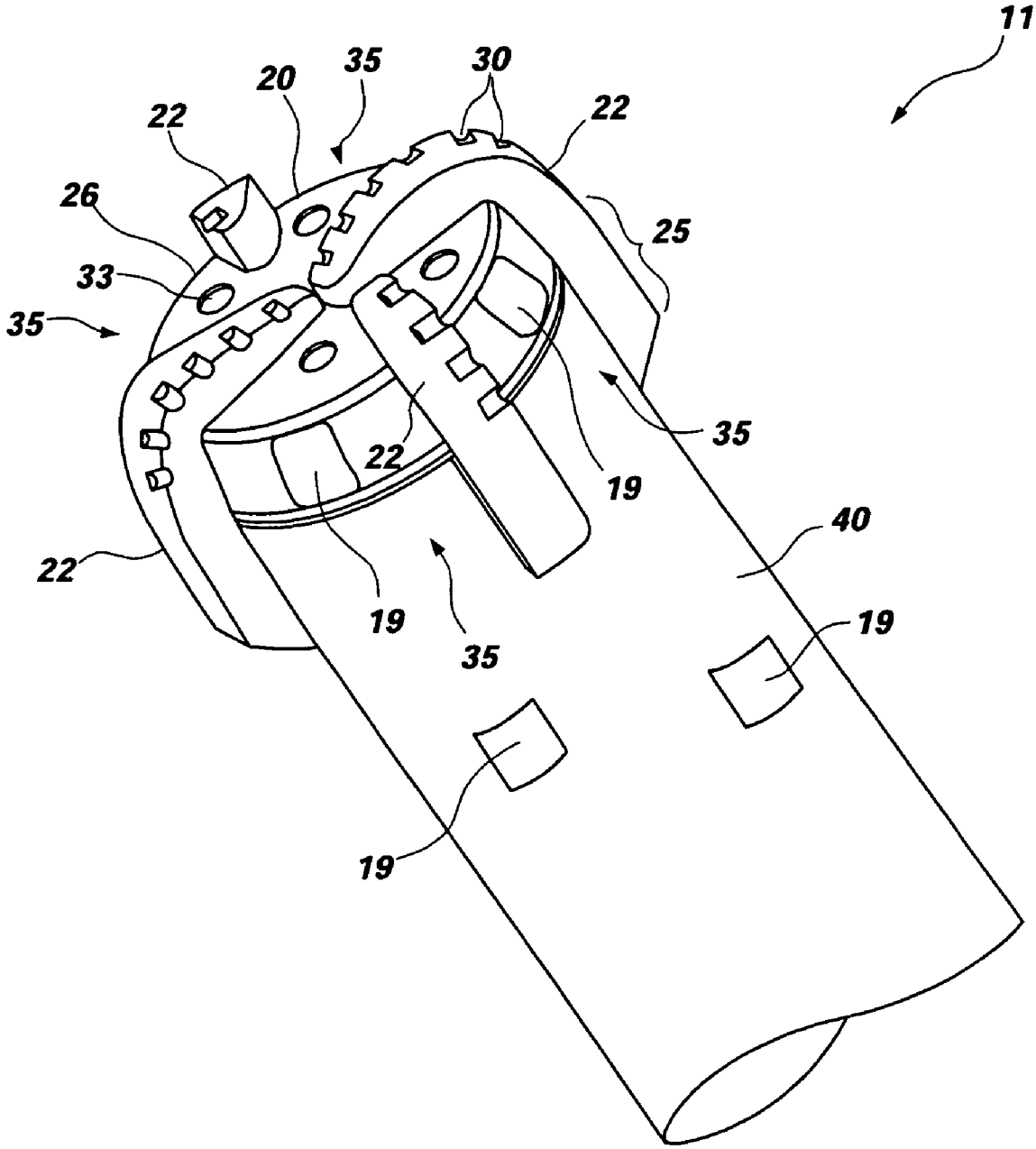
FIG. 1E shows a casing bit assembly according to the present invention wherein the casing bit includes frangible regions.

However, in some instances, the size and placement of apertures 33 that are employed for drilling operations may not be particularly desired for cementing operations. For instance, the apertures configured to deliver a drilling fluid to the cutting elements of the casing bit 12 may become plugged or obstructed prior to or during delivery of cement therethrough. As shown in FIG. 1E, at least one of the casing bit 12 and the casing section 40 may include one or more frangible, perforatable, or otherwise removable regions 19 that are configured for delivering cement or other hardenable material therethrough. The one or more frangible regions 19 may be configured only as a safety mechanism, in case the apertures 33 become obstructed during cementing.

Alternatively, the one or more frangible regions 19 and apertures 33 may be configured so that cement is selectively delivered through the one or more frangible regions 19. For instance, an obstruction element may be "dropped" into the casing section 40, which is configured to engage and seal one or more of the apertures 33 of the casing bit 12. As another alternative, the apertures 33 may be sized so that a hydraulic pressure may build within the casing bit 12 that is sufficient to rupture or otherwise open at least one of the one or more frangible regions 19. The hydraulic pressure may be generated by flow of drilling fluid, cement, or another fluid. It may be further noted that the viscosity of the fluid may be tailored in order to generate pressure within the casing bit 12 for rupturing or opening at least one of the one or more frangible regions 19.

Figure 1F:
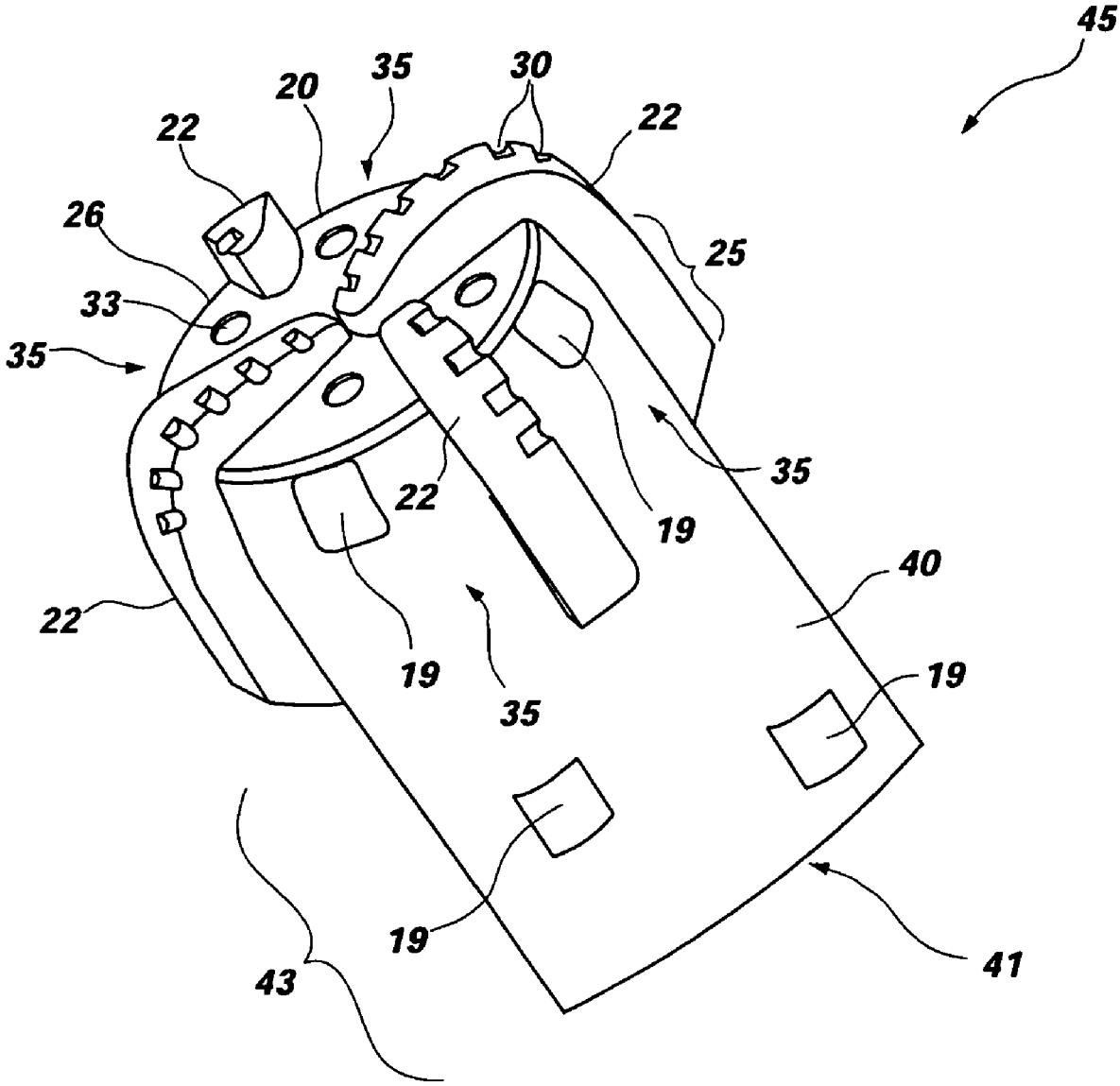
FIG. 1F shows a casing bit assembly according to the present invention wherein the casing bit includes an integral stem section.

As may further be seen in reference to FIG. 1F, casing bit 45 may include an integral stem section 43 extending longitudinally from the nose portion 20 of casing bit 45 that includes one or more frangible regions 19. Alternatively, flow control equipment may be included within integral stem section 43 of casing bit 45. Casing bit 45 includes the above-mentioned features as described in relation to casing bit assembly 11, as labeled and shown in FIG. 1E. However, casing bit 45 may also include a threaded end 41 for attaching the casing bit 45 to a drill string or casing string (not shown). Alternatively or additionally, casing bit 45 may include, without limitation, a float valve mechanism, a cementing stage tool, a float collar mechanism, a landing collar structure, other cementing equipment, or combinations thereof, as known in the art, within integral stem section 43.

Figure 1G:
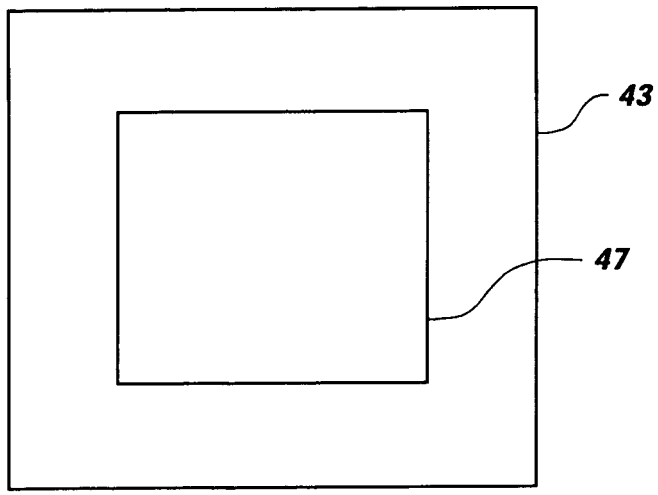
FIG. 1G shows a schematic view of a casing bit including an integral stem section.

More particularly, as shown in FIG. 1G, integral stem section 43 of casing bit 45 may include, as component 47, cementing float valves as disclosed in U.S. Pat. No. 3,997,009 to Fox and U.S. Pat. No. 5,379,835 to Streich, the disclosures of which are incorporated by reference herein. Further, valves and sealing assemblies commonly used in cementing operations as disclosed in U.S. Pat. No. 4,624,316 to Baldridge et al. and U.S. Pat. No. 5,450,903 to Budde, the disclosures of each of which are incorporated by reference herein, may comprise component 47. Further, float collars as disclosed in U.S. Pat. No. 5,842,517 to Coone, the disclosure of which is incorporated in its entirety by reference herein, may comprise component 47. In addition, U.S. Pat. No. 5,960,881 to Allamon et al. and U.S. Pat. No. 6,497,291 to Szarka, the disclosures of which are incorporated in their entirety by reference herein, disclose cementing equipment which may comprise component 47. Any of the above-referenced cementing equipment, or mechanisms and equipment as otherwise known in the art, may be included within integral stem section 43 and may comprise component 47 thereof.

Figure 1H:
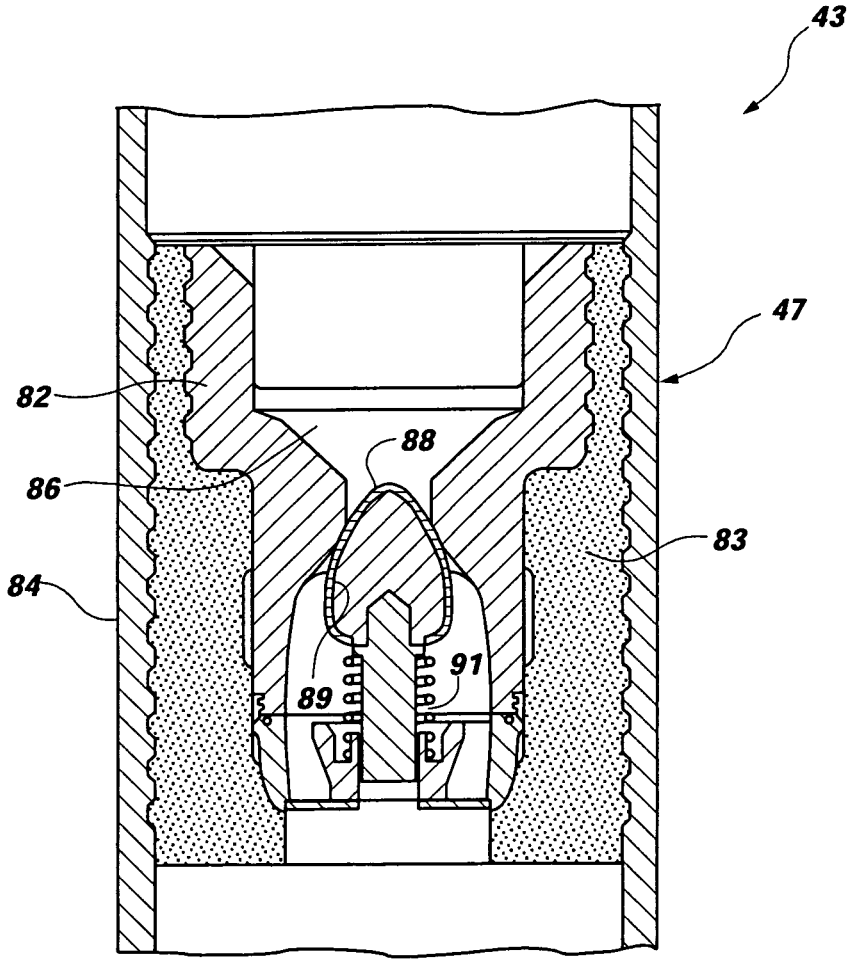
FIG. 1H shows a partial side cross-sectional view of an integral stem section according to the present invention.

In one embodiment, component 47 may comprise a float collar, as shown in FIG. 1H, which depicts a partial side cross-sectional view of integral stem section 43. As shown in FIG. 1H, component 47 may include an inner body 82 anchored within outer body 84 by a short column of cement 83, and having a bore 86 therethrough connecting its upper and lower ends. The bore 86 may be adapted to be opened and closed by check valve 88 comprising a poppet-type valve member 89 adapted to be vertically movable between a lower position opening bore 86 and an upper position closing bore 86, thus permitting flow downwardly therethrough, but preventing flow upwardly therethrough. Therefore, poppet-type valve member 89 may be biased to an upper position by biasing element 91, which is shown as a compression spring; however, other biasing mechanisms may be used for this purpose, such as a compressed gas or air cylinder or an arched spring. Thus, cement may be delivered through check valve 88 and through apertures (not shown) or frangible regions (not shown) formed within the integral stem section 43 or the integral casing bit (not shown), as discussed hereinabove.

Referring to FIGS. 2A-2G of the drawings, as discussed above, casing bit 12 may be affixed to a casing section and cemented within a borehole or wellbore (not shown), as known in the art. FIGS. 2A-2G show partial cross-sectional embodiments of a wellbore assembly 13 according to the present invention including a drilling tool 10 that is disposed within the interior of casing bit 12 for drilling therethrough. Wellbore assembly 13 is shown without a casing section attached to the casing bit 12, for clarity. However, it should be understood that the embodiments of wellbore assembly 13 as shown in FIGS. 2A-2G may include a casing section which may be cemented within a borehole as described and shown in FIG. 1D.

Generally, referring to FIGS. 2A-3B, a drilling tool 10 may include a drilling profile 14 defined along its lower region that is configured for engaging and drilling through the subterranean formation. Explaining further, the drilling profile 14 of the drilling tool 10 may be defined by cutting elements (FIGS. 3A and 3B) that are disposed along a path or profile of the drilling tool 10. Thus, the drilling profile 14 of drilling tool 10 refers to the drilling envelope or drilled surface that would be formed by a full rotation of the drilling tool 10 about its drilling axis (not shown). Of course, drilling profile 14 may be at least partially defined by generally radially extending blades (not shown) disposed on the drilling tool 10, as known in the art. Moreover, drilling profile 14 may include arcuate regions, straight regions, or both, as shown in FIGS. 2A-3B.

Casing bit 12 may include an outer profile 18 defined along its lowermost region, the lowermost region configured to drill through a subterranean formation. The outer profile 18 of casing bit 12 refers to either the drilling profile 14 of the casing bit 12, as explained above in relation to drilling tool 10, or the exterior geometry of the casing bit 12. According to the present invention, casing bit 12 may include an inner profile 16 which substantially corresponds to the drilling profile 14 of drilling tool 10. Such a configuration may provide greater stability in drilling through casing bit 12. Particularly, forming the geometry of drilling profile 14 of drilling tool 10 to conform or correspond to the geometry of the inner profile 16 of casing bit 12 may allow for cutters (labeled "50" in FIGS. 3A and 3B) disposed on the drilling tool 10 to engage the inner profile 16 of casing bit 12 at least somewhat concurrently, thus equalizing the forces, the torques, or both, of cutting therethrough.

Figure 2A:
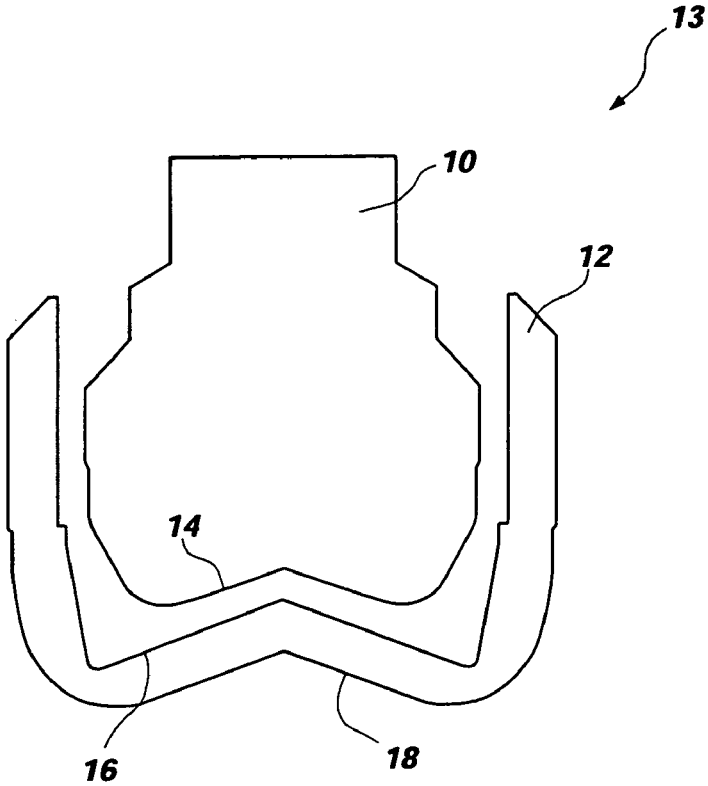
FIGS. 2A-2G each show a schematic cross-sectional view of a wellbore assembly of the present invention including a drilling tool disposed within a casing bit of the present invention.

For instance, referring to FIG. 2A, the drilling profile 14 of drilling tool 10 substantially corresponds to the inner profile 16 of casing bit 12, both of which form a so-called "inverted cone." Put another way, the drilling profile 14 slopes longitudinally upwardly from the outer diameter of the drilling tool 10 toward the center of the drilling tool 10. Therefore, as the drilling tool 10 engages the inner profile 16 of casing bit 12, the drilling tool 10 may be, at least partially, positioned by the respective geometries of the drilling profile 14 of the drilling tool 10 and the inner profile 16 of the casing bit 12. In addition, because the cutting structure (not shown) of the drilling tool 10 contacts the inner profile 16 of the casing bit 12 substantially uniformly, the torque generated in response to the contact may be distributed, to some extent, more equally upon the drilling tool 10.

Figure 2B:
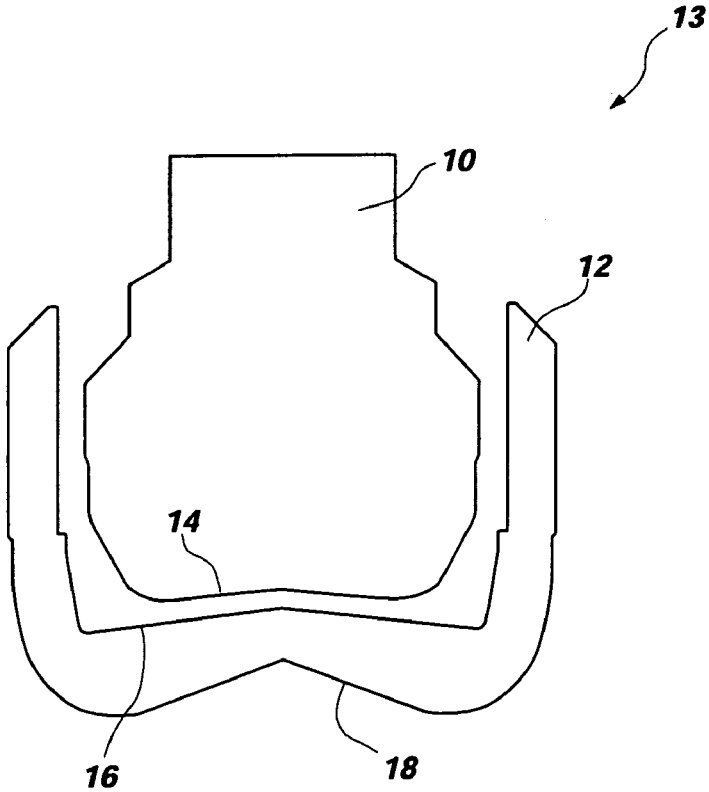
Figure 2C:
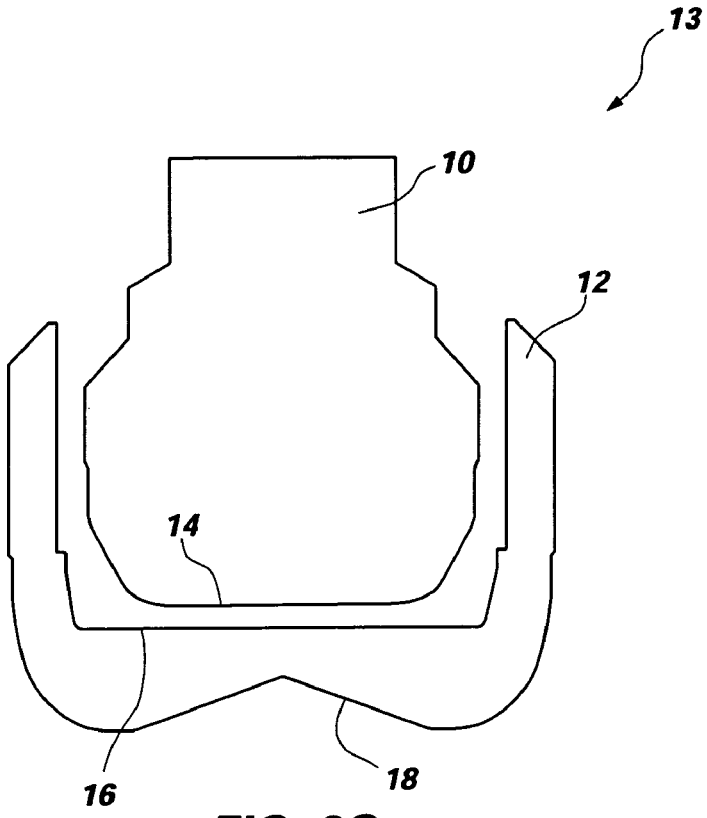

Similarly, FIG. 2B shows a wellbore assembly 13 comprising drilling tool 10 including a drilling profile 14 shaped as a slightly inverted cone which substantially corresponds to the inner profile 16 of casing bit 12. FIG. 2C illustrates another embodiment of a wellbore assembly 13 wherein the drilling profile 14 of the drilling tool 10 substantially corresponds to the inner profile 16 of the casing bit 12. Particularly, each of the drilling profile 14 of the drilling tool 10 and the inner profile 16 of the casing bit 12 exhibits a substantially flat or planar geometry.

Figure 2D:
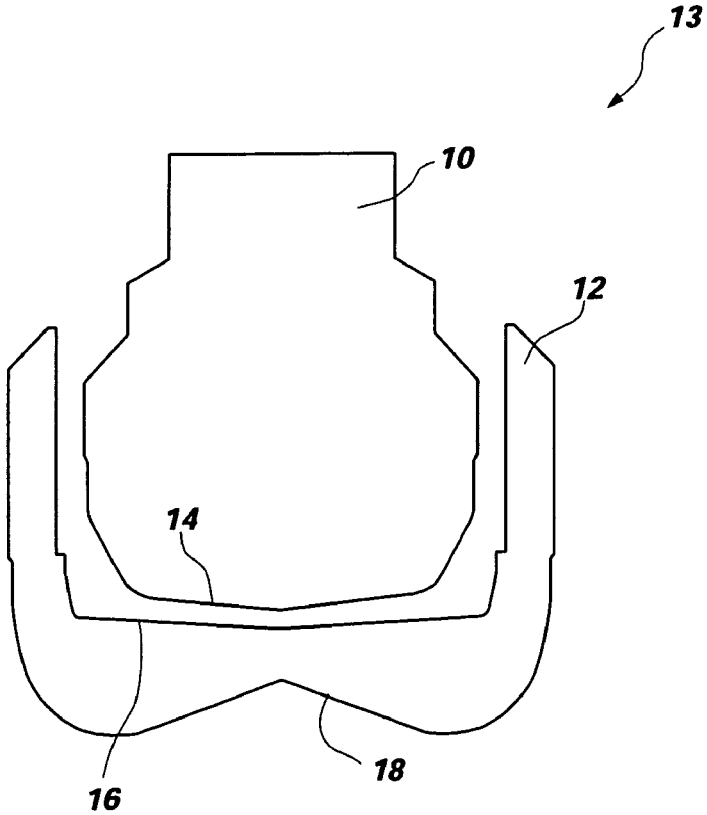

Alternatively, as shown in FIG. 2D, the drilling profile 14 of drilling tool 10 may be pointed or at least partially form a conical geometry while the inner profile 16 of the casing bit 12 substantially corresponds thereto. Generally, a tapered or rounded drilling profile 14 of drilling tool 10 which corresponds to a tapered or rounded inner profile 16 of a casing bit 12 may position or center the drilling tool 10 as it drills through the casing bit 12.

Of course, the inner profile 16 of casing bit 12 may also be shaped in relation to the outer profile 18 thereof. Selectively configuring the inner profile 16 of casing bit 12 in relation to the outer profile 18 thereof may be advantageous to stabilize the drilling tool 10 as it drills through casing bit 12. More specifically, the distance or thickness between the inner profile 16 and outer profile 18 of casing bit 12 may be configured to provide a suitable stabilizing bore surface formed by the formation below the outer profile 18 of the casing bit 12.

Figure 2E:
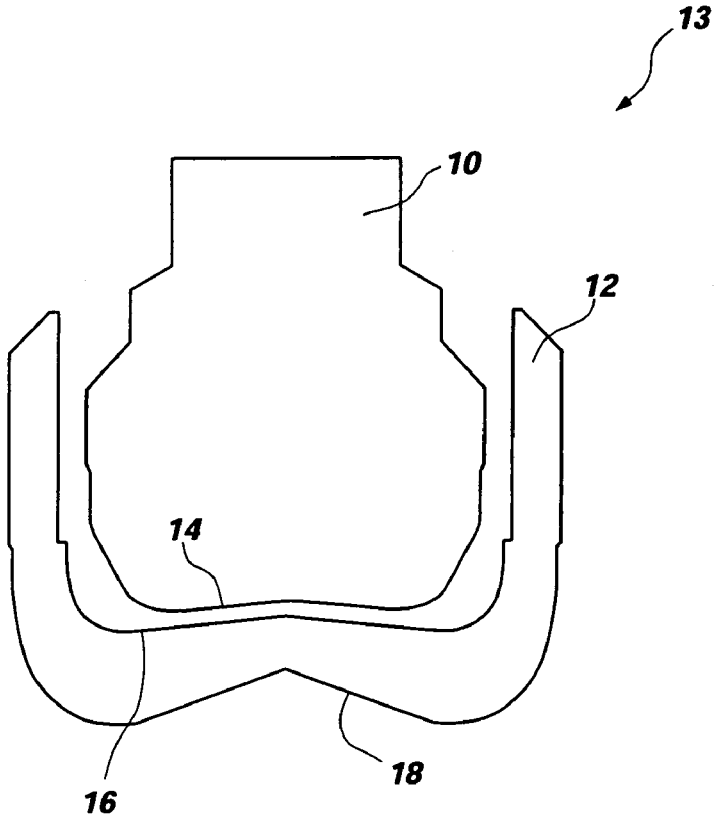
Figure 2F:
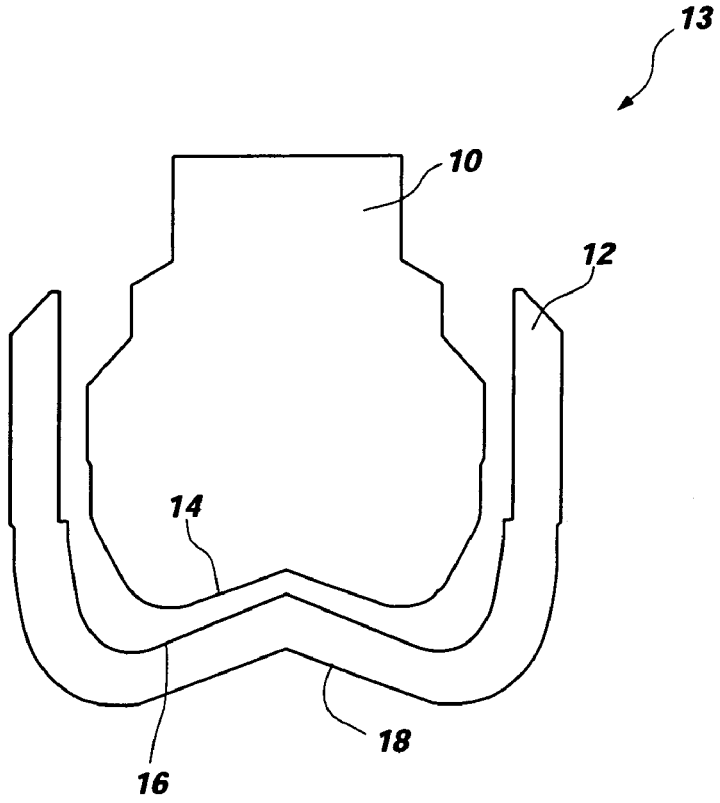
Figure 2G:
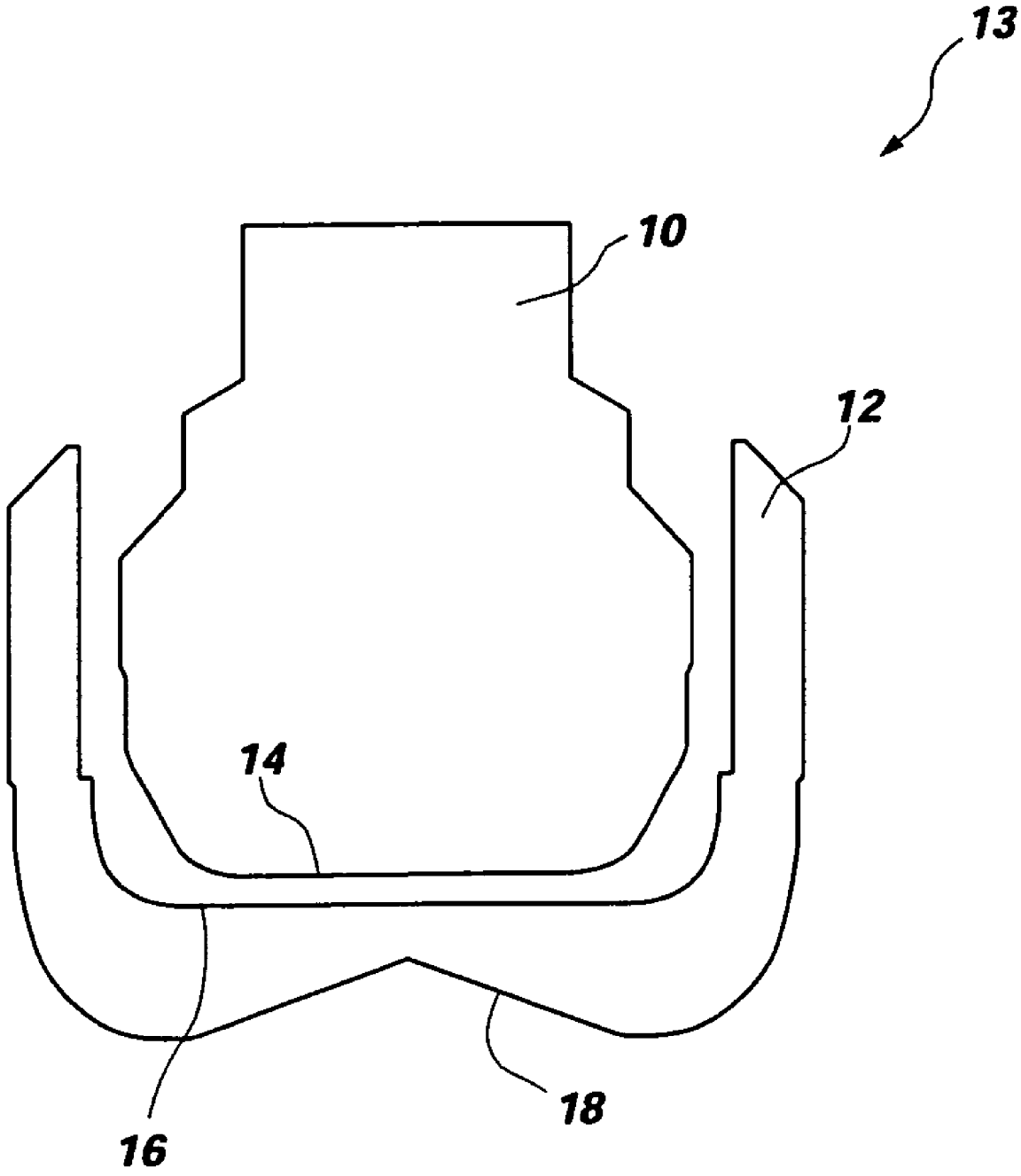

FIG. 2E shows drilling profile 14 of drilling tool 10 which substantially corresponds to the inner profile 16 of casing bit 12, wherein both are shaped in a slightly inverted cone geometry and wherein the laterally outer portions of inner profile 16 are rounded or exhibit a fillet. "Laterally", as used herein, means a distance in relation to a central axis or drilling axis of the drilling tool. The amelioration of sharp corners may reduce undesirable stresses in the casing bit 12 or may improve the performance of drilling tool 10 during drilling through the casing bit 12. Similarly, FIG. 2F illustrates a drilling tool 10 including a drilling profile 14 that substantially corresponds to the inner profile 16 of the casing bit 12 wherein the outer profile 18 of the drilling tool 10 forms an inverted cone geometry. In addition, the inner profile 16 of the casing bit 12 includes rounded or filleted laterally outer portions thereof. Also, FIG. 2G illustrates a drilling tool 10 including a drilling profile 14 that substantially corresponds to the inner profile 16 of the casing bit 12 wherein the outer profile 18 of the drilling tool 10 is shaped substantially flat or planar. In addition, the inner profile 16 of the casing bit 12 includes laterally outer portions that are rounded or filleted.

Figure 3A:
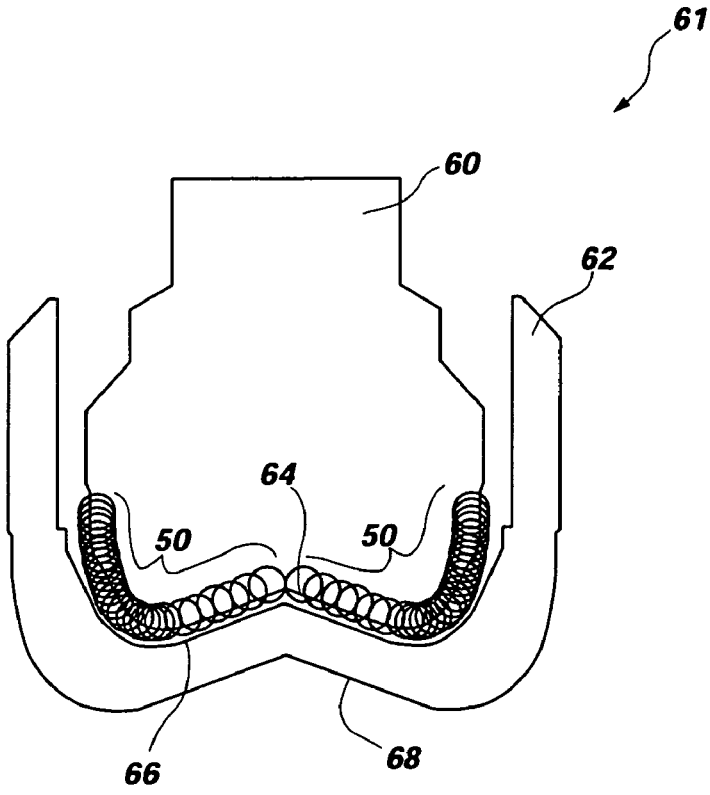
FIGS. 3A and 3B each show a schematic cross-sectional view of a wellbore assembly of the present invention including a drilling tool having cutters defining a drilling profile disposed within a casing bit of the present invention.
Figure 3B:
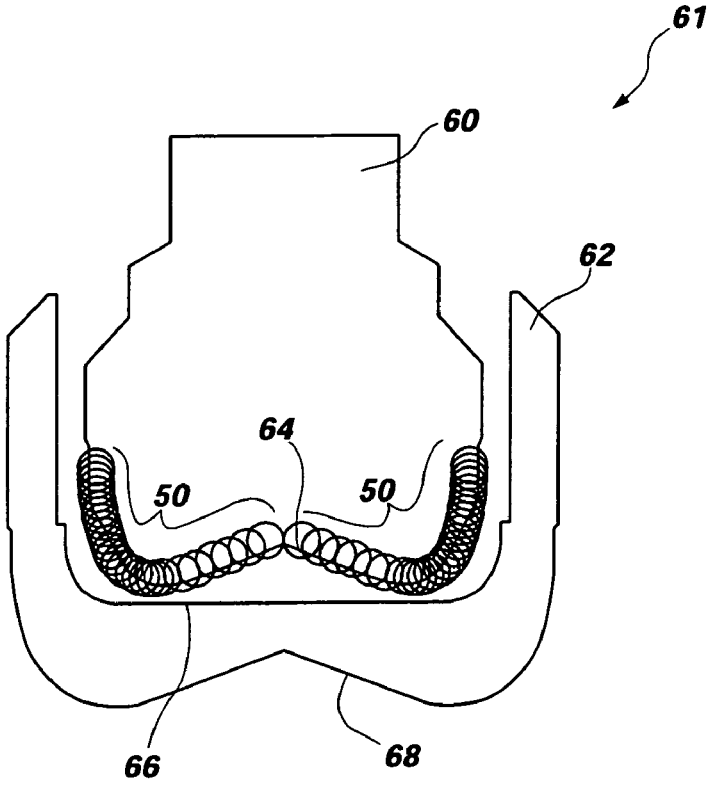

In another aspect of the present invention, as shown in FIGS. 3A and 3B, the outer profile 68 of casing bit 62 of assembly 61 may have a geometry that substantially corresponds to the drilling profile 64 of drilling tool 60. In FIGS. 3A and 3B, all the cutting elements 50 are shown on each side (with respect to the central axis of the drilling tool 60) of the drilling tool 60, and are shown as if all the cutting elements 50 were rotated into a single plane. Thus, the lower surface of the overlapping cutting elements 50 forms the drilling profile 64 of drilling tool 60, the drilling profile 64 referring to the drilling envelope formed by a full rotation of the drilling tool 60 about its drilling axis (not shown). As seen with respect to FIGS. 3A and 3B, the outer profile 68 of casing bit 62 may substantially correspond to the drilling profile 64 formed by the cutting elements 50 disposed on the drilling tool 60 during a full rotation of the drilling tool 60. Particularly, both FIGS. 3A and 3B show a drilling profile 64 and an outer profile 68 of casing bit 62 that are shaped as an inverted cone geometry. As may be further appreciated, inner profile 66 may also substantially correspond to the drilling profile 64 of drilling tool 60 or may be shaped differently than drilling profile 64 as illustrated in FIG. 3A and FIG. 3B, respectively.

Accordingly, as may be seen by reference to FIGS. 2A-3B, casing bit 12, 62 of the present invention may have an outer profile and an inner profile, wherein at least one of the outer profile and the inner profile substantially corresponds to the drilling profile of drilling tool 10, 60. Such a configuration may facilitate drilling through the casing bit 12, 62 with the drilling tool 10, 60, drilling into a subterranean formation subsequent to drilling through the casing bit 12, 62, or both.

Figure 4A:
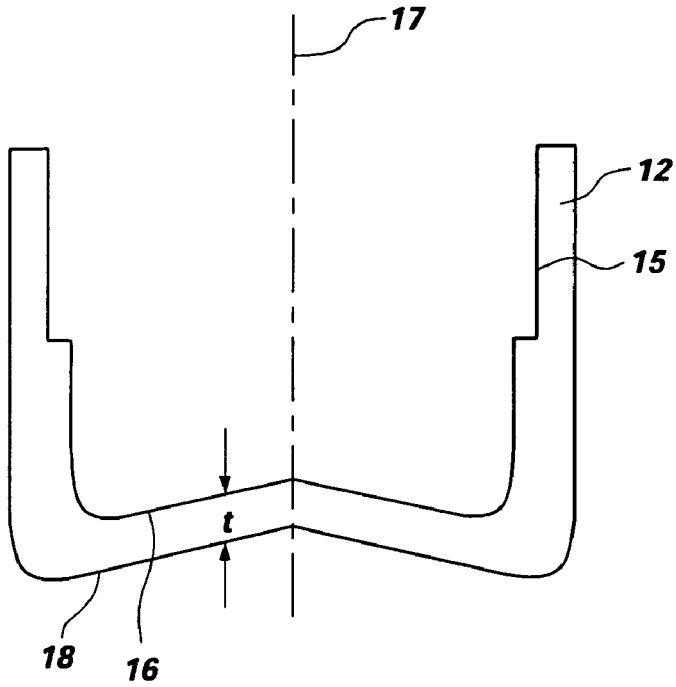
FIG. 4A shows a schematic cross-sectional view of a casing bit of the present invention.

Turning now to FIG. 4A, the casing bit 12 may be designed to minimize the average thickness thereof in the region configured for drilling therethrough in relation to expected loading conditions due to torque and weight-on-bit applied to the casing bit 12 during drilling. The thickness, labeled "t" on FIG. 4A, of casing bit 12 generally refers to the distance between the surface formed by the inner profile 16 and the surface formed by the outer profile 18 along the expected direction of drilling therethrough (shown in FIG. 4A as vertical). Accordingly, reducing the average thickness t of casing bit 12 in the region configured for drilling therethrough may aid in drilling therethrough by way of drilling tool 10 or may reduce damage to cutting elements carried by drilling tool 10. Reducing the average thickness t of casing bit 12 may be accomplished by finite element modeling or other predictive modeling of the stresses that are generated by expected forces of drilling, such as torque and weight-on-bit. Specifically, the average thickness of the casing bit 12 may be selected so that the maximum predicted stress in the casing bit 12 in response to the expected forces of drilling is at least one and one-half times the yield stress of the material comprising the casing bit 12, but may be between one and one-half and three times the yield stress thereof, or more. Finite element analysis or other modeling concepts may be employed to predict or model the stresses within casing bit 12 that may be experienced by drilling therewith.

Figure 4B:
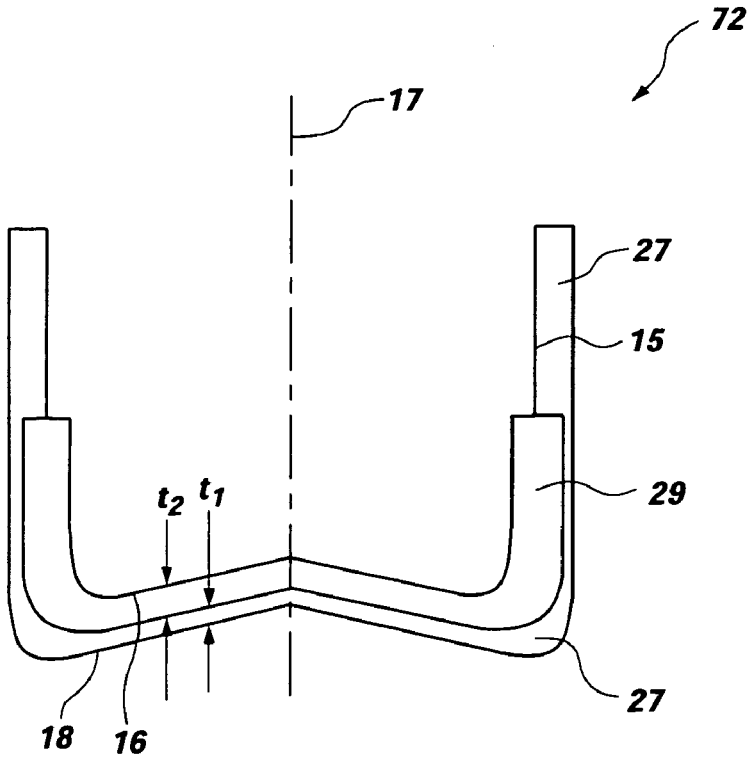
FIG. 4B shows a schematic cross-sectional view of a casing bit of the present invention.

In another aspect of the present invention, FIG. 4B shows casing bit 72 comprising a relatively thin outer shell 27 having a thickness $t_1$ and at least one inner core 29 having a thickness $t_2$ that is disposed therein. It may be appreciated that if outer shell 27 comprises a material with a reasonably high yield stress, so that selecting the average thickness $t_1$ thereof by way of finite element modeling or other predictive modeling of the stresses in relation to expected forces of drilling, such as torque and weight-on-bit, may yield a relatively small thickness $t_1$. As may also be appreciated, affixation region 15 may be preferably formed as a portion of outer shell 27, without limitation. Such a thickness may result in outer shell 27 exhibiting relative flexibility and, therefore, may become damaged by flexure by drilling solely therewith. However, inner core 29 may be disposed and affixed within outer shell 27 to provide stiffness and strength thereto. Of course, additional shells or layers (not shown), if any, may be affixed adjacent inner core 29, and so on, respectively. Thickness $t_2$ may be selected in relation to $t_1$, so that the maximum predicted stress in the casing bit 72 in response to the expected forces of drilling is at least two times the yield stress of the material in which the stress exists, but may be between two and three times the yield stress of the material in which the stress exists, or more. Such a configuration may facilitate drilling through casing bit 72 subsequent to drilling a borehole therewith. Outer shell 27 may comprise steel, iron alloys, tungsten carbide powder infiltrated with a copper based binder, nickel alloys, any of which may be machined or cast to form outer profile 18. Inner core 29 may preferably comprise a relatively ductile material that is more readily drillable than outer shell 27, such as aluminum, brass, bronze, or phenolic. Inner core 29 material may be disposed within outer shell 27 in a molten form, if appropriate, and molded or machined to form inner profile 18. Additional shells or inner cores (not shown) may also be formed in accordance to outer shell 27 or inner core 29, without limitation. Alternatively, outer shell 27 and at least one inner core 29 may be formed separately and affixed to one another by fasteners, welding, brazing, or other mechanical affixation techniques as known in the art. Such a configuration may provide sufficient strength and stiffness to the casing bit 72 for drilling a subterranean formation, while facilitating subsequent drilling therethrough.

Figure 5:
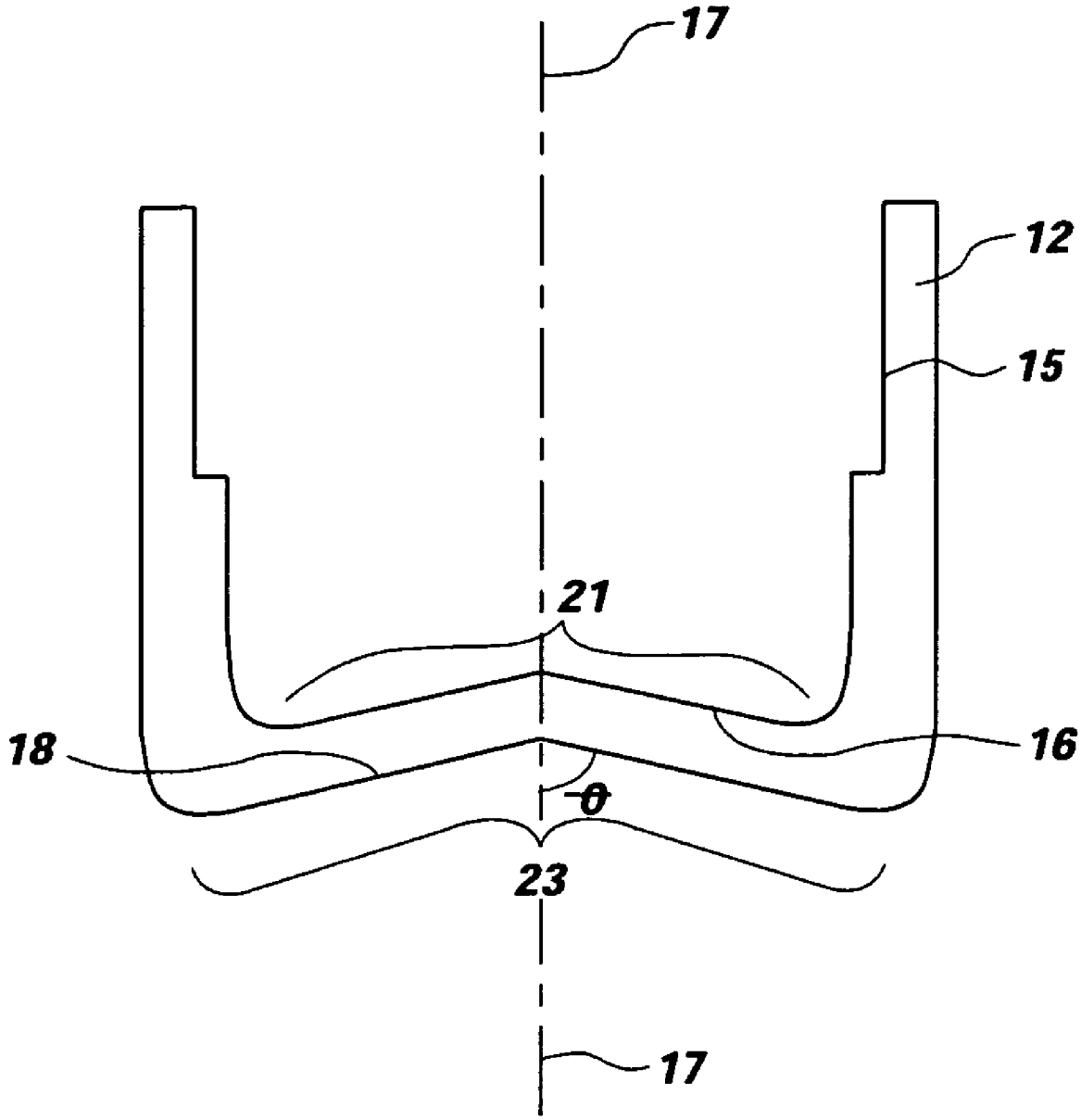
FIG. 5 shows a schematic cross-sectional view of a casing bit of the present invention.

As discussed above, a casing bit of the present invention may have an outer profile that exhibits an inverted cone geometry. As shown in more detail in FIG. 5, a casing bit 12 of the present invention may include an outer profile 18 that forms an inverted cone region 23, as mentioned above. More specifically, the inner straight line forming a portion of outer profile 18 and extending from longitudinal axis 17 may be oriented at an angle θ that is less than 90° with respect to the longitudinal axis 17, thus forming an "inverted cone" region 23. Such a configuration may improve drilling performance of casing bit 12. In addition, inner profile 16 may generally correspond to the shape of the outer profile 18, as shown in FIG. 5. As mentioned above, an upwardly extending feature, such as region 21 of casing bit 12 may be configured to facilitate centering of a drilling tool (not shown) that exhibits a generally concave-shaped outer profile while the drilling tool drills through the casing bit 12. Such a configuration may also stabilize the drilling tool as it drills through the casing bit 12.

Figure 6A:
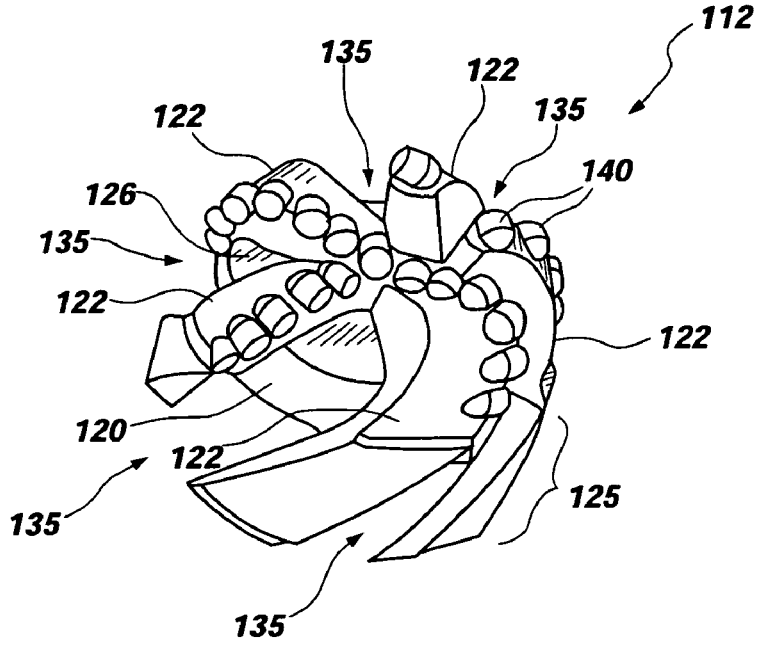
FIG. 6A shows a perspective view of a casing bit according to the present invention, wherein the casing bit includes spiral blades.
Figure 6B:
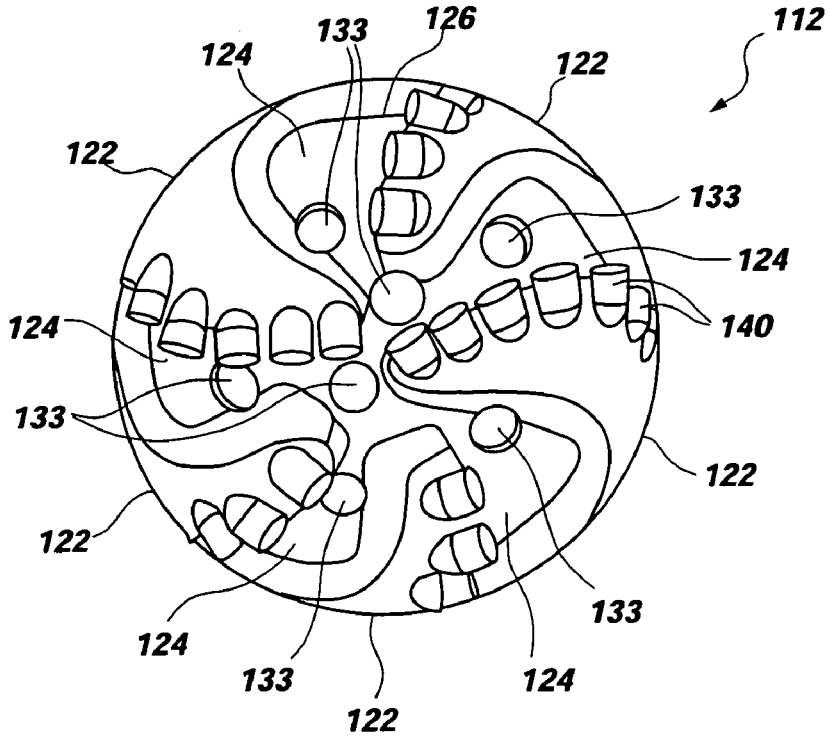
FIG. 6B shows top view of the casing bit shown in FIG. 6A.

FIGS. 6A and 6B illustrate a casing bit 112 according to the present invention, the casing bit 112 including a nose portion 120, face 126, generally radially extending blades 122, and forming fluid courses 124 extending to junk slots 135 between circumferentially adjacent blades 122, as generally described in relation to FIGS. 1A and 1B. However, blades 122 include cutting elements 140, such as, for instance, PDC cutting elements. Cutting elements 140 may be affixed upon the blades 122 within pockets (not shown) of casing bit 112 by way of brazing, welding, or as otherwise known in the art. Also, casing bit 112 may comprise, without limitation, metals, metal alloys, particulate composites or any combination thereof, such as, for instance, steel, aluminum, bronze, brass, and tungsten carbide composites.

Blades 122, as shown in FIGS. 6A and 6B, may be curved and extend generally radially outwardly in a generally spiral fashion from the centerline to the radial outer extent of the casing bit 112. In addition, the gage regions 125 of blades 122 may extend longitudinally away from the nose portion 120 of the casing bit 112 in a generally helical fashion, defining junk slots 135 between circumferentially adjacent gage regions 125. Also, the gage regions 125 of blades 122 may be configured to define the outermost radial extent of casing bit 112 and substantially a radius of the wall surface of the borehole. Gage regions 125 may have wear-resistant inserts or coatings, such as cutters, natural or synthetic diamond, or hardfacing material, on radially outer surfaces thereof as known in the art to inhibit excessive wear thereto. The elongated nature of the spiraled blades 122 may provide additional length along which cutting structures may be disposed so as to enhance cutting redundancy at any given radius. In addition, such a configuration may provide increased circumferential contact around the borehole which may improve the stability of the drilling operation during use of the casing bit 112.

During drilling, fluid courses 124 between circumferentially adjacent blades 122 may be provided with drilling fluid flowing from apertures 133 that extend from the interior of the casing bit 112 to the face 126 thereof. Formation cuttings may be swept away from cutting elements 140 by drilling fluid emanating from apertures 133, the fluid moving generally radially outwardly through fluid courses 124 and then upwardly through junk slots 135 to an annulus between the casing section (not shown) to which the casing bit 112 may be affixed.

Figure 7A:
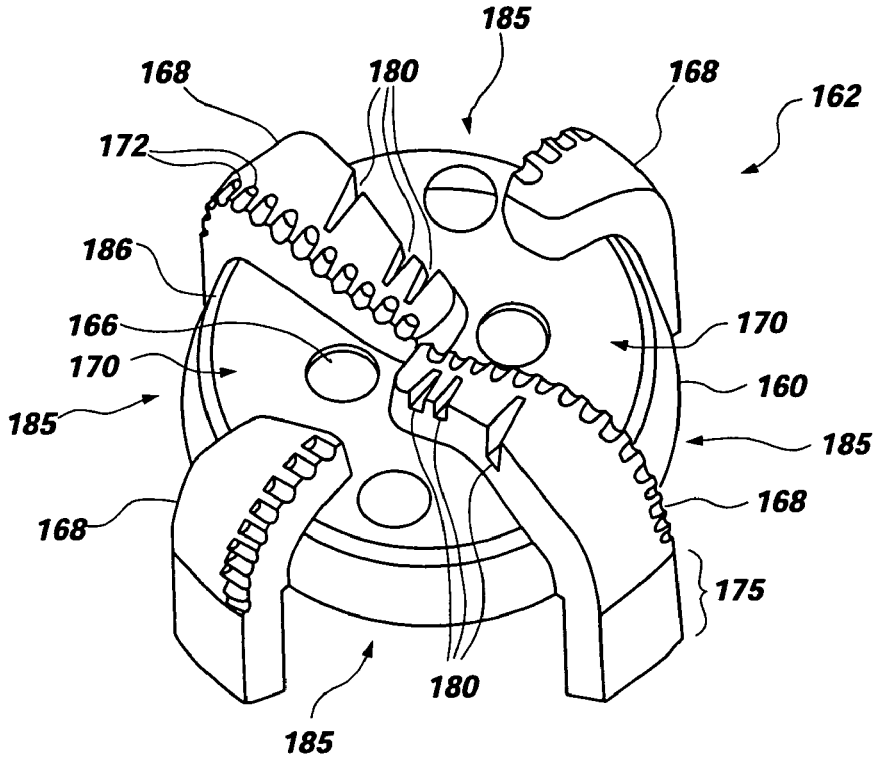
FIGS. 7A and 7B each illustrate perspective views of a casing bit of the present invention which includes rotationally trailing grooves.
Figure 7B:
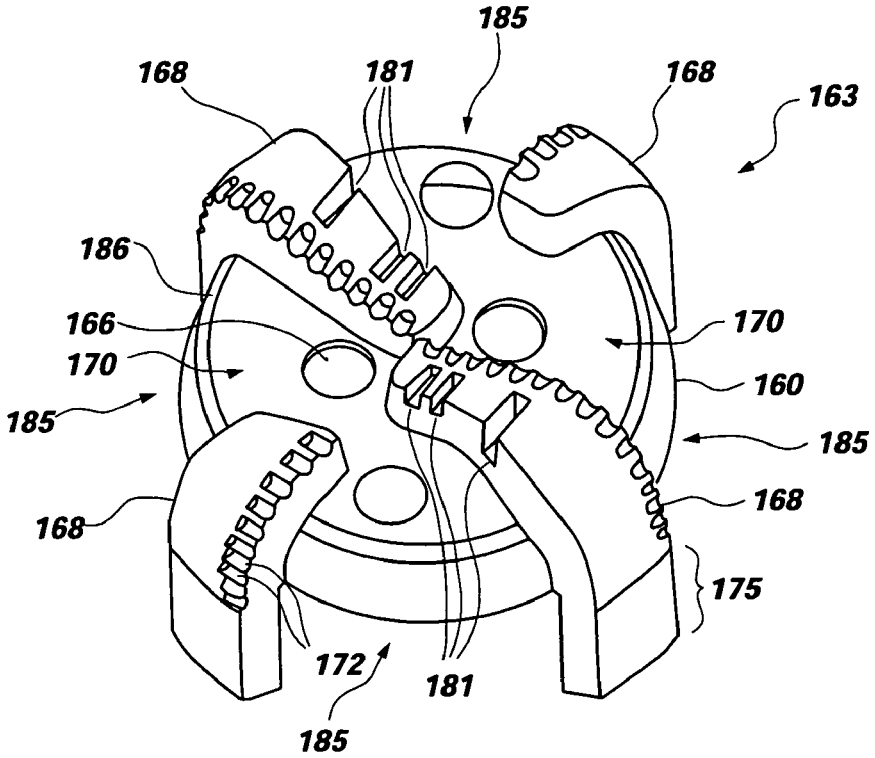

FIGS. 7A and 7B shows casing bits 162 and 163, respectively, each including a nose portion 160, face 186, apertures 166 formed in nose portion 160, and generally radially extending blades 168 forming fluid courses 170 extending to junk slots 185 between circumferentially adjacent blades 168. Blades 168 include pockets 172 for accepting cutting elements (not shown), such as, for instance, PDC cutting elements. Cutting elements may be affixed upon the blades 168 within pockets 172 of casing bits 162 and 163 by way of brazing, welding, or as otherwise known in the art. Gage regions 175 comprise longitudinally upward extensions of blades 168, extending from nose portion 160 and may have wear-resistant inserts or coatings. Apertures 166 formed in casing bits 162 and 163 and extending between the exterior and the interior thereof, respectively, may be configured to transmit drilling fluid to the face 186 and into fluid courses 170 and junk slots 185.

In addition, as shown in FIG. 7A, one or more of blades 168 of casing bit 162 may include rotationally trailing grooves 180 formed therein. Explaining further, rotationally trailing grooves 180 follow, in relation to the direction of intended rotation of the casing bit 162, the cutting elements disposed on the blade in which they are formed. Rotationally trailing grooves 180 may follow a circumferential path or a tangential path, in relation to an intended rotation of the casing bit 162. In addition, rotationally trailing grooves 180 may have a tapered geometry in which the width of the rotationally trailing grooves 180 increases along a direction from the rotationally leading face of two of blades 168 to the trailing edges thereof. Of course, such an embodiment is an example, the present invention contemplates that one or more of blades 168 may include at least one rotationally trailing groove 180. Put another way, one of blades 168 may include at least one rotationally trailing groove 180, or, alternatively, more than one of blades 168 may include at least one rotationally trailing groove 180. Rotationally trailing grooves 180 may extend at least partially through blades 168, through a portion of nose portion 160, or both. Thus, rotationally trailing grooves 180 may communicate drilling fluid between the interior of the casing bit 162 and the exterior thereof. The presence of rotationally trailing grooves 180 may aid in drilling through the casing bit 162, by separating blades 168 into smaller sections as they are partially drilled through by a drilling tool.

Similarly, as shown in FIG. 7B, blades 168 of casing bit 163 may include one or more rotationally trailing grooves 181 formed therein, wherein the rotationally trailing groove 181 has a substantially constant width along its extent, which may follow a circumferential path or a tangential path, in relation to an intended direction of rotation of the casing bit 163. Alternatively, rotationally trailing groove 181 may follow a desired path through blades 168. One of blades 168 may include at least one rotationally trailing groove 181, or, alternatively, more than one of blades 168 may include at least one rotationally trailing groove 181. Rotationally trailing grooves 181 may extend at least partially through a portion of a blade 168, through a portion of nose portion 160, or both. Thus, rotationally trailing groove 181 may communicate drilling fluid between the interior of the casing bit 163 and the exterior thereof. As noted above, the presence of rotationally trailing grooves 181 may aid in drilling through the casing bit 163, by separating blades 168 into smaller sections as they are partially drilled through by a drilling tool.

Figure 7C:
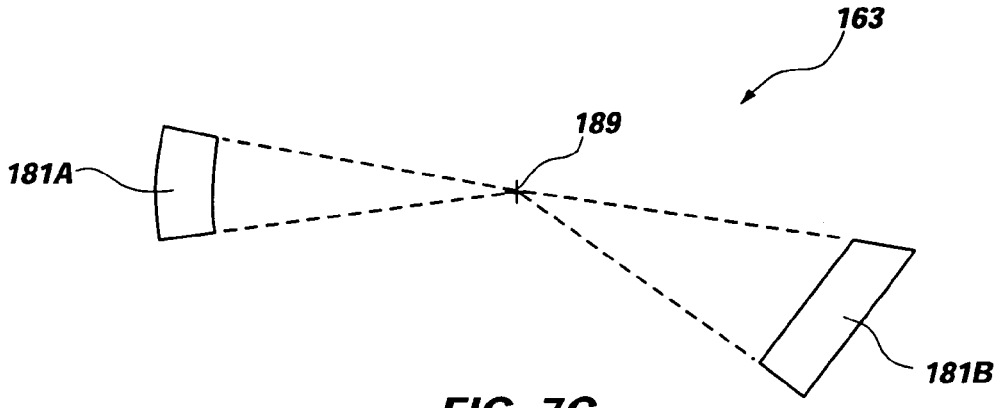
FIG. 7C shows a partial schematic top elevation view of the casing bit shown in FIG. 7B.

More particularly, FIG. 7C shows a partial schematic top elevation view of rotationally trailing grooves 181A and 181B disposed about longitudinal axis 189 of casing bit 163. As shown in FIG. 7C, casing bit 163 may include a circumferentially trailing groove 181A, a tangentially trailing groove 181, both, or neither. Alternatively or additionally, casing bit 163 may include a rotationally trailing groove 181 following a generally straight or arcuate path, oriented as desired, through a blade 168 thereof, without limitation. Likewise, casing bit 162 may include a rotationally trailing groove 180 following a generally straight or arcuate path, oriented as desired, through a blade 168 thereof, which may be circumferentially trailing or tangentially trailing, without limitation.

Of course, the present invention contemplates that the size and configuration of rotationally trailing grooves may be selected and tailored for providing sufficient strength to the blades 168 for drilling. Thus, constant width rotationally trailing grooves 181 may be desirable in particular blade geometries while tapered rotationally trailing grooves 180 may be a desirable configuration in other blade geometries.

As mentioned above in relation to FIGS. 2A-3B, it may be desirable to drill through a casing bit of the present invention subsequent to drilling operations therewith. However, as may be appreciated, the casing bit of the present invention may include relatively hard and abrasion resistant materials in order to drill effectively to a desired depth. Thus, there may be discord between an effective design of casing bit for drilling effectively to a desired depth and a casing bit that may be subsequently drilled through, because the relatively hard and abrasion resistant materials that would be preferred for drilling may inhibit drilling therepast. Therefore, the present invention contemplates that cutting elements disposed on the casing bit of the present invention may be tailored to facilitate drilling effectively to a desired depth and drilling therepast with a drilling tool. Particularly, the presence and configuration of relatively hard and abrasive materials contained by or disposed upon a casing bit of the present invention may be selectively tailored to facilitate drilling therethrough with a drilling tool.

As mentioned above, cutting elements may be used in combination with the casing bit of the present invention. However, conventional rotary drill bits are not configured for drilling through a drill bit or casing bit which carries PDC cutters within the area intended to be removed. Accordingly, the present invention contemplates cutting elements that may be configured to facilitate drilling through the casing bit upon which they are disposed.

In a first embodiment, a cutting element of the present invention may comprise a superabrasive layer bonded to a substrate wherein the substrate may be substantially free of carbide. The term "carbide," as used herein, refers to a compound of carbon and one or more metallic elements. Carbide may generally exhibit relatively hard and abrasive properties. Particularly, tungsten carbide is known to exhibit a relatively high hardness as well as a relatively high resistance to abrasion, erosion, or both. Accordingly, the use of conventional cutting elements that include cemented tungsten carbide within a casing bit of the present invention may cause difficulty in drilling therethrough.

Figure 8A:
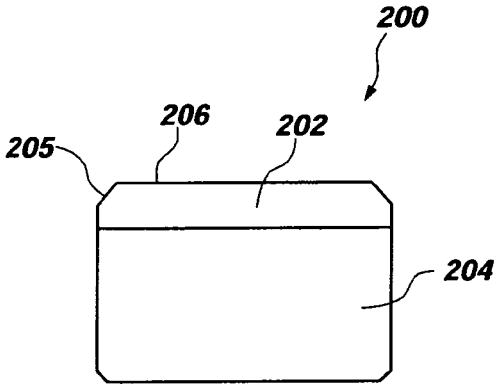
FIG. 8A shows a schematic side cross-sectional view of a cutting element according to the present invention.

Thus, FIG. 8A illustrates a side cross-sectional view of a cutting element 200 according to the present invention. Cutting element 200 includes a superabrasive table 202, forming cutting face 206, wherein the superabrasive table 202 may comprise diamond, cubic boron nitride, or other superhard or superabrasive particles, and wherein the particles are bonded to one another. Of course, superabrasive table 202 may include chamfer 205 and may be bonded to substrate 204. For instance, superabrasive table 202 may be bonded to substrate 204 during HPHT process, which also bonds superabrasive particles (not shown) to one another to form the superabrasive table 202. Substrate 204 may be substantially free from carbide. Accordingly, substrate 204 may comprise steel, tungsten, bronze, brass, aluminum, ceramic, molybdenum, or alloys of molybdenum, such as TZM alloy.

Thus, as explained above, "substantially free" of carbide may mean completely free from carbide. However, the present invention also contemplates that a substrate that is "substantially free" of carbide may include other configurations wherein carbide forms a minor portion of the entire substrate 204 as well. Moreover, a substantially carbide-free cutting element of the present invention may be formed in response to drilling a subterranean formation, wherein the drilling removes at least a portion of the carbide within the substrate.

Figure 8B:
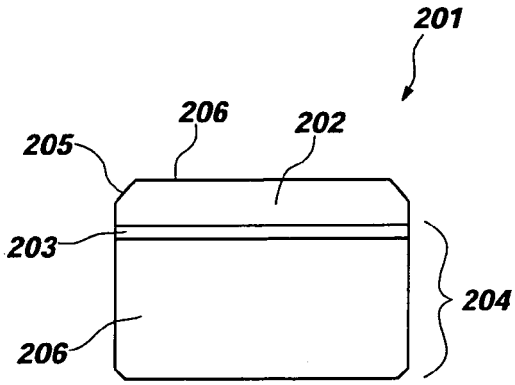
FIG. 8B shows a schematic side cross-sectional view of a cutting element according to the present invention.

For instance, as shown in FIG. 8B, which illustrates cutting element 201, substrate 204 may include layer 203, which may include carbide, such as tungsten carbide. Such a layer may be desirable to increase the strength, stiffness, or both, of the adjacent superabrasive table 202. Furthermore, as the superabrasive table 202, which forms at least a portion of cutting face 206, and the substrate 204 wear away in relation to drilling a subterranean formation, a relatively small amount of carbide may exist at the time that a drilling tool is employed to drill therethrough. Thus, an amount of carbide comprising a superabrasive cutting element of the present invention may be selectively tailored to form a substantially carbide-free substrate in response to drilling a subterranean formation. In other words, at least a portion of the substrate of a superabrasive cutting element of the present invention may be configured to substantially wear away or be removed in response to drilling a subterranean formation. Such a configuration may reduce the amount of carbide in the casing bit that is encountered by a drilling tool employed to drill therethrough.

Figure 8C:
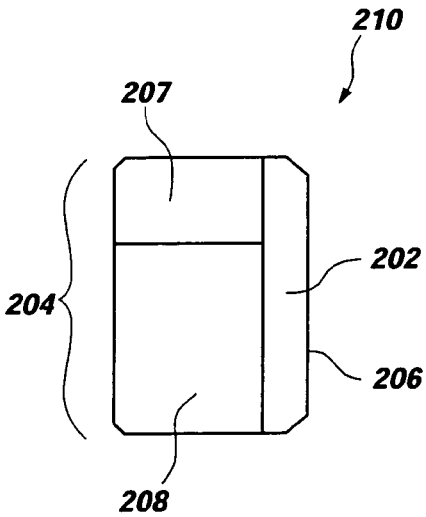
FIG. 8C shows a schematic side cross-sectional view of a cutting element according to the present invention.
Figure 8D:
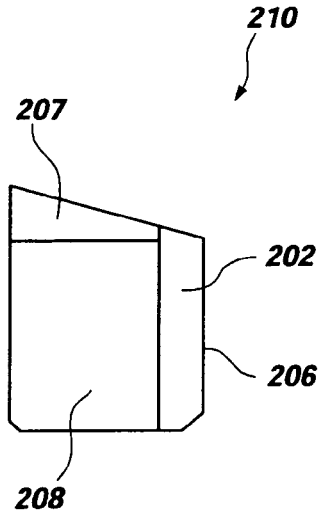
FIG. 8D shows a schematic side cross-sectional view of a cutting element as shown in FIG. 8C which has been worn.

Also, in another embodiment of a cutting element 210 of the present invention, as shown in FIGS. 8C and 8D, cutting element 210 may include substrate 204 and superabrasive table 202 forming at least a portion of cutting face 206, wherein the substrate comprises two different materials that are disposed in corresponding areas or regions 207 and 208 thereof. Region 207 may include carbide and may be sized and configured to substantially wear away during drilling therewith, as shown in FIG. 8D. Accordingly, worn cutting element 210 may be substantially carbide free after use thereof, which may facilitate drilling through a casing bit employing same.

Of course, the superabrasive table of a cutting element may also be sized and configured to wear away in relation to drilling a subterranean formation, so that a relatively small amount of superabrasive material may exist upon a casing bit employing same at the time that a drilling tool is employed to drill therethrough. Thus, an amount of superabrasive material comprising a superabrasive table of a cutting element of the present invention may be selectively tailored to form a substantially superabrasive free cutting element in response to drilling a subterranean formation. In other words, at least a portion of the superabrasive table of a superabrasive cutting element of the present invention may be configured to substantially wear away or be removed in response to drilling a subterranean formation. Such a configuration may reduce the amount of superabrasive material affixed to the casing bit that is encountered by a drilling tool employed to drill therethrough.

In addition, the present invention is not limited to wearing the amount of abrasive material within a cutting element or substrate by way of the subterranean formation alone. Rather, abrasive material comprising a cutting element superabrasive table or substrate including diamond, carbide, ceramic, or other material exhibiting relatively high resistance to one or more of abrasion, erosion, and wear may be removed by one or more of mechanical, thermal, or chemical degradation. For instance, upon drilling to a desired depth, the casing bit of the present invention may be operated with drilling fluid that contains a chemical with an affinity for carbon. For example, iron-containing, cobalt-containing, or other metal containing compounds such as metallic salts may have an affinity for carbon at relatively high temperatures. Thus, the casing bit may be drilled without drilling fluid or very little drilling fluid, so as to heat the abrasive materials sufficiently to cause one or more of chemical, mechanical, and thermal degradation, thus rendering an initially abrasive material substantially nonabrasive. Accordingly, a material that initially exhibits relatively high resistance to one or more of abrasion, erosion, and wear may be rendered to exhibit substantially little resistance to any of abrasion, erosion, and wear, or may be removed from the casing bit.

In yet another embodiment of a cutting element of the present invention, the superabrasive material included therein may be sized and positioned to facilitate drilling through a casing bit employing same with a drilling tool. More particularly, the abrasive volume of the cutting element may be sized and configured so as to reduce the damage that may be caused in drilling through a casing bit employing one or more of the cutting elements. "Abrasive volume, " as used herein, is intended to indicate a material that exhibits at least one of relatively high hardness, abrasive-resistance, and erosion-resistance. For instance, an abrasive volume may include carbide, diamond, boron nitride, ceramic, or other material exhibiting at least one of relatively high hardness, abrasive-resistance, and erosion-resistance. For example, a cutting element which is generally configured as a portion of a cylinder, according to U.S. Pat. No. 5,533,582 to Tibbitts, assigned to the assignee of the present invention and the disclosure of which is incorporated in its entirety by reference herein, may be employed by the casing bit of the present invention.

Figure 9A:
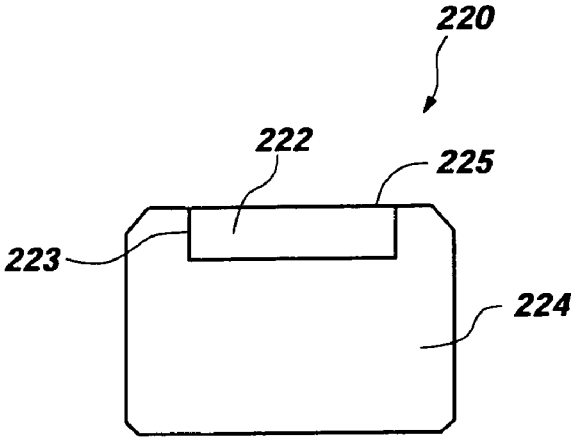
FIG. 9A shows a schematic side cross-sectional view of a cutting element according to the present invention.
Figure 9B:
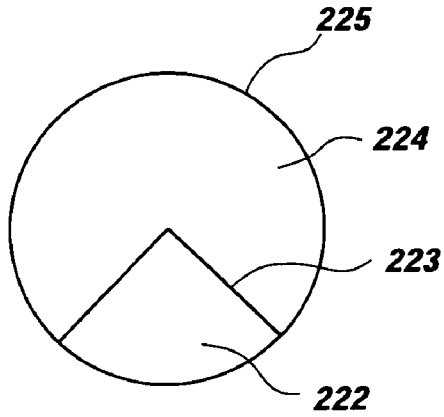
FIGS. 9B-9D each show a schematic top view of different exemplary geometries of the cutting element as shown in FIG. 9A.
Figure 9C:
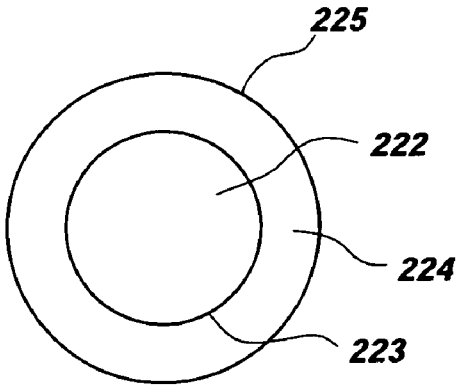
Figure 9D:
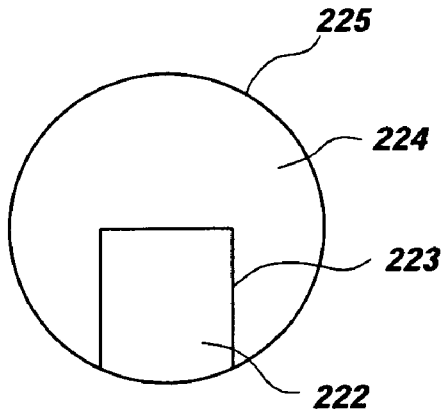

As shown in FIG. 9A, cutting element 220 includes substrate 224 and abrasive volume 222, wherein the abrasive volume forms at least a portion of cutting face 225. Abrasive volume 222 is disposed within substrate 224, wherein at least a portion of a side 223 surface of the abrasive volume is bonded to the substrate. Substrate 224 may comprise steel, tungsten, tungsten carbide, TZM, molybdenum, bronze, brass, aluminum, or ceramic, while abrasive volume 222 may comprise polycrystalline diamond, tungsten carbide, impregnated material, or hardfacing material. Impregnated material, as known in the art, generally refers to an abrasive material, such as, for instance, diamond particles, which may be natural or synthetic, dispersed within a metal binder. Of course, abrasive volume 222 may be configured in different geometries. For instance, FIGS. 9B-9D show different top views of a cutting element having an abrasive volume 222 wherein at least a portion of a side surface thereof is bonded to the substrate 224. More specifically, FIG. 9B shows a schematic top view of a circular sector shaped abrasive volume 222, FIG. 9C shows schematic top view of a generally circular abrasive volume 222, and FIG. 9D shows a schematic top view of a partially rectangular abrasive volume 222. As may be seen in reference to FIG. 9C, the substrate 224 surrounds the entire side surface of abrasive volume 222. The present invention also contemplates that the abrasive volume 222 may be sized and positioned according to a predicted amount of wear in relation to an expected drilling experience.

Further, the casing bit of the present invention may employ selective cutting element configuration and placement. Particularly, cutting elements may be selectively positioned and configured in relation to the portion of the casing bit to be drilled through. Such a configuration may be advantageous in reducing the damage to a drilling tool used to drill through a casing bit of the present invention.

Figure 10A:
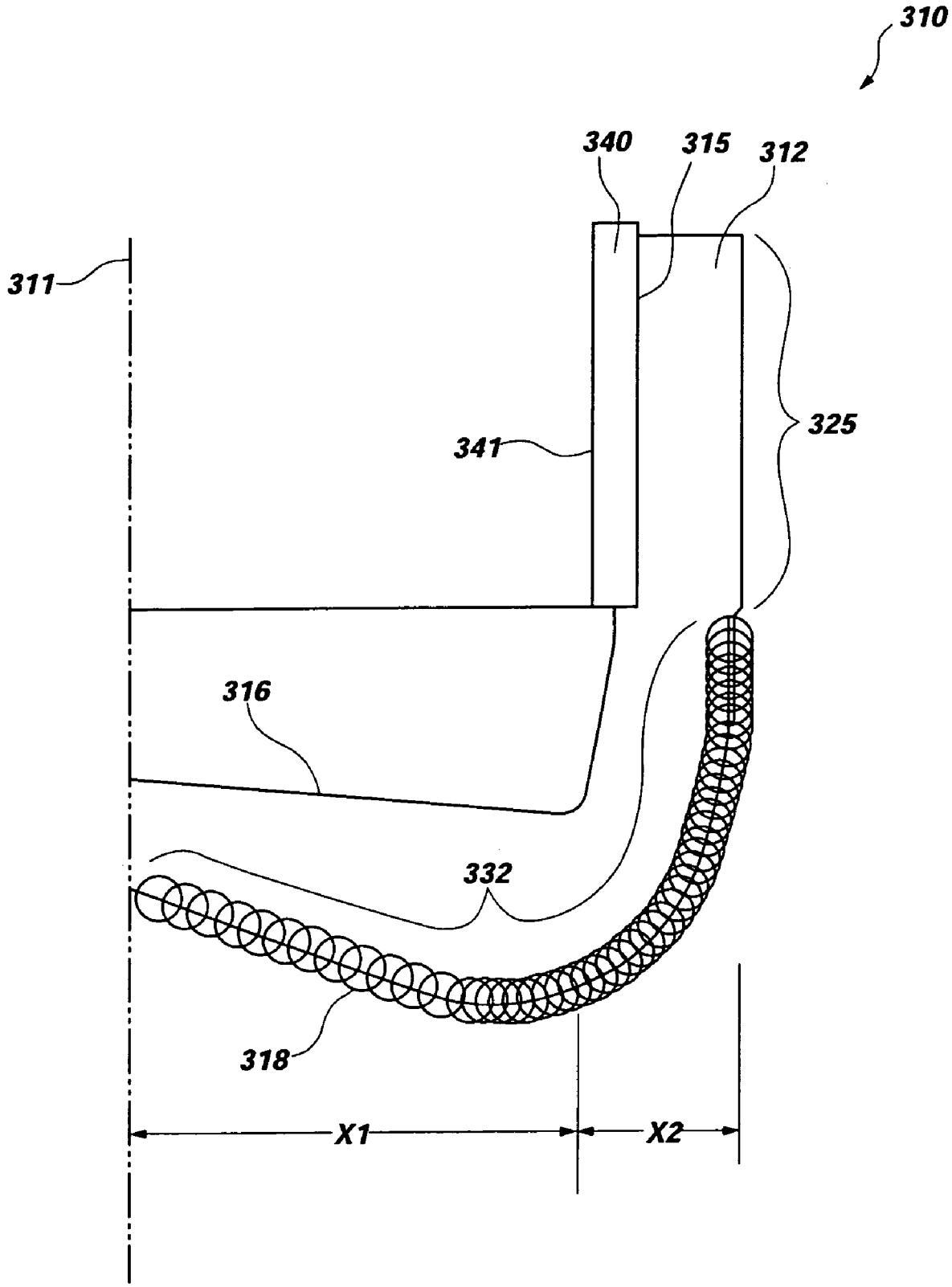
FIG. 10A shows a schematic side cross-sectional view of a casing bit according to the present invention.

For instance, FIG. 10A illustrates a partial side cross-sectional design view of an embodiment of a casing bit assembly 310 of the present invention including casing bit 312 affixed to casing section 340 along connection surface 315, which may be threaded, welded, or both, wherein all of the cutting elements 332 that are disposed upon the casing bit 312 are shown as rotated into a single plane in relation to longitudinal axis 311. Connection surface 315 may comprise a portion of gage regions 325 extending from casing bit 312 as discussed hereinabove. Region x1 shows a radial region of casing bit 312, extending from longitudinal axis 311 to another radial position. Region x1 may be sized and configured, for example, as the portion of casing bit 312 which may be drilled through, from the inner profile 316 of casing bit 312 to the outer profile 318 thereof. As shown in FIG. 10A, region x1 corresponds to the portion of the casing bit 312 extending radially from longitudinal axis 311 to a radial position corresponding to the inner surface 341 of casing section 340. Accordingly, typically, a drilling tool (not shown) disposed through casing section 340 may have an outer diameter of less than the inner diameter of the casing section 340. Comparatively, region x2 shows a region of casing bit 312 which may not be configured for drilling therethrough. Accordingly, the cutting elements 332 generally within region x1 may be configured differently than the cutting elements 332 generally within region x2. Specifically, the cutting elements 332 within region x1 may be sized and configured to facilitate drilling therethrough. Alternatively, at least a majority of the cutting elements within region x1 may be configured differently than a majority of the cutting elements 332 generally within region x2.

For example, at least one of the cutting elements 332 generally within region x1 comprises a first grade of cutting element based upon at least one inherent quality related to wear characteristics, and at least one of the cutting elements 332 generally within region x2 comprises a second grade of cutting element 332 based upon at least one inherent quality related to wear characteristics, wherein the inherent quality of the second grade of cutting element 332 is generally different than the inherent quality of the first grade of cutting element 332. In such an example, it may be advantageous to select the first grade of cutting element 332 in region x1 to exhibit wear characteristics that are inferior to the wear characteristics of the second grade of cutting element 332 in region x2. Alternatively, a majority of the cutting elements 332 in region x1 comprises a first grade of cutting element based upon at least one inherent quality related to wear characteristics, and a majority of the cutting elements 332 generally within region x2 comprises a second grade of cutting element 332 based upon at least one inherent quality related to wear characteristics, wherein the inherent quality of the second grade of cutting element 332 is generally different from or inferior to the inherent quality of the majority of the first grade of cutting element 332.

Alternatively, or additionally, as discussed above, the amount of abrasive material comprising cutting elements 332 generally within region x1 may be adjusted to substantially wear away or be removed in response to drilling a subterranean formation to facilitate drilling through a casing bit employing same. Thus, the above-mentioned cutting elements 200, 201, 210, and 220 as described in relation to FIGS. 8A-9D according to the present invention may be used within region x1 of the casing bit 312 of the present invention. As may be appreciated, such a configuration may assist in removing region x1 of casing bit 312 by way of drilling therethrough via reducing the amount of materials exhibiting at least one of relatively high hardness, relatively high abrasion resistance, and relatively high erosion resistance at the time at which drilling through the casing bit 312 is desired.

Explaining further, since the inherent quality related to wear characteristics and the amount of abrasive volume within a cutting element will (assuming smooth wear of the cutting element) may determine the amount of subterranean formation that may be cut or removed, a cutting element of the present invention may be tailored in this regard. Thus, an inherent quality related to wear characteristics, the amount or volume of abrasive material contained by each grade of cutting element, or both, may be tailored or selected in relation to a section of subterranean formation through which the casing bit 312 is to drill. Such a configuration may provide a method to facilitate removal of region x1 of casing bit 312 by way of drilling therethrough after the casing bit 312 has drilled a casing section (not shown) into a subterranean formation. Summarizing, the abrasive volume of a cutting element of the present invention may be configured to substantially wear away in response to an expected amount of drilling.

Accordingly, where the casing bit 312 of the present invention includes a plurality of cutting elements 332 wherein a first portion of the plurality of cutting elements 332 is disposed generally within region x1 and a second portion of the plurality of cutting elements 332 is disposed generally within region x2, the average amount of abrasive material contained by each of the cutting elements 332 of the first portion of the plurality of cutting elements 332 may be less than the average amount of abrasive material contained by each of the cutting elements 332 of the second portion of the plurality of cutting elements 332. In yet another alternative, the cutting elements 332 or a majority thereof in region x1 may be sized differently than the cutting elements 332 in region x2. Such a configuration may reduce the amount of materials exhibiting at least one of relatively high hardness, relatively high abrasive-resistance, and relatively high erosion-resistance within region x1 of casing bit 312. In addition, smaller cutters may be more easily flushed from the borehole by drilling fluid delivered from a drilling tool (not shown), which drills through casing bit 312.

In a further aspect of the present invention relating to cutting elements disposed on a casing bit of the present invention, cutting elements may be selectively placed upon a casing bit of the present invention according to the concepts and teachings of U.S. Pat. Nos. 6,021,859, 5,950,747, 5,787,022, and 5,605,198 to Tibbitts et al., the disclosure of each of which is mentioned and incorporated in its entirety hereinabove. Accordingly, cutting elements may be engineered and selectively placed upon a casing bit of the present invention to accommodate differing loading or stress conditions such as are experienced at different locations thereon.

In yet another aspect of the present invention, a casing bit of the present invention may be configured with a first plurality of cutting elements disposed thereon that are sized, configured, and positioned to drill through a casing bit or shoe or other drilling string component, while a second plurality of cutting elements disposed thereon are sized, configured, and positioned to drill into a subterranean formation.

Figure 10B:
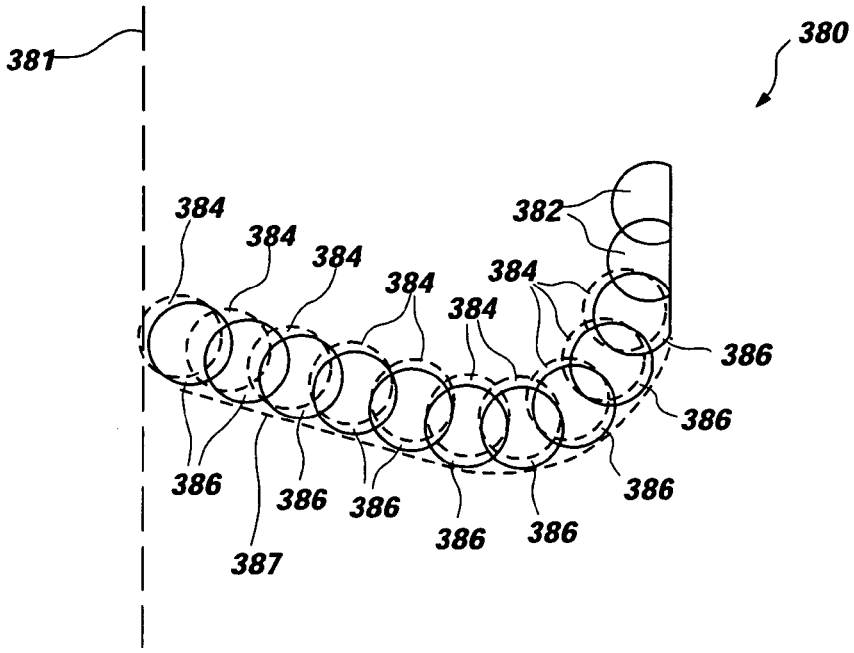
FIG. 10B shows a schematic side cross-sectional view of a cutting element placement design of a casing bit according to the present invention.

More particularly, FIG. 10B shows a schematic side view of a cutting element placement design 380 showing cutting elements 382, 384, and 386 disposed on a casing bit (not shown) of the present invention in relation to the longitudinal axis 381 and drilling profile 387 thereof, as if all the cutting elements 382, 384, and 386 were rotated onto a single blade (not shown). Particularly, a first plurality of cutting elements 386 may be sized, configured, and positioned so as to engage and drill a first material or region, such as a casing shoe or other downhole component. Further, the first plurality of cutting elements 386 may be configured to drill through a region of cement that surrounds a casing shoe, if it has been cemented within a borehole, as known in the art. In addition, a second plurality of cutting elements 384 may be sized, configured, and positioned to drill into a subterranean formation. Also, cutting elements 382 are shown as positioned to cut a gage diameter, but the gage region of the cutting element placement design 380 may also include cutting elements 386 and 384 of the first and second plurality, respectively. The present invention contemplates that the first plurality of cutting elements 386 may be more exposed than the second plurality of cutting elements 384. In this way, the first plurality of cutting elements 386 may be sacrificial in relation to the second plurality of cutting elements 384. Explaining further, the first plurality of cutting elements 386 may be configured to initially engage and drill through materials and regions that are different from subsequent materials and regions that the second plurality of cutting elements 384 is configured to engage and drill through.

Accordingly, the first plurality of cutting elements 386 may be configured differently than the second plurality of cutting elements 384. Particularly, the first plurality of cutting elements 386 may comprise tungsten carbide cutting elements, while the second plurality of cutting elements 384 may comprise polycrystalline diamond cutting elements. Such a configuration may facilitate drilling through a casing shoe or bit as well as the cement thereabout with primarily the first plurality of cutting elements 386. However, upon passing into a subterranean formation, the abrasiveness of the drilling may wear away the tungsten carbide cutting elements 386, and the second plurality of polycrystalline diamond cutting elements 384 may engage the same. One or more of the first plurality of cutting elements 386 may rotationally precede one or more of the second plurality of cutting elements 384, without limitation. Alternatively, one or more of the first plurality of cutting elements 386 may rotationally follow one or more of the second plurality of cutting elements 384, without limitation.

Figure 11A:
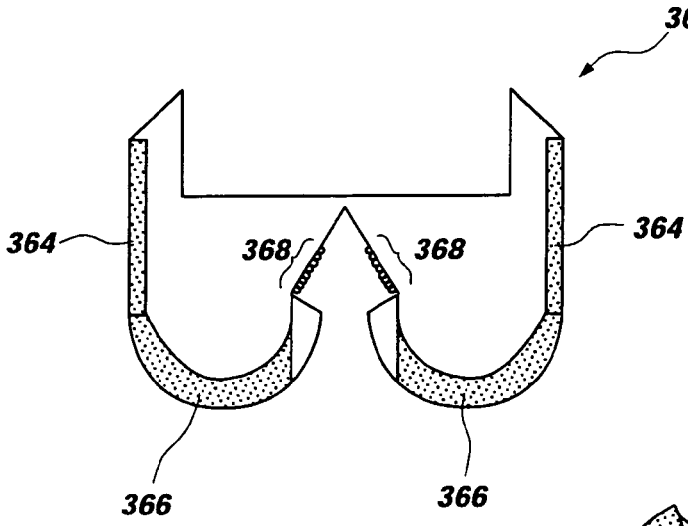
FIG. 11A shows a schematic side cross-sectional view of an exemplary casing bit of the present invention.
Figure 11B:
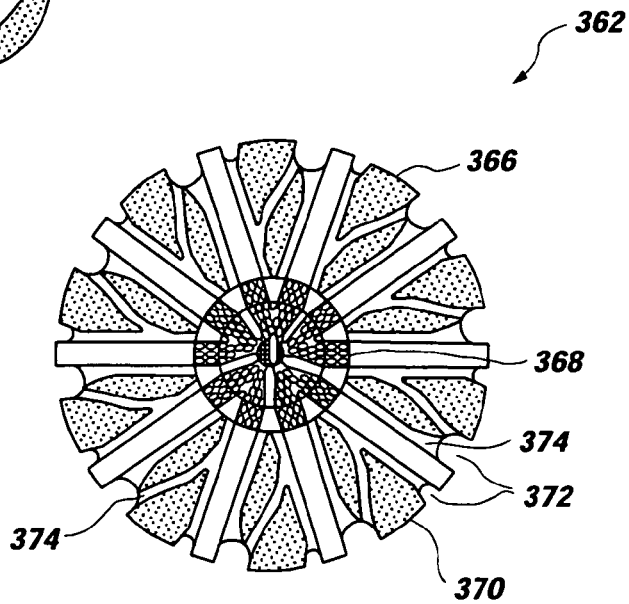
FIG. 11B shows a top view of the casing bit shown in FIG. 11A.

FIGS. 11A and 11B illustrate an embodiment of a casing bit 362 of the present invention comprising impregnated material. As shown in FIG. 11B, casing bit 362 includes blade sections 370 formed from impregnated material, where adjacent raised blade sections 370 form junk slots 372 therebetween. Also, fluid channels 374 may be formed in the face of casing bit 362 for communicating fluid from the interior of the casing bit 362 to the junk slots 372. Further, casing bit 362 includes different materials disposed in different regions thereof that may be configured for drilling therethrough. As shown in FIG. 11A, casing bit 362 includes a gage material 364, a nose material 366, and a cone material 368. Thus, cone material 368 and nose material 366 may be configured for drilling therethrough, while gage material 364 may be configured with respect to inherent qualities related to drilling performance. Therefore, gage material 364 may be substantially more wear resistant than the cone material 368 or nose material 366. Such configuration may aid in a drilling tool (not shown) drilling through the inner portion of casing bit 362.

As a further aspect of the present invention, a casing bit of the present invention may be configured as a reamer. A reamer is an apparatus that drills initially at a first smaller diameter and subsequently at a second, larger diameter. Although the present invention may refer to "casing bit reamer," the term "casing bit" as used herein also encompasses the structures described hereinbelow which are referred to as a "casing bit reamer."

One type of conventional reamer, as known with respect to conventional drill bits, is a reaming assembly having a pilot drill bit at the lower longitudinal end thereof and an upper reaming structure that is centered with respect to the pilot drill bit and includes a plurality of blades be spaced about a substantial portion of the circumference, or periphery, of the reamer. During operation, i.e., drilling, the lower pilot drill bit and the upper reaming structure rotate about a drilling axis to form a pilot borehole and a larger reamed borehole.

Figure 12A:
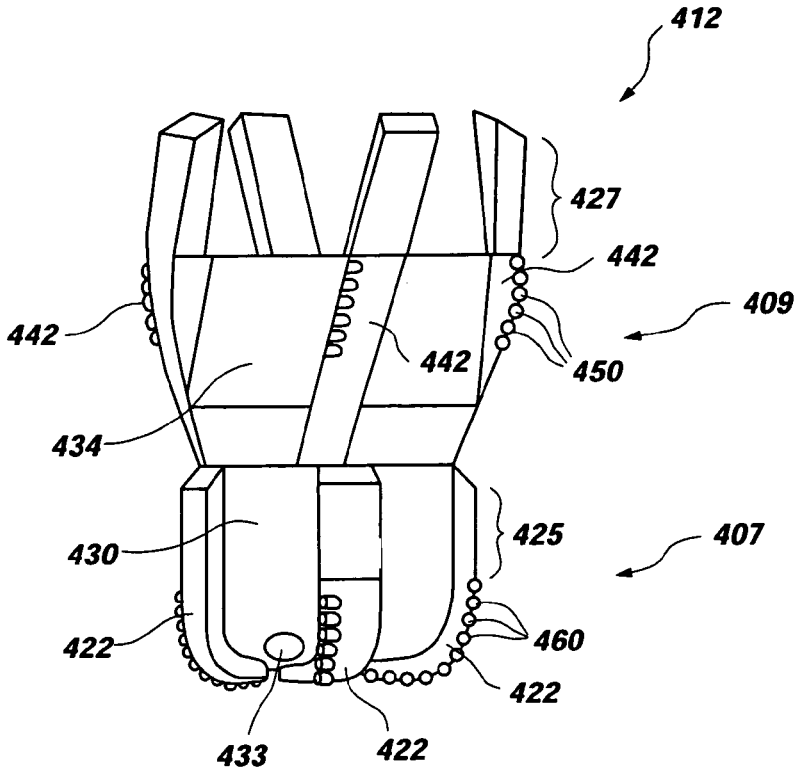
FIG. 12A shows a perspective side view of an exemplary casing bit reamer of the present invention.
Figure 12B:
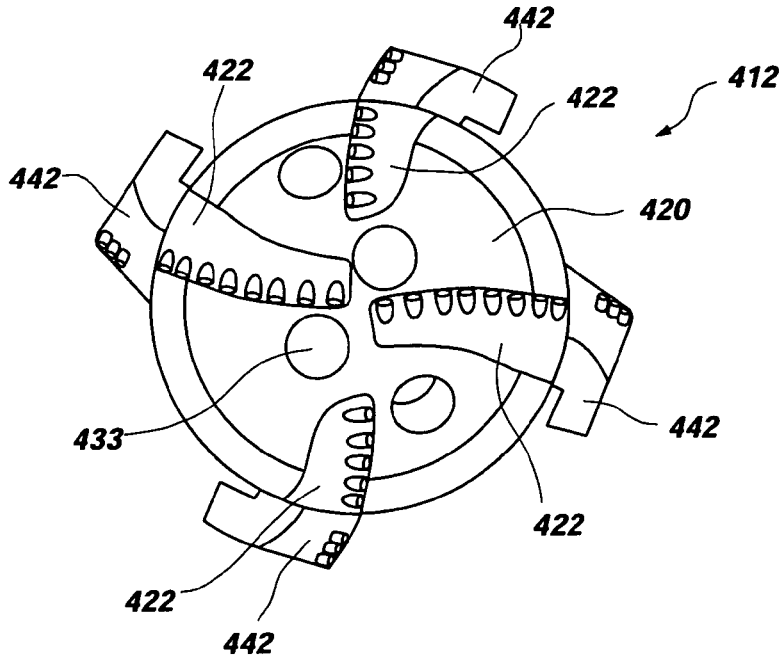
FIG. 12B shows a top view of the casing bit reamer shown in FIG. 12A.

Turning to FIGS. 12A and 12B, a casing bit reamer 412 is shown which includes face 420, pilot section 407 at its lower longitudinal end, and upper reaming section 409 longitudinally thereabove. Pilot section 407 includes bit body 430 having generally radially extending blades 422, wherein the blades 422 may be configured to carry cutting elements 460. Blades 422 extend to corresponding gage regions 425 which may be configured to define the outermost radial surface of the pilot section 407 and, by implication, of a pilot borehole formed therewith. Likewise, upper reaming section 409 includes tubular body 434 having generally radially extending blades 442, wherein blades 442 may be configured to carry cutting elements 450. Blades 442 extend to corresponding gage region 427 extending longitudinally from tubular body 434 and which may be configured to define the outermost radial surface of the upper reaming section 409, and, by implication, of a reamed borehole formed therewith. Apertures 433 may be formed in the pilot section 407, upper reaming section 409, or both, and may be configured to communicate drilling fluid from the interior of the casing bit reamer 412 to the exterior thereof, as known in the art. Accordingly, a casing bit reamer 412 according to the present invention may be advantageous in enlarging a borehole while casing the same.

Another type of conventional reamer, as is known with respect to conventional drill bits, is a bicenter bit assembly, which employs two longitudinally superimposed bit sections with laterally offset axes. The first axis is the center of the pass-through diameter, that is, the diameter of the smallest borehole the bit will pass through. This axis may be referred to as the pass-through axis. The second axis is the axis of the borehole that is formed as the bit assembly is rotated, which may be referred to as the drilling axis. Usually a first, lower and smaller diameter pilot bit section is employed to commence the drilling, and rotation of the pilot bit section is centered about the drilling axis as the second, upper and larger diameter main bit section engages the formation to enlarge the borehole, the rotational axis of the bit assembly transitions from the pass-through axis to the drilling axis when the full-diameter, enlarged borehole is drilled.

Figure 13A:
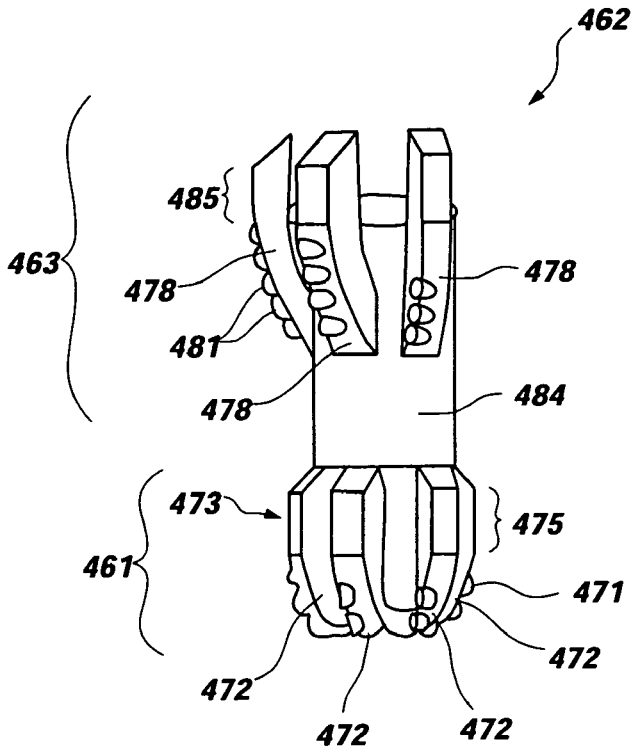
FIG. 13A shows a perspective side view of an exemplary casing bit reamer of the present invention.
Figure 13B:
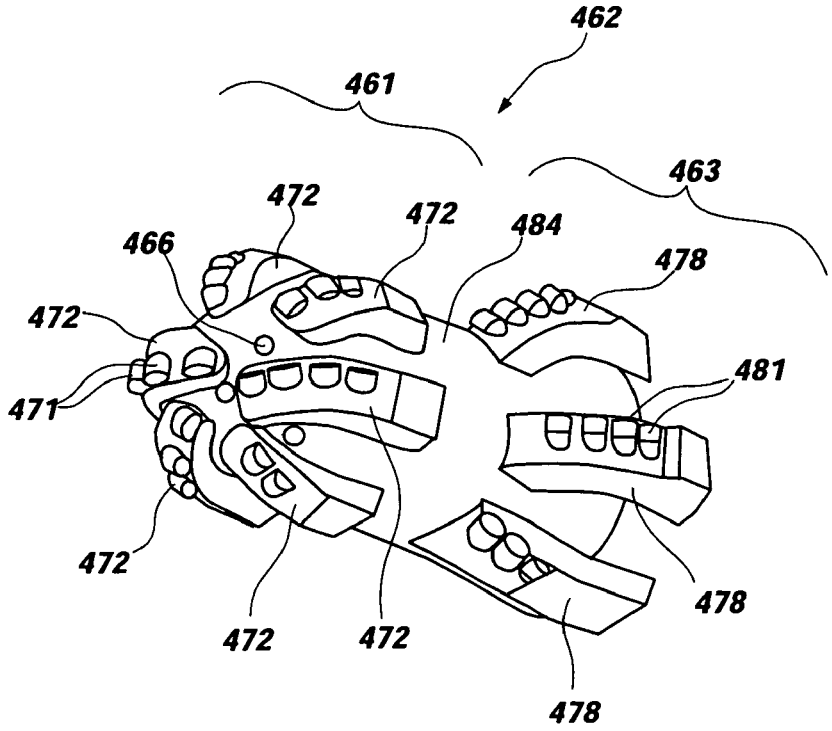
FIG. 13B shows a perspective view of the exemplary casing bit reamer shown in FIG. 13A.

As shown in FIGS. 13A and 13B, the present invention contemplates a casing bit reamer 462 having two longitudinally superimposed sections, a pilot bit section 461 and a reamer wing section 463. Pilot bit section 461 includes a bit body 473 having generally radially extending blades 472, extending to a gage region 475 which is configured to define the outermost radial surface of the pilot borehole. In addition, cutting elements 471 may be affixed to blades 472 disposed within cutting element pockets formed thereon by way of brazing or as otherwise known in the art. Likewise, reaming wing section 463 includes a tubular body 484 having generally radially extending blades 478 disposed only about a portion of the circumference of tubular body 484. The blades may include cutting elements 481 and may extend to corresponding gage regions 485, which extend longitudinally from tubular body 484 and may be configured to define the outermost radial surface of the reamed borehole. Of course, the pilot bit section 461, the reamer wing section 463, or both, may include apertures 466 (FIG. 13B) for communicating drilling fluid from the interior of the casing bit reamer 462 to the cutting elements 471 and 481 thereon.

The casing bit reamer 462 has a pass-through diameter, which is the smallest borehole that the casing bit will pass through. Accordingly, if the casing bit reamer 462 is rotated within a borehole having a smaller diameter than the reaming diameter, the casing bit reamer 462 will initially rotate generally within the smaller borehole about the central axis thereof. However, when the casing bit reamer 462 rotates about the reaming axis, the reamer wing section 463 traverses a reaming diameter, which is the diameter of the borehole that is formed as the reamer wing section 463 is rotated thereabout.

Thus, during operation which begins in a borehole that is smaller than the reaming diameter, the first, lower and smaller diameter pilot bit section 461 is employed to commence drilling a pilot-sized borehole and rotation of the pilot bit section 461 is centered about the reaming axis as the second, upper and larger diameter main bit section engages the formation to enlarge the pilot-sized borehole to the reaming diameter. Further, the rotational axis of the casing bit reamer 462 transitions from rotation within the smaller borehole to rotation about the reaming axis when the full-diameter, enlarged borehole is drilled.

Of course, an extended assembly (extended bicenter assembly) with a pilot bit at the distal or leading end thereof and a reamer assembly some distance above may also be employed by the present invention. Such an arrangement may allow the pilot bit to be changed. Further, the extended nature of the assembly may permit greater flexibility when passing through tight spots in the borehole as well as the opportunity to effectively stabilize the pilot bit so that the pilot hole and the following reamer will take the path intended for the borehole.

In addition, so-called "secondary" blades on the reamer wing to speed the transition from pass-through to drill diameter with reduced vibration and borehole eccentricity may be employed by the casing bit of the present invention, as disclosed with respect to drill bits, in U.S. Pat. No. 5,497,842, assigned to the assignee of the present invention and the disclosure of which is hereby incorporated in its entirety by reference herein. Also, the casing bit of the present invention may include a circumferentially tapered pilot stabilizer pad, as disclosed in U.S. Pat. No. 5,765,653, assigned to the assignee of the present invention and the disclosure of which is hereby incorporated in its entirety by reference herein.

Figure 14A:
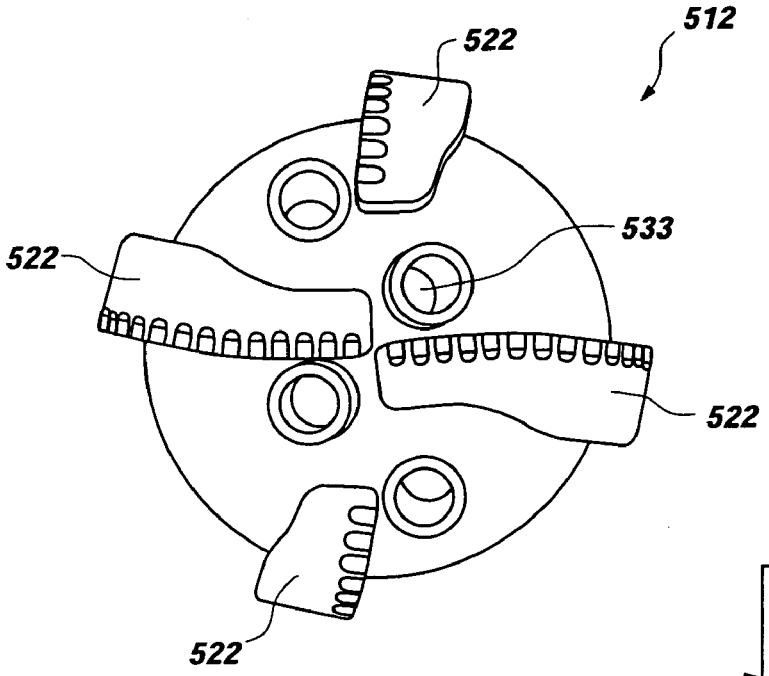
FIG. 14A shows a top view of an exemplary casing bit of the present invention.
Figure 14C:
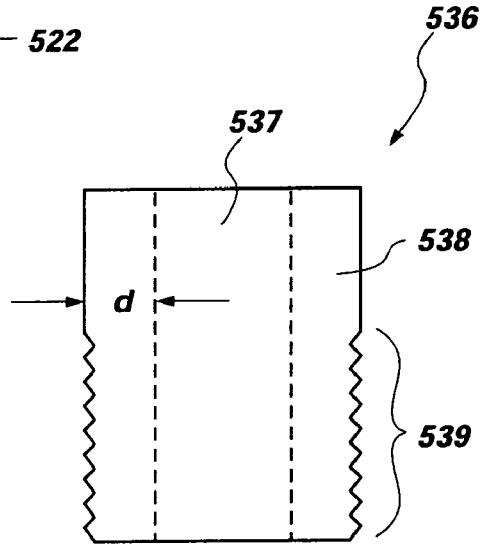
FIG. 14C shows a schematic side cross-sectional view of a nozzle according to the present invention.
Figure 14B:
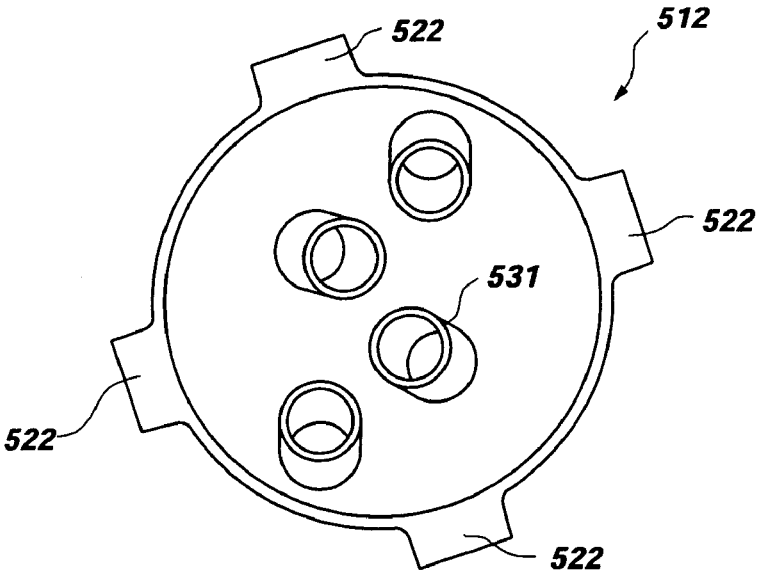
FIG. 14B shows a back view of the exemplary casing bit shown in FIG. 14A.

The present invention also contemplates that the delivery and communication of drilling fluid may be advantageously configured in relation to a casing bit 512 of the present invention. FIG. 14A shows a top view of casing bit 512, which includes generally radially extending blades 522. Also as shown in FIG. 14A, casing bit 512 includes apertures 533 for delivering and communicating drilling fluid to the blades 522 during drilling. Turning to FIG. 14B, retaining structure 531 may be formed as a portion of casing bit 512 and may be configured for receiving a nozzle 536 (FIG. 14C) or a sleeve (not shown). As shown in FIG. 14C, nozzle 536 may be configured with a bore 537 extending through a body 538. Further, nozzle 536 may include a threaded portion 539 for affixing the nozzle 536 within a retaining structure 531. Alternatively, the nozzle 536 may be brazed into the retaining structure. Accordingly, retaining structure 531 may comprise a corresponding threaded surface, an O-ring-type groove for sealing between the nozzle 536 and retaining structure 531, or both. Alternatively, nozzle 536 may comprise a sleeve that is threadedly affixed or brazed into the retaining structure 531. Accordingly, a sleeve (not shown), as known in the art, may be formed by a body 538 forming a bore 537 as described in relation to nozzle 536, except without the threaded portion 539. Also, as may be appreciated, retaining structure 531 may form a disc, sleeve, port, nozzle, a reduced cross-sectional area, or a bore and may not be configured to accept any additional structural component.

Nozzle 536 may comprise an erosion resistant material, such as, for instance, tungsten carbide, hardened steel, ceramic materials, diamond materials, or other hard materials exhibiting erosion resistance as known in the art. Such a configuration may allow for the fluid communicated through the nozzle 536 to exit therefrom at a relatively high velocity without damaging the nozzle 536. Of course, a nozzle 536 may also be replaceable, which may allow for selective configuration of the drilling fluid characteristics of the casing bit 512. As discussed above, it may be desirable to drill through the casing bit 512 subsequent to the casing bit 512 operating to drill a casing section into a subterranean formation. Therefore, it may be desirable to configure the erosion resistant material comprising the nozzle 536 so as to facilitate drilling therethrough. Particularly, the radial thickness, labeled "d" in FIG. 14C may be configured in relation to an expected amount of erosion due to operation during drilling a casing section into a subterranean formation. Of course, more generally, the shape of the bore 537 of the nozzle 536 may also be configured according to predicted or expected erosion thereof. Such a configuration may reduce the amount of erosion resistant material comprising the casing bit 512 subsequent to operating the casing bit 512 to drill a casing section into a subterranean formation; thus, reducing the amount of erosion resistant material may facilitate drilling therethrough with a drilling tool. The present invention contemplates that any embodiment of a casing bit as disclosed herein may include a retaining structure 531.

Figure 15A:
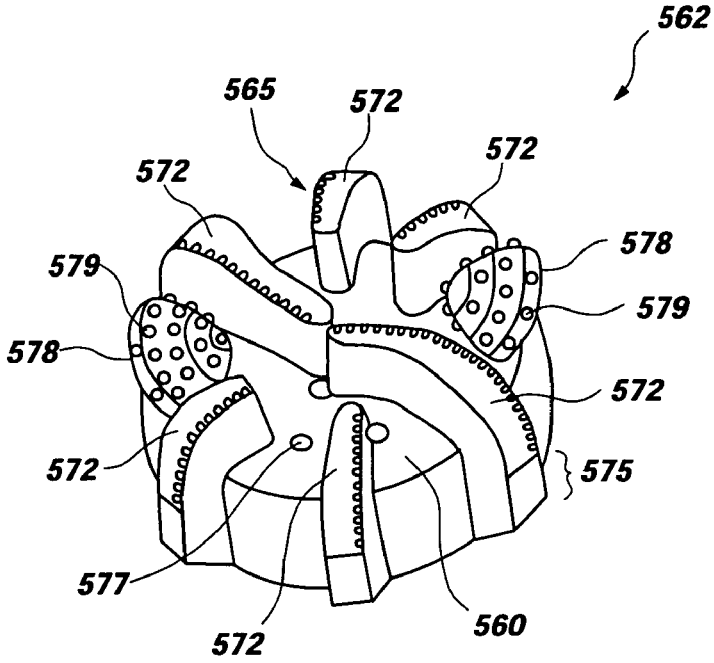
FIG. 15A shows a perspective view of an exemplary casing bit of the present invention including rolling cones.
Figure 15B:
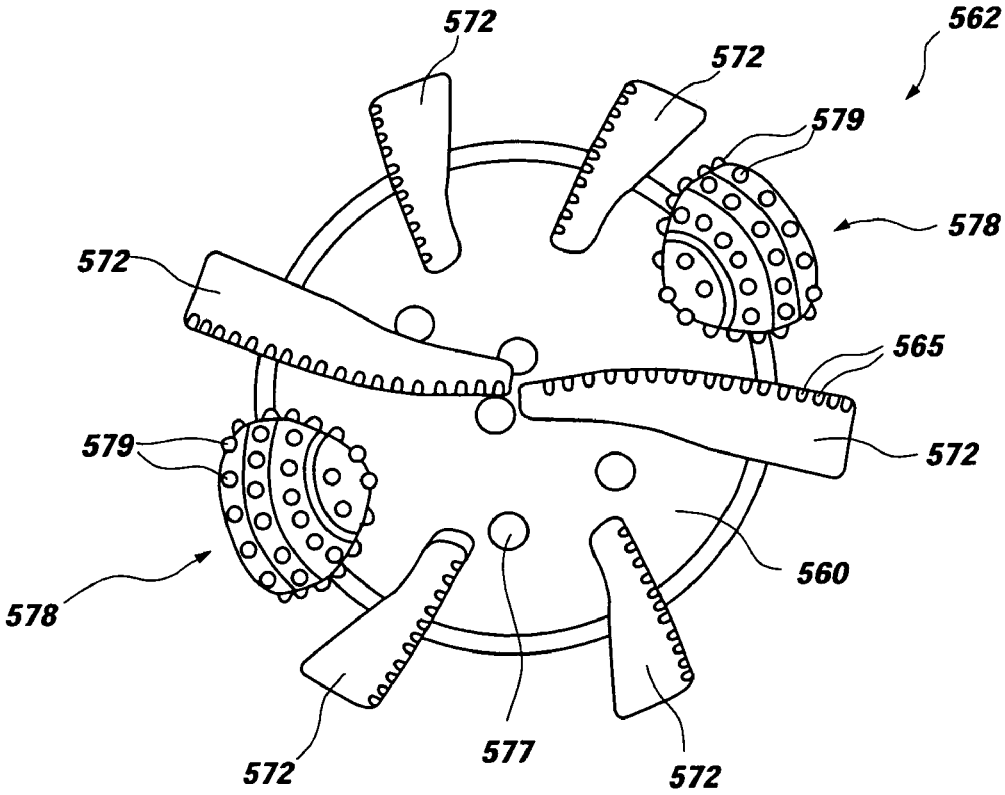
FIG. 15B shows a top view of the casing bit shown in FIG. 15A.

FIGS. 15A and 15B show another embodiment of a casing bit 562 of the present invention, wherein casing bit 562 includes a body portion 560 having generally radially extending blades 572 and a gage region 575. In addition, casing bit 562 includes rolling cones 578 affixed to body portion 560 of casing bit 562. Rolling cones 578 may be configured to rotate about a spindle (not shown), the spindle affixed to the body portion 560 of the casing bit 562. Accordingly, the rolling cones 578 may be generally configured according to rolling cones referred to as TRI-CONE® rotary drill bits. Rolling cones 578 may include inserts 579 for fracturing rock by contact therewith, as known in the art. Also, apertures 577 may be formed through body portion 560 of casing bit 562 and may be configured to deliver and communicate drilling fluid from the interior of casing bit 562 to the blades 572 thereof during drilling. While the present invention contemplates that the rolling cones 578 may be positioned without limitation upon the casing bit 562 of the present invention, it may be advantageous to position the rolling cones 578 so that the casing bit 562 may be subsequently drilled through without drilling through the rolling cones 578.

Configuring casing bit 562 with both generally radially extending blades 572 having cutting elements 565 thereon as well as rolling cones 578 may be advantageous in that the exposure of the inserts 579 disposed on rolling cones 578 in relation to cutting elements 565 disposed on the blades 572 may be substantially equalized so that in soft formations, the cutting elements 565 may more efficiently remove the formation being drilled, while in hard formations the rolling cones 578 may more effectively remove the formation being drilled. Such a configuration may provide a drilling structure suited for drilling a variety of different formation types with appropriate drilling performance in relation thereto. Alternatively, rolling cones 578 and cutting elements 565 disposed on the blades 572 may be configured according to the expected formations to be drilled. For example, the formation may be initially relatively soft (i.e., a shale), but the formation may change along the intended drilling path to a relatively hard (i.e., a limestone with stringers) formation.

As a further aspect of the present invention, a casing bit 612 may be configured to include features as described with respect to U.S. Pat. No. 6,460,631, assigned to the assignee of the present invention and the disclosure of which is incorporated in its entirety by reference herein. Alternatively, a casing bit 612 may be configured to include features as described with respect to U.S. application Ser. No. 10/266,534, which is also assigned to the assignee of the present invention and the disclosure of which is incorporated in its entirety by reference herein.

Figure 16:
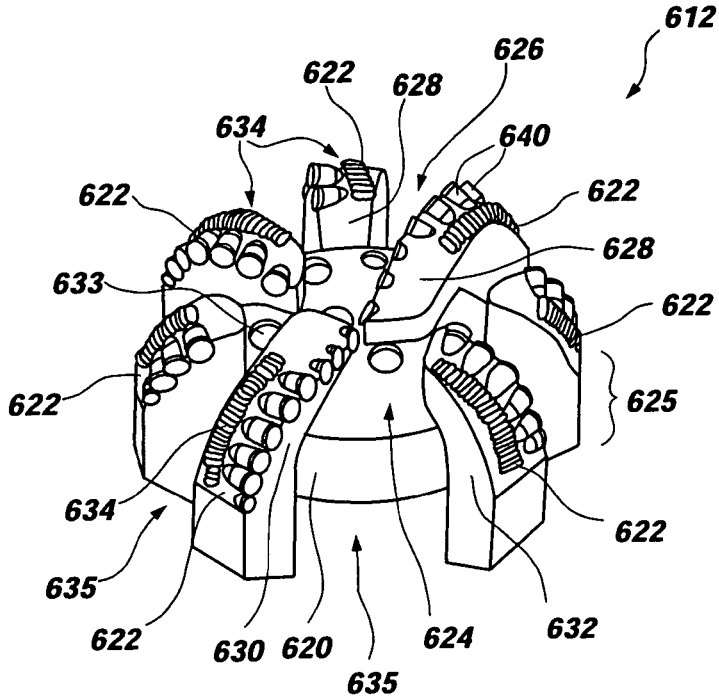
FIG. 16 shows a perspective view of an exemplary casing bit of the present invention including wear knots.

More specifically, as shown in FIG. 16, casing bit 612 of the present invention may include a plurality of blades 622 extending generally radially outwardly and longitudinally away from nose portion 620 to gage regions 625 and spaced circumferentially about the nose portion 620 of casing bit 612. Of course, a greater or fewer number of blade structures of a variety of geometries may be utilized as determined to be optimum for a particular casing bit. Furthermore, blades 622 need not be equidistantly spaced about the circumference of casing bit 612 as shown, but may be spaced about the circumference, or periphery, of a casing bit in any suitable fashion including a nonequidistant arrangement or an arrangement wherein some of the blades 622 are spaced circumferentially equidistantly from each other and wherein some of the blades are irregularly, nonequidistantly spaced from each other.

Apertures 633 may be disposed about the face 626 of the casing bit 612 in fluid communication with the interior of casing bit 612. Preferably, but not necessarily, as discussed above, apertures 633 may include nozzles or sleeves (not shown) disposed therein to better control the expulsion of drilling fluid from nose portion 620 into fluid courses 624 and junk slots 635 in order to facilitate the cooling of cutting elements 640 on casing bit 612 and the flushing of formation cuttings up the borehole toward the surface when casing bit 612 is in operation.

Blades 622 preferably comprise, in addition to gage region 625, an outward facing bearing surface 628, a rotationally leading surface 630, and a rotationally trailing surface 632. Therefore, as the casing bit 612 is rotated in a subterranean formation to create a borehole, leading surface 630 will be facing the intended direction of rotation of casing bit 612 while trailing surface 632 will be facing opposite, or backwards from, the intended direction of casing bit 612 rotation. A plurality of cutting elements 640 may be preferably disposed along and partially within blades 622. As may be noted, cutting elements 640 proximate the longitudinal axis of the casing bit 612 may be disposed so as to be relatively sunken into or surrounded by blades 622. Further, cutting elements 640 may be positioned so as to have a superabrasive cutting face generally facing in the same direction as leading surface 630 as well as to be exposed to a certain extent beyond bearing surface 628 of the respective blade in which each of cutting elements 640 is positioned. Cutting elements 640 are preferably superabrasive cutting elements known within the art, such as the exemplary PDC cutters described previously herein, and are physically secured in cutter pockets by installation and securement techniques known in the art.

Wear knots, wear clouds, or built-up wear-resistant areas 634, collectively referred to as wear knots 634 herein, may be disposed upon, or otherwise provided on bearing surfaces 628 of blades 622 with wear knots 634 preferably being positioned so as to rotationally follow cutting elements 640 positioned on respective blades 622 or other surfaces in which cutting elements 640 are disposed. Wear knots 634 may be originally molded into casing bit 612 or may be added to selected portions of bearing surface 628. As described earlier herein, bearing surfaces 628 of blades 622 may be provided with other wear-resistant features or characteristics such as embedded diamonds, TSPs, PDCs, hard facing, weldings, and weldments, for example. Such wear-resistant features may be employed to enhance directional drilling, reduce balling, and for preventing damage to cutting elements 640 due to an excessive depth-of-cut while drilling with the casing bit 612 of the present invention.

Thus, the casing bit of the present invention may include at least one cutting element for engaging a formation having a maximum compressive strength. More specifically, the at least one cutting element may be secured to a selected portion of the face of the leading end of the casing bit, the at least one superabrasive cutter exhibiting a limited amount of cutter exposure perpendicular to the selected portion of the face of the leading end to which the at least one superabrasive cutter is secured to, in combination with the total bearing surface of the casing bit, limit a maximum depth-of-cut of the at least one cutting element into the formation during drilling.

Moreover, cutting elements and wear knots of a casing bit of the present invention may be configured to control the amount of torque experienced by the bit and an optionally associated bottomhole assembly regardless of the effective weight-on-bit. Further, such a configuration may minimize at least one of torque fluctuations and rate-of-penetration fluctuations during drilling. Further, a casing bit so configured may include a sufficient amount of bearing surface area to contact the formation so as to generally distribute the weight of the bit against the bottom of the borehole without exceeding the compressive strength of the rock formation.

Figure 17:
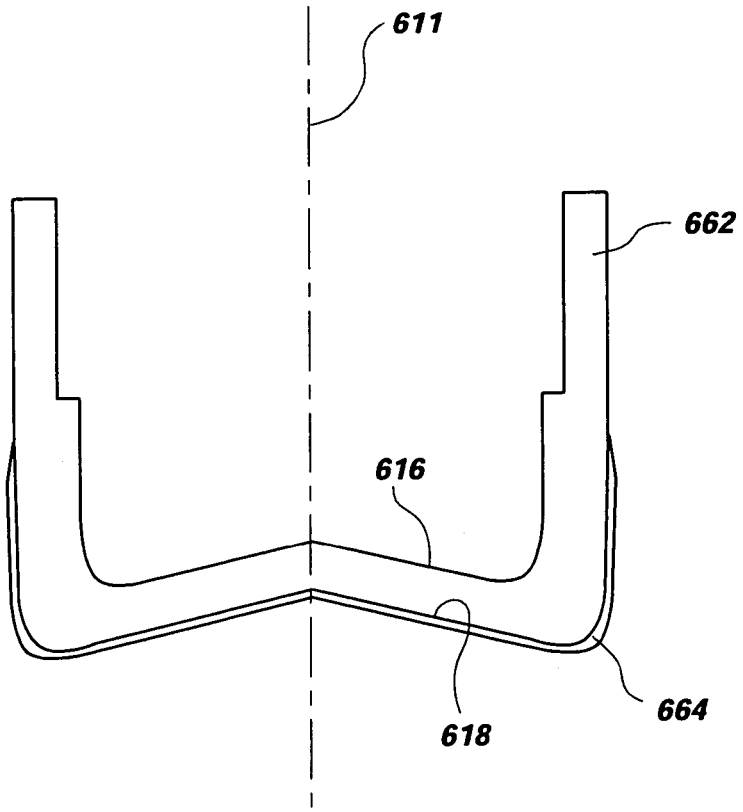
FIG. 17 shows a schematic side cross-sectional view of a casing bit according to the present invention including a coating.

Moving to FIG. 17, the present invention also contemplates that one or more coatings may be applied to the casing bit of the present invention. For instance, the casing bit 662 as shown in FIG. 17 may include a coating 664 comprising a substance that inhibits the formation cuttings from adhering thereto. Particularly, a casing bit 662, having a longitudinal axis 611, may include a coating 664 that comprises a polymer, such as TEFLON® or another polymer that inhibits adhesion between cuttings of the formation and the surface of the casing bit 662. Alternatively, coating 664 may comprise a diamond film or coating. For instance, coatings comprising diamond may be deposited by way of chemical vapor deposition or physical vapor deposition, as known in the art. Furthermore, the casing bit 662 may include coating 664 or film that exhibits erosion resistance, abrasion resistance, or both. More particularly, coating 664 may comprise a chemical vapor deposition coating, such as, for instance, a diamond material. Such a configuration may inhibit wear, erosion, or both, but may also facilitate drilling therethrough. Explaining further, coating 664 on the exterior surface of a casing bit 662 may have a propensity to fracture while being drilled through without causing significant damage to the drilling tool that is drilling the coating 664 and may also have a propensity to be flushed from the borehole by drilling fluid. Such behavior may particularly occur where the drilling profile of the drilling tool substantially corresponds with the outer profile 618 of the casing bit 662, as discussed in relation to FIGS. 2A-3B, and wherein the coating 664 is applied to the outer profile 618 of the casing bit 662. FIG. 17 also depicts an inner profile 616 of casing bit 662.

As mentioned above, a casing bit according to the present invention may be configured with a material that may be removed therefrom by one or more of mechanical, thermal, or chemical degradation. Similarly, the body or structure of the casing bit of the present invention may be acted upon by one or more of mechanical, thermal, or chemical degradation to facilitate drilling therethrough. Accordingly, in one embodiment, a casing bit of the present invention may be configured with at least one of an explosive agent and an incendiary agent. As may be appreciated, use of an explosive agent, an incendiary agent, or both, in proximity to a casing bit may facilitate a drilling tool drilling therethrough or passing therethrough.

Figure 18:
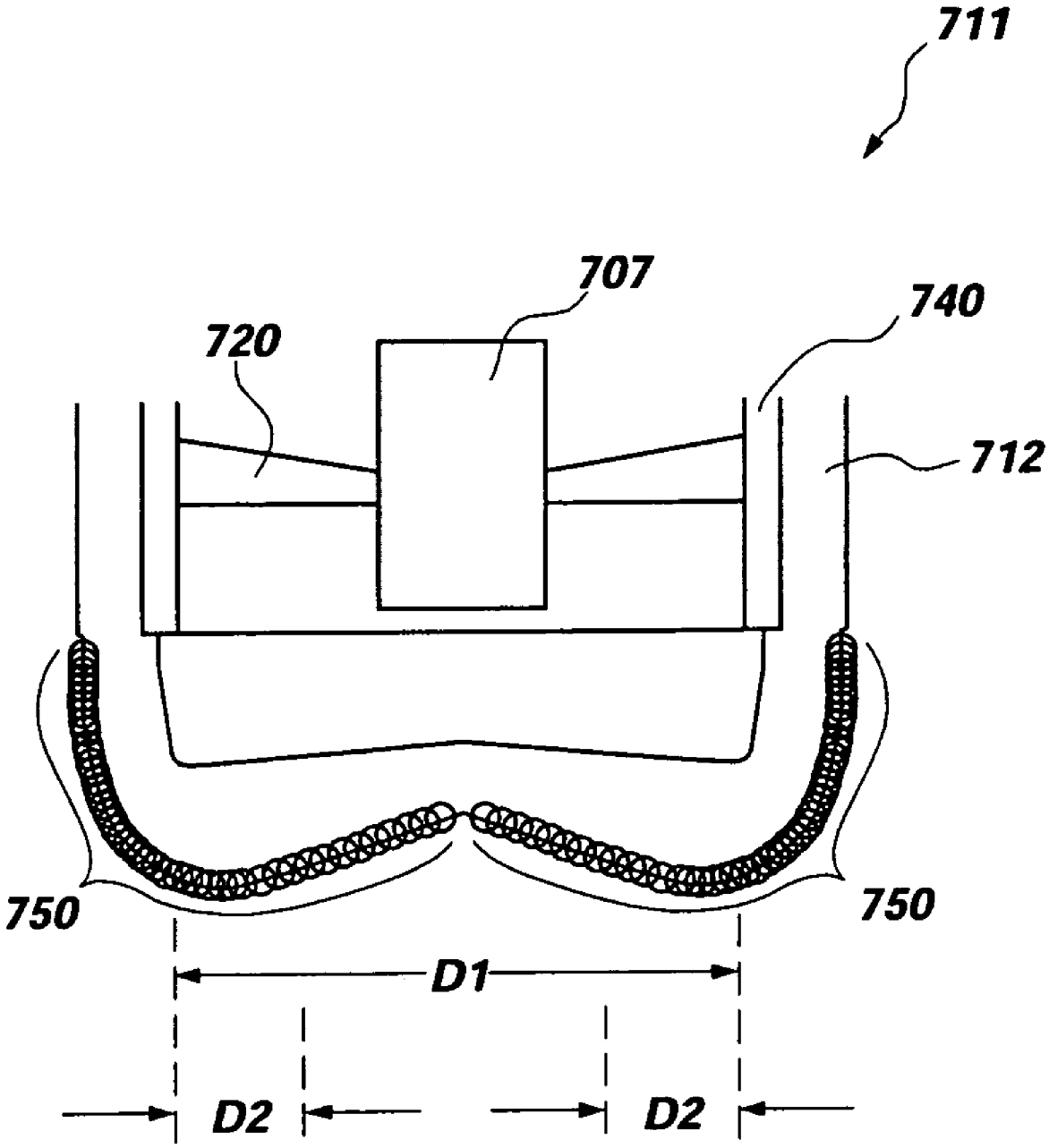
FIG. 18 shows a schematic side cross-sectional view of a casing bit according to the present invention including a destructive element.

More specifically, as shown in FIG. 18, casing assembly 711 may include casing bit 712 affixed to casing section 740. Casing assembly 711 is shown as a partial side cross-sectional design view wherein all of the cutting elements 750 that are disposed upon the casing bit 712 are shown as being rotated into a single plane and are shown on both sides of FIG. 18. Although destructive element 707 is shown as being affixed to casing section 740, casing bit 712, casing section 740, or both may include destructive element 707, without limitation. Destructive element 707 may comprise an explosive or an incendiary agent. As shown in FIG. 18, destructive element 707 may be affixed to the casing section 740 by support elements 720 disposed from one or more circumferential positions along the inner radius of casing section 740, which extend radially inwardly therefrom, and are affixed to destructive element 707. Support elements 720 may be affixed to casing section 740 and destructive element 707 by welding, brazing, mechanical fasteners, or as otherwise known in the art. Destructive element 707 may include an ignition device (not shown) that may cause the ignition of the at least one of an incendiary and explosive agent therein. Ignition device may be configured to ignite the at least one of an incendiary and explosive agent within destructive element 707 upon contact with a drilling tool (not shown) or upon contact with a deployable element (not shown) that may be "dropped" down the interior of the casing section 740. Such a deployable element may be a substantially spherical ball. Alternatively, the ignition device (not shown) may ignite the at least one of an incendiary and explosive agent in response to one or more pressure pulses or a magnitude of pressure of the drilling fluid. For instance, mud-pulse telemetry may be used to cause ignition of at least one of an incendiary and explosive agent of destructive element 707.

Preferably, destructive element 707 may be configured to substantially remove, destroy, perforate, degrade, weaken, or otherwise render a portion of casing bit 712 that is desired to drill therethrough to be more easily drilled. For instance, destructive element 707 may be configured to substantially remove region D1 of casing bit 712 by generating hot gases, liquids, or both, that are directed toward region D1. More specifically, for example, destructive element 707 may comprise a quantity of thermite, a mixture of powdered or granular aluminum and a metal oxide, which, of course, may be combined with other substances, such as binders, and may be configured to cause a thermite reaction. Alternatively, destructive element 707 may be configured as a tool for perforating casing, as known in the art.

Of course, cutting elements 750 generally within region D1 may be substantially removed, destroyed, perforated, degraded, weakened, or otherwise rendered more drillable. However, it may be appreciated that a majority of the cutting elements disposed on casing bit 712 within region D1 may be positioned in the region denoted by D2, because the number of cutting elements 750 may be adjusted in relation to the amount of formation removed therewith, and the volume of formation removed increases with radial distance from the center of rotation of the casing bit 712. Accordingly, destructive element 707 may be configured to substantially remove annular region D2 of casing bit 712 by generating hot gases, liquids, or both, that are directed toward annular region D2. Such a configuration may be configured to substantially remove, destroy, perforate, degrade, weaken, or otherwise render more drillable a majority of cutting elements 750 within region D1.

Figure 19A:
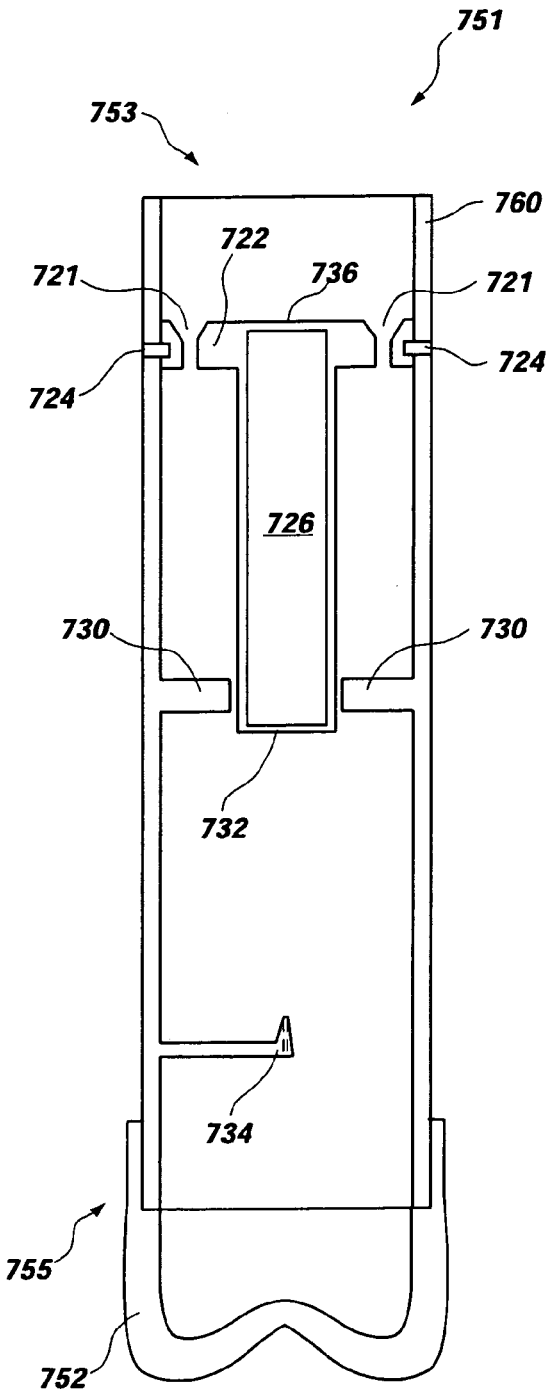
FIGS. 19A and 19B each show schematic cross-sectional views of a substance delivery assembly of the present invention.
Figure 19B:
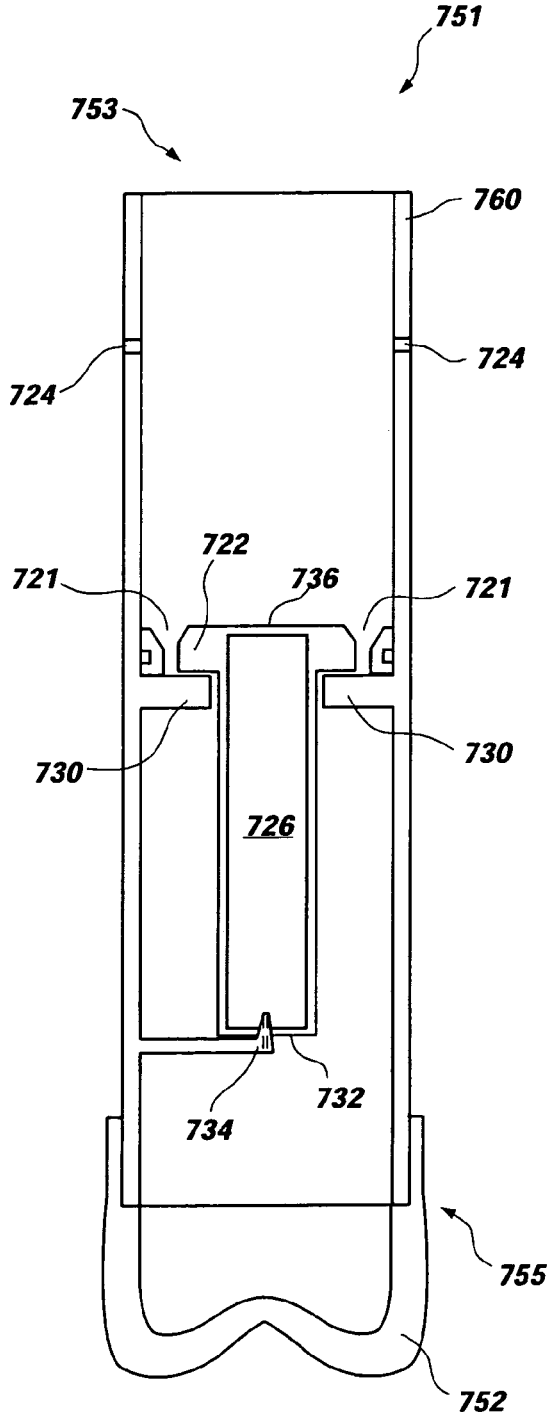

Also, in another embodiment, the body of a casing bit, the cutting elements affixed thereto, or both may be dissolved, degraded, abraded, weakened, or otherwise rendered more drillable prior to drilling therethrough. As shown in FIGS. 19A and 19B, a substance delivery assembly 751 may include a casing section 760 having a container 722 with a chamber 726 that is configured for holding a substance. The substance may preferably be a relatively highly reactive chemical, such as, for instance, nitric acid, hydrofluoric acid, hydrochloric acid, or mixtures thereof. The amount and concentration of chemical held by container 722 may be selected according to the materials and size of a casing bit 752 affixed to the lower end 755 of casing section 760, to substantially dissolve, degrade, weaken, or destroy at least a portion of the casing bit 752.

Initially, container 722 may be affixed at its upper longitudinal end to casing section 760 by way of frangible elements 724 and disposed between positioning elements 730 at its lower longitudinal end. During drilling, as drilling fluid flows from the upper end 753 of casing section 760 and through apertures 721, a downward longitudinal force may be developed on container 722. However, the frangible elements 724 and apertures 721 may be sized and configured so that the frangible elements 724 will not fail in response to the flow rates of drilling fluid experienced during normal drilling conditions. Upon completion of a desired depth of drilling, the flow rate of drilling fluid may be increased to a level sufficient to fail the frangible elements 724, which may allow container 722 to be displaced longitudinally downwardly between extending positioning elements 730, as shown in FIG. 19B. As may be seen in FIG. 19B, container 722 may be punctured through its lower wall 732 by barb 734. Barb 734 may have one or more holes extending longitudinally therethrough or may be splined on its surface to allow a fluid within chamber 726 to flow therearound and interact with the casing bit 752. Also, apertures 721 may be sealed or substantially blocked at their lower longitudinal openings by the upper longitudinal surfaces of positioning elements 730, which may substantially reduce or prevent drilling fluid from flowing through apertures 721. Such a configuration may be advantageous so that the substance within chamber 726 may be less diluted or washed away quickly from casing bit 752.

Of course, many alternatives exist for delivering a substance to the casing bit 752 by way of container 722. For instance, alternatively, barb 734 may be eliminated, while the upper wall 736 of chamber 726, the lower wall 732 of chamber 726, or both may be configured to be frangible, so that pressure of the drilling fluid causes both to break, rupture, or otherwise perforate so as to allow a substance within chamber 726 to escape. As a further alternative embodiment, the upper wall 736 may be configured as a piston element that is releasably affixed to the chamber 726 but may be caused, by way of drilling fluid pressure, to move longitudinally downwardly within chamber 726 so as to expel a substance contained therein.

Figure 20A:
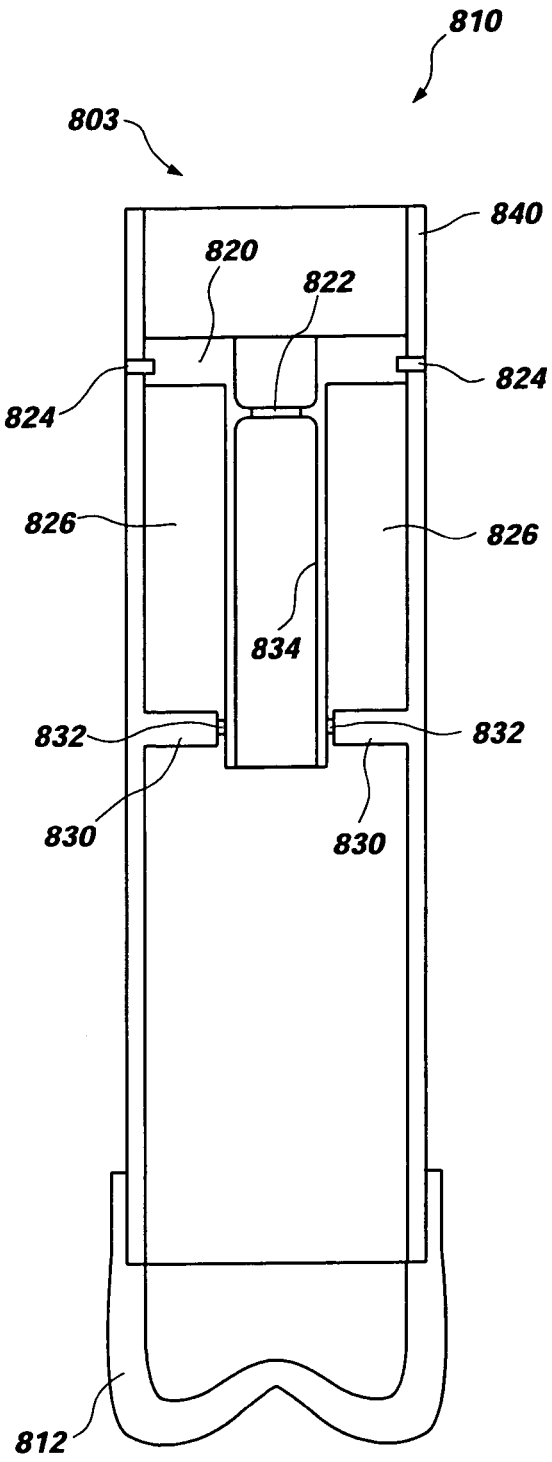
FIGS. 20A-20D show schematic cross-sectional views of another embodiment of a substance delivery assembly of the present invention.
Figure 20B:
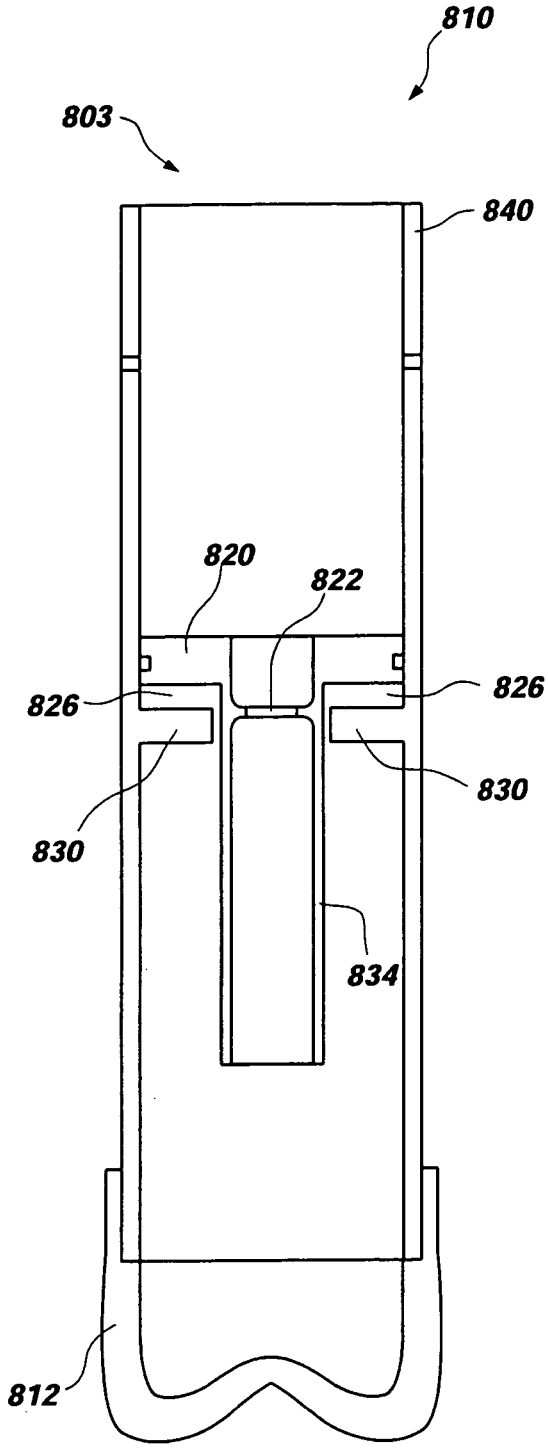

FIGS. 20A, 20B, 20C, and 20D show an embodiment of substance delivery assembly 810 wherein a piston element 820 is configured to expel a substance from chamber 826 formed between the wall of casing section 840 and drilling fluid tube 834. During drilling, drilling fluid flows from the upper end 803 of casing section 840, through aperture 822, and through drilling fluid tube 834, which generates a downward longitudinal force on piston element 820. However, the frangible elements 824 and aperture 822 may be sized and configured so that the frangible elements 824 will not fail in response to the flow rates of drilling fluid experienced during normal drilling conditions. Upon completion of a desired depth of drilling, the flow rate of drilling fluid may be increased to a level sufficient to fail the frangible elements 824, which may allow piston element 820 to be displaced longitudinally downwardly, generating a pressure within chamber 826 sufficient to force a substance across seal element 832 and may also displace or "blow-out" seal elements 832. In turn, the contents of chamber 826 may be expelled from chamber 826 through the annulus formed between fluid tube 834 and positioning flange 830 as piston element 820 is displaced longitudinally downwardly between extending positioning flange 830. Of course, as discussed above, the chamber 826 may contain a sufficient amount or concentration of a reactive chemical, such as, for instance, acid to dissolve, weaken, destroy, or otherwise improve the drillability of casing bit 812. However, the embodiment of substance delivery assembly 810 as shown in FIGS. 20A and 20B may dilute or wash away the substance or chemical expelled from chamber 826, because drilling fluid may continue to flow through drilling fluid tube 834 and mix with the substance as it is emptied from chamber 826.

Figure 20C:
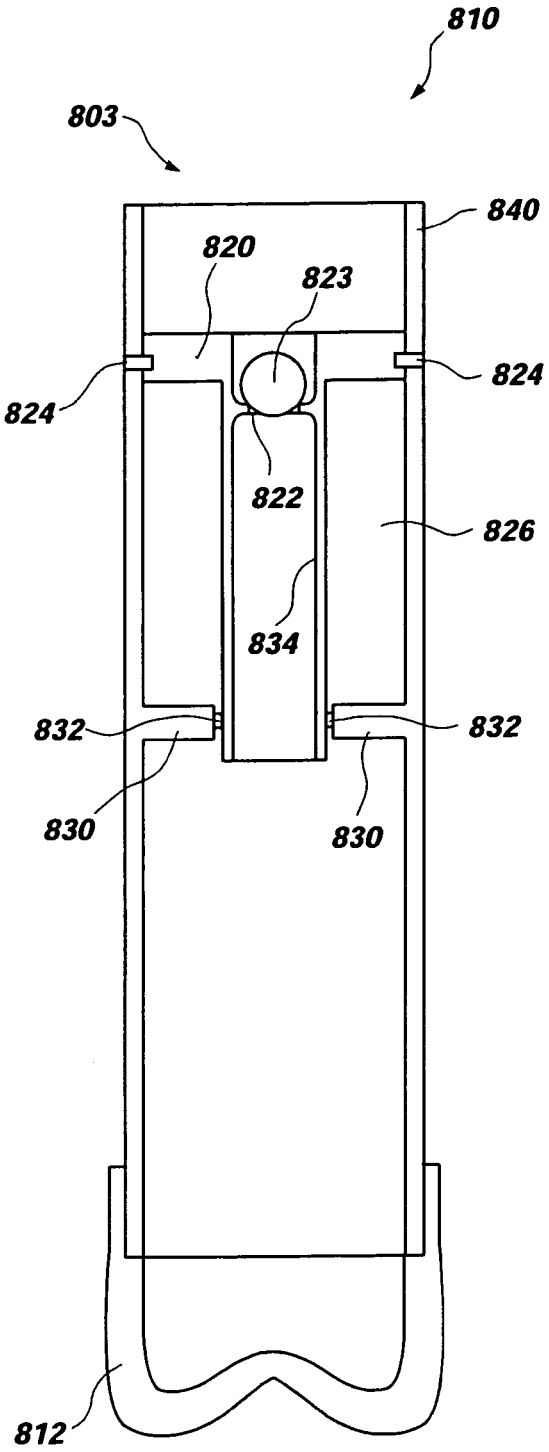
Figure 20D:
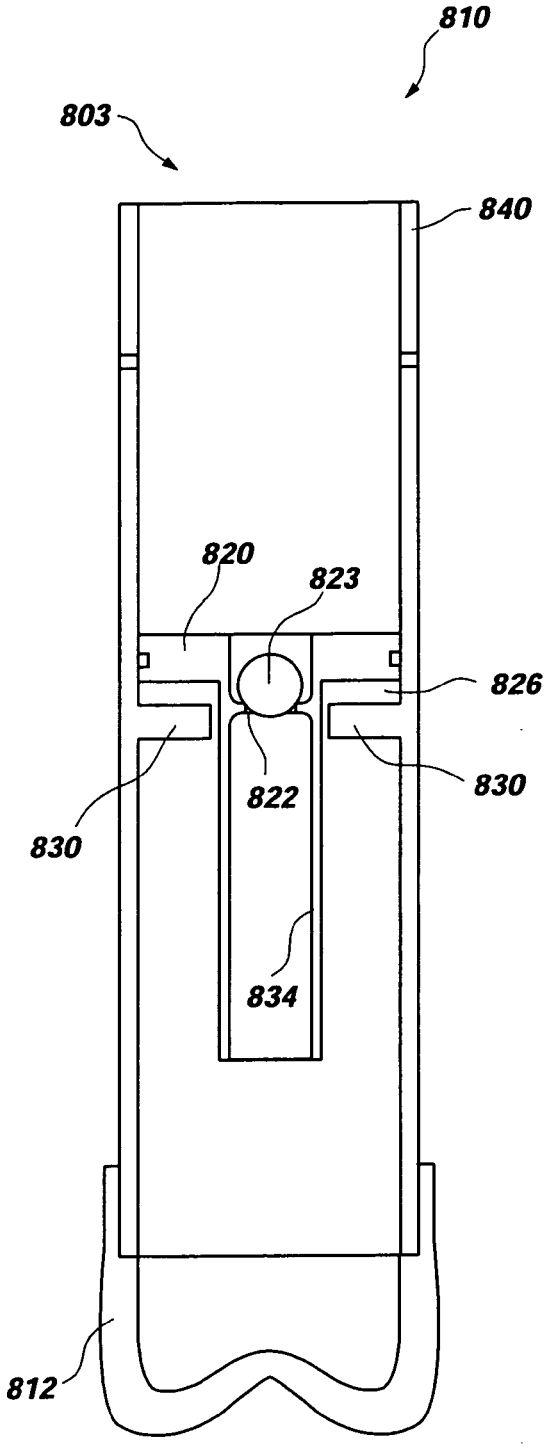

In another embodiment of substance delivery assembly 810, as shown in FIGS. 20C and 20D, an actuation element 823, shown as a ball, may be disposed within casing section 840 from a surface of a subterranean formation or from within the drilling assembly to cause a substance within chamber 826 to be expelled therefrom. During drilling, drilling fluid may flow from the upper end 803 of casing section 840, through aperture 822, and through drilling fluid tube 834. However, the frangible elements 824 and aperture 822 may be sized and configured so that the frangible elements 824 will not fail in response to the force developed on piston element 820 in response to the flow rates of drilling fluid therethrough that may be experienced during normal drilling conditions. Upon completion of a desired depth of drilling, the actuation element 823 may be disposed within casing section 840, ultimately being disposed against the opening defining aperture 822. Pressure developed in the drilling fluid by reducing or preventing drilling fluid flow through aperture 822 may increase to a level sufficient to fail the frangible elements 824, which may allow piston element 820 to be displaced longitudinally downwardly, generating a pressure within chamber 826 sufficient to displace or fail seal elements 832. In this way, the contents of chamber 826 may be expelled from chamber 826 through the annulus formed between fluid tube 834 and positioning flange 830 as piston element 820 is displaced longitudinally downwardly between radially extending positioning flange 830.

As a further embodiment of a casing bit of the present invention, abrasive particles entrained within the drilling fluid may be used to erode or abrade the casing bit subsequent to drilling therewith. For instance, abrasive particles may be introduced into the drilling fluid at or near the surface of the subterranean formation. Alternatively, abrasive particles may be delivered selectively by a delivery system within the casing. For instance, turning to FIGS. 20A and 20B, chamber 826 may contain an abrasive material, for instance, within a slurry, which may be released or expelled in the manner described above with respect to a chemical. Abrasive material so delivered may include silicon carbide, sand, alumina, or other ceramics or cermets as known in the art.

Figure 21A:
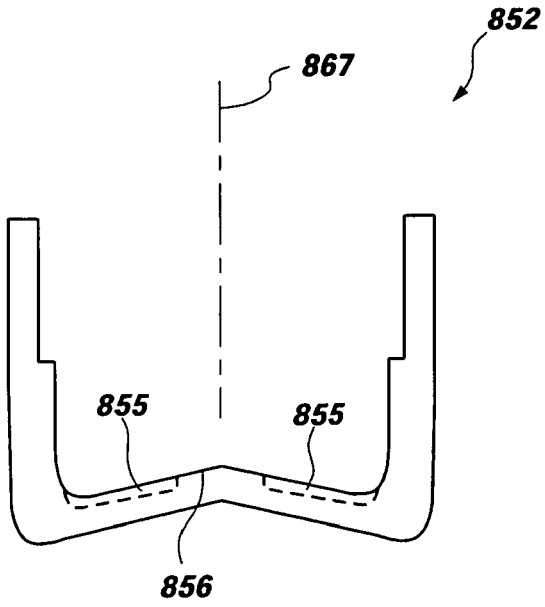
FIG. 21A shows a schematic side cross-sectional view of a casing bit of the present invention including recesses or grooves configured to preferentially fail.
Figure 21B:
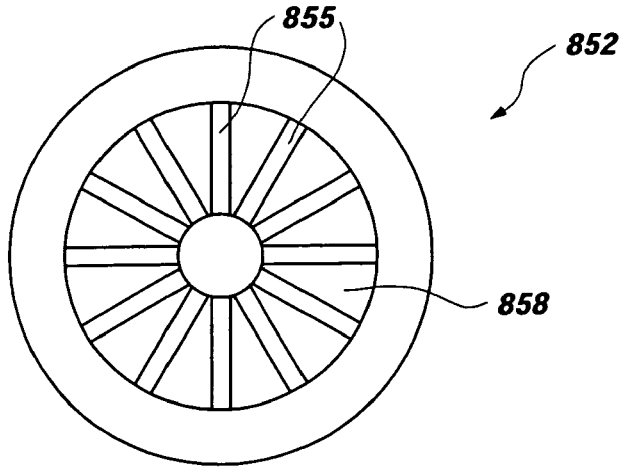
FIG. 21B shows a schematic top elevation of the casing bit shown in FIG. 21A.

In another embodiment of the present invention, a casing bit of the present invention may be mechanically configured to be frangible, weakened, or fractured preferentially, in response to forces applied thereto subsequent to drilling operations. Particularly, casing bit 852 of the present invention may include one or more recesses or grooves 855 that may cause the casing bit to be frangible, weakened, or fractured preferentially. Turning to FIGS. 21A and 21B, casing bit 852 is shown as having twelve generally radially extending recesses or grooves 855 formed in the inner profile 856 of casing bit 852. Grooves 855 may have different radial extents, depths, and widths, in relation to the expected drilling forces in the area that the groove is formed. In addition, grooves 855 may be formed on the outside surface, inner surface, or both, of casing bit 852 and may be oriented circumferentially, longitudinally, or in any other suitable orientation. For instance, grooves may be arranged in a so-called pineapple pattern, analogous to the pattern formed on the exterior of grenades to cause preferential shrapnel formation. Additionally or alternatively, welds (not shown) may be formed along the inner profile 856 to strengthen the casing bit 852 for drilling operation, but which may be subsequently removed as a drilling tool (not shown) is disposed within casing bit 852 and begins to drill therethrough. In addition, axial forces, in excess of the axial forces applied while drilling, may be applied to the casing bit 852, during rotation or otherwise, which may cause weakening or failure along the grooves 855. Such a configuration may cause the casing bit 852 to fracture into a number of sections 858 that may be flushed from a borehole by drilling fluid emanating from a drilling tool (not shown) drilling therethrough. Particularly, for instance, a casing bit 852 including grooves 855 may be fractured preferentially into sections 858 by way of at least one of an explosive and an incendiary agent, as discussed above, without limitation.

Figure 21C:
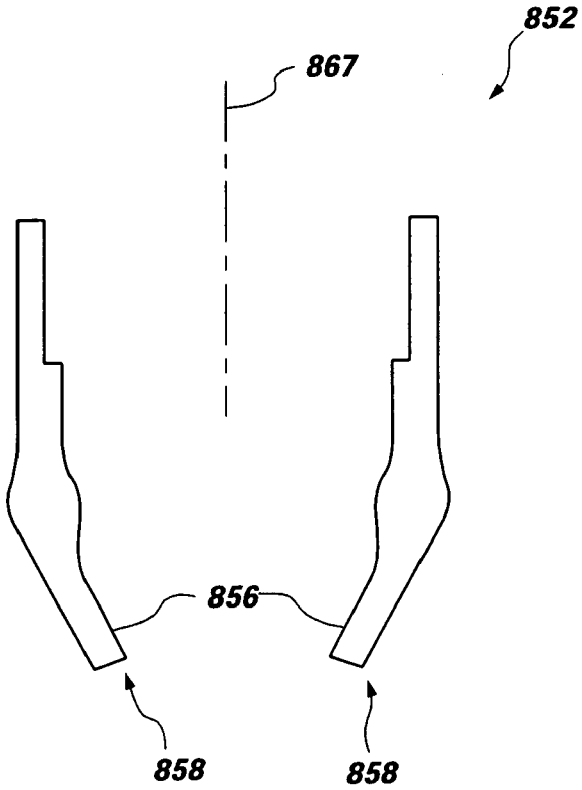
FIG. 21C shows a schematic side cross-sectional view of a casing bit of the present invention which has been deformed.

Alternatively, the configuration as depicted in FIGS. 21A and 21B may be suited for deformation of the inner profile 856 of the casing bit 852 about longitudinal axis 867 to facilitate a drilling tool passing therethrough as shown in FIG. 21C. For instance, a drilling tool may drill partially into the inner profile 856, which may include welds (not shown) that strengthen the casing bit 852 along radially extending grooves 855. Upon substantial removal, by drilling or otherwise, of any such welds, the drilling tool may be forced longitudinally downward, pushing the sections 858 of the casing bit 852 radially outward and separating the sections 858. Of course, the casing bit 852 may be cemented within the borehole at some distance above the bottom thereof to allow clearance for deformation of the sections 858 as shown in FIG. 21C.

Figure 21D:
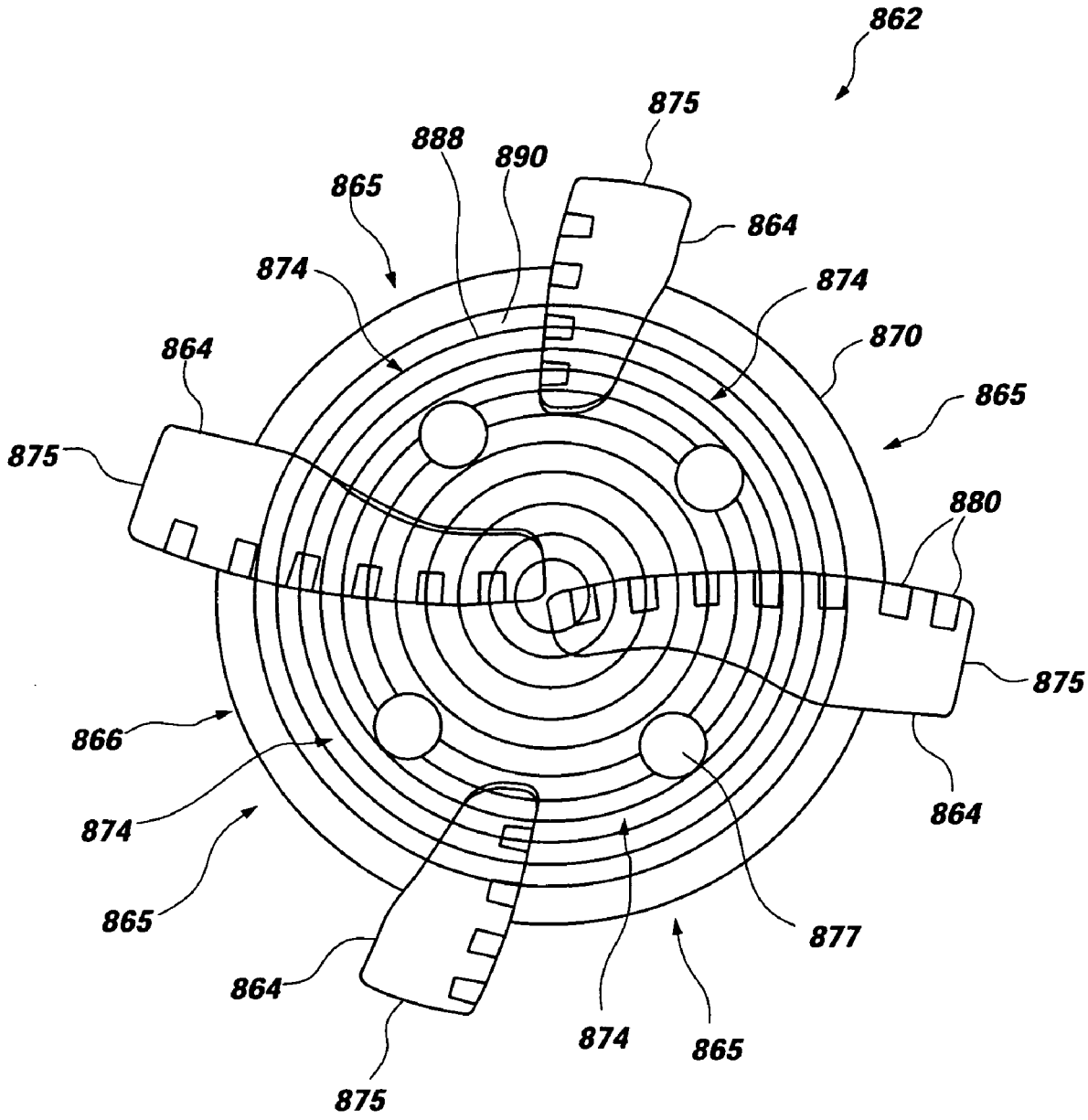
FIG. 21D shows a top elevation of a casing bit of the present invention formed of fiber-reinforced composite including one or more fibers disposed generally concentrically therein.

In a further structural embodiment of a casing bit of the present invention, the body of the casing bit may be formed of fiber-reinforced composite, wherein the fiber extends in a generally circumferential fashion. FIG. 21D depicts a schematic representation of a casing bit 862, shown from an upwardly looking perspective in relation to its face 866, a perspective as if viewing the casing bit 862 from the bottom of a borehole. Casing bit 862 may be formed of a fiber-reinforced composite material wherein one or more fibers 888 are disposed within a matrix material 890. Matrix material 890 may comprise a hardenable or curable resin, such as an epoxy, thermoplastic, or a phenolic resin matrix. For example, suitable commercially available curable phenolic resins may be SC-I008 from Borden Chemical of Columbus, Ohio and 91-LD phenolic resin from Stuart-Ironsides of Chicago, Ill. Alternatively, Polyetherketone (PEK), Polyetherketoneketone (PEKK), or Polyetheretherketone (PEEK) may comprise matrix material 890. One or more fibers 888 may comprise metal wire, carbon, or ceramic materials. Further, processes for the fabrication of fiber-reinforced composite may involve applying matrix material 890 and one or more fibers 888 to a mandrel (in a pre-preg form or otherwise) such as by tape wrapping; ply-by-ply applying and debulking thereof at very high pressures and temperatures to soften the resin, immediately followed by cooling; and autoclaving or hydroclaving curing, such as by pressurized curing at 200 to 1000 psig, as known in the art.

As shown in FIG. 21D, the one or more fibers 888 may be configured in a generally concentric fashion, in relation to a single point, such as the longitudinal axis of the casing bit 862, or about another point. In addition, the present invention contemplates that one or more fibers 888 may be generally concentric in different areas (i.e., about different points). Such a configuration may provide structural strength and stiffness in localized regions about which the one or more fibers 888 are concentric. Casing bit 862 includes a nose portion 870, apertures 877, and generally radially extending blades 864, forming fluid courses 874 therebetween extending to junk slots 865, between circumferentially adjacent blades 864. Blades 864 may also include pockets 880, which may be configured to carry cutting elements (not shown), such as, for instance, polycrystalline diamond cutting elements. One or more fibers 888 may bend, twist, or may otherwise be disposed to form the geometric features of the casing bit 862, such as blades 864 and cutting pockets 880, or, alternatively, geometric features of casing bit 862 may be formed by machining through the one or more fibers 888. Each of blades 864 may include a gage region 875 which is configured to define the outermost radius of the casing bit 862 and which may comprise longitudinally upward (as the casing bit 862 is oriented during use) extensions of blades 864, extending from nose portion 870. As may be appreciated, orienting the one or more fibers 888 in a generally circumferential, concentric fashion may provide structural support to the cutting elements (not shown) against torque, WOB, or both, that is applied to the casing bit during drilling. However, fiber-reinforced composite casing bit 862 may be relatively easy to drill through, because the concentrically-oriented one or more fibers 888 may not withstand drilling effectively.

Figure 21E:
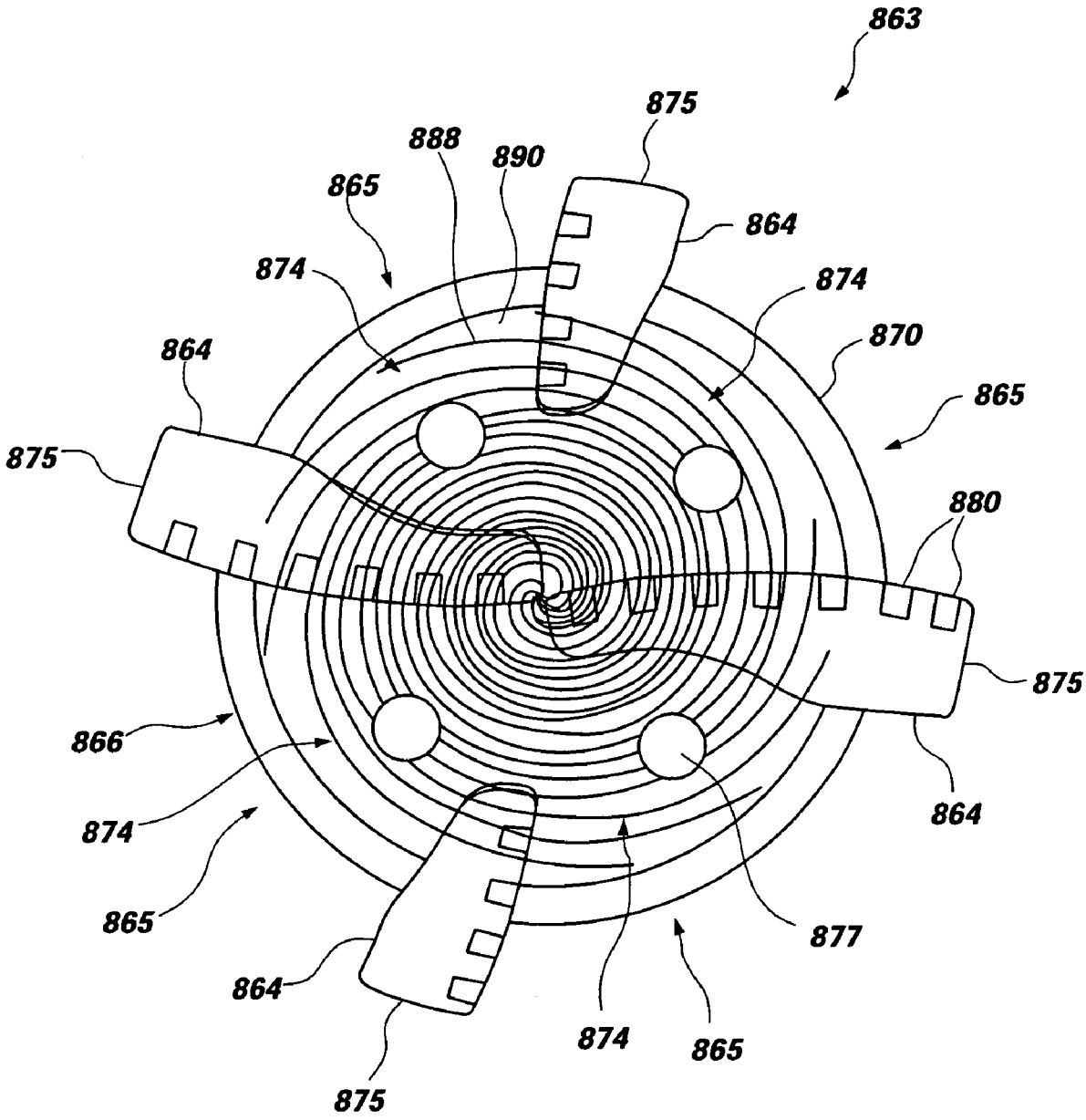
FIG. 21E shows a top elevation of a casing bit of the present invention formed of fiber-reinforced composite including one or more fibers disposed generally spirally therein.

Alternatively, as shown in FIG. 21E, orienting the fiber of a fiber-reinforced composite in a generally circumferential, spiral fashion may support the cutting elements and casing bit 863 against torque applied thereto during drilling. FIG. 21E depicts a schematic representation of a casing bit 863, shown from an upwardly looking perspective in relation to its face 866, a perspective as if viewing the casing bit 863 from the bottom of a borehole. Casing bit 863 may be formed of a fiber-reinforced composite material wherein one or more fibers 888 are disposed within a matrix material 890. One or more fibers 888 may comprise metal wire, carbon, or ceramic materials. As shown in FIG. 21E, the one or more fibers 888 may be generally disposed along a spiral, the spiral originating substantially at the center of the casing bit 863. Of course, the present invention contemplates that one or more fibers 888 may be generally disposed along a spiral, wherein the spiral originates in one or more different areas (i.e., about different points). Such a configuration may provide structural strength and stiffness in localized regions about which the one or more fibers 888 originate. Casing bit 863 may include a nose portion 870, apertures 877, generally radially extending blades 864 having pockets 880, fluid courses 874 between adjacent blades 864 extending to junk slots 865 and gage regions 875 as discussed in relation to FIG. 21D. Further, one or more fibers 888 may bend, twist, or may otherwise be disposed to form the geometric features of the casing bit 863, such as blades 864 and cutting pockets 880, or alternatively, geometric features of casing bit 863 may be formed by machining through the one or more fibers 888. As may be appreciated, orienting the one or more fibers 888 in a generally circumferential, spiral fashion may provide structural support to the cutting elements (not shown) against torque, WOB, or both, that is applied to the casing bit 863 during drilling. However, fiber-reinforced composite casing bit 863 may be relatively easy to drill through, because the spirally-extending one or more fibers 888 may not withstand drilling effectively.

Referring back to FIG. 10A, the present invention also contemplates that cutting elements disposed on a casing bit of the present invention may be configured for ease of removal which may facilitate drilling through a casing bit from which the cutting elements have been removed. FIG. 10A illustrates a partial side cross-sectional design view of an embodiment of a casing bit assembly 310 of the present invention including casing bit 312 affixed to casing section 340 along connection surface 315, which may be threaded, welded, or both, wherein all of the cutting elements 332 that are disposed upon the casing bit 312 are shown as being rotated into a single plane in relation to longitudinal axis 311. As shown in FIG. 10A, region x1 may correspond to the portion of the casing bit 312 extending radially from longitudinal axis 311 to a radial position corresponding to the inner surface 341 of casing section 340. Comparatively, region x2 shows a region of casing bit 312 which may not be configured for drilling through. Accordingly, the cutting elements 332 generally within region x1 may be configured differently than the cutting elements 332 generally within region x2. Specifically, the cutting elements 332 generally within region x1 may be selectively configured to be released from the casing bit 312.

For example, at least one of the cutting elements 332 generally within region x1 may be affixed to the casing bit 312 by way of an adhesive. During drilling, as cutting elements 332 may be typically forced into cutting pockets (not shown) formed within the body of casing bit 312, the adhesive may exhibit sufficient strength therefor. Upon completion of drilling with casing bit 312, the cutting elements 332 within region x1 of casing bit 312 may be removed therefrom by impact loading, increasing the forces over those exerted during drilling, or heating the cutting elements 332 by drilling with reduced drilling fluid flow rates. Doing so may cause the adhesive to fail, thus allowing the cutting elements 332 within region x1 to be removed from casing bit 312. Separating the cutting elements 332 from the casing bit 312 may facilitate drilling therethrough, or may facilitate removing the cutting elements 332 from the borehole by propelling the cutting elements 332 upwardly within the borehole with drilling fluid.

The adhesive may comprise an epoxy, an acrylic, an acrylate, a phenolic, a formaldehyde, a polyurethane, a polyester, a silicone, a vinyl, a vinyl ester, a thermosetting plastic or other adhesive formulation as known in the art.

As a further alternative, affixing at least one cutting element 332 generally within region x1 by way of soldering may facilitate removal thereof after drilling, particularly by heating the cutting elements 332 by drilling with reduced drilling fluid flow rates. As used herein, "brazing" refers to affixation formed by way of at least partially melting a material at a temperature of about 1000° Fahrenheit or higher, while soldering refers to affixation formed by way of at least partially melting a material at a temperature of between about 400° Fahrenheit to about 1000° Fahrenheit. However, the ranges of soldering and brazing may overlap, above and below 1000° Fahrenheit. In further detail, soldering material (i.e., a solder) may typically comprise tin, lead, silver, copper, antimony, or as otherwise known in the art. Also, solder used to affix at least one cutting element 332 generally within region x1 may preferably comprise a eutectic alloy.

In a further alternative, at least one cutting element may be affixed to a casing bit by way of so-called electrically disbonding adhesive. For instance, U.S. Pat. No. 6,620,380 to Thomas et al., the disclosure of which is incorporated in its entirety by reference herein, discloses an electrically disbonding material which may be configured as an adhesive, having a lap shear strength in the range of 2000-4000 psi. Further, the bond between the disbondable composition and a substrate may be weakened in a relatively short time by the flow of electrical current across the bondline between the substrate and the composition. Accordingly, at least one of the cutting elements 332 generally within region x1 may be affixed to the casing bit 312 by way of an electrically disbonding material. During drilling, as cutting elements 332 may be typically forced into cutting pockets (not shown) formed within the body of casing bit 312, the electrically disbonding material may exhibit sufficient strength therefor. Upon completion of drilling with casing bit 312, the at least one cutting element 332 within region x1 of casing bit 312 may be removed therefrom by causing an electric current to flow across the electrically disbonding material. Doing so may cause the electrically disbonding material to fail or weaken, thus allowing the cutting elements 332 within region x1 to be removed from casing bit 312.

Figure 22A:
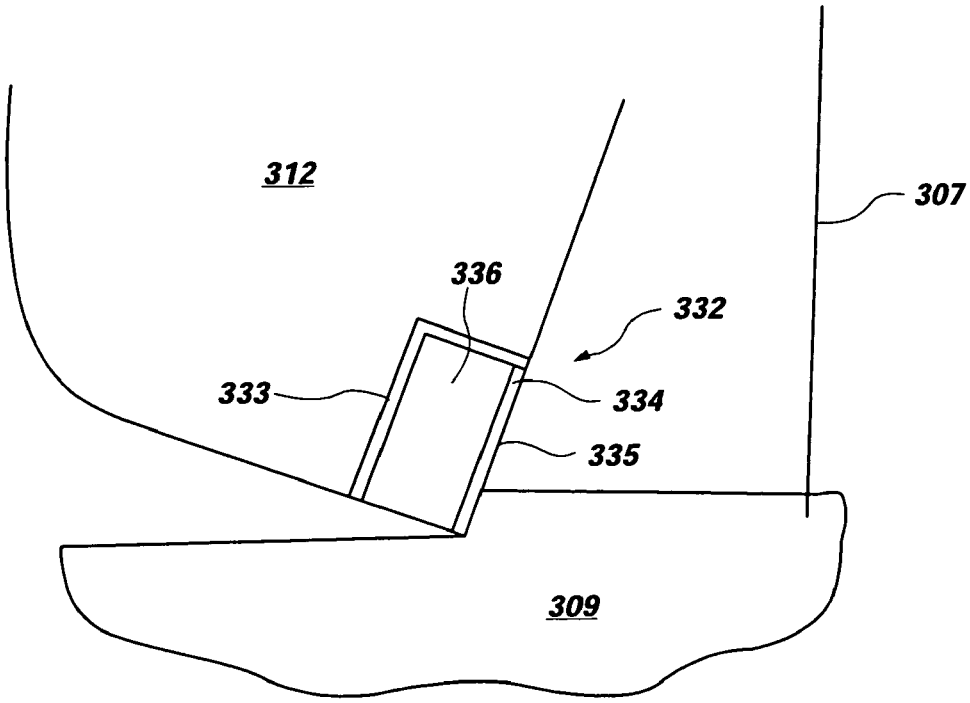
FIG. 22A shows an enlarged partial cross-sectional view of a cutting element configuration including electrically disbonding material.
Figure 22B:
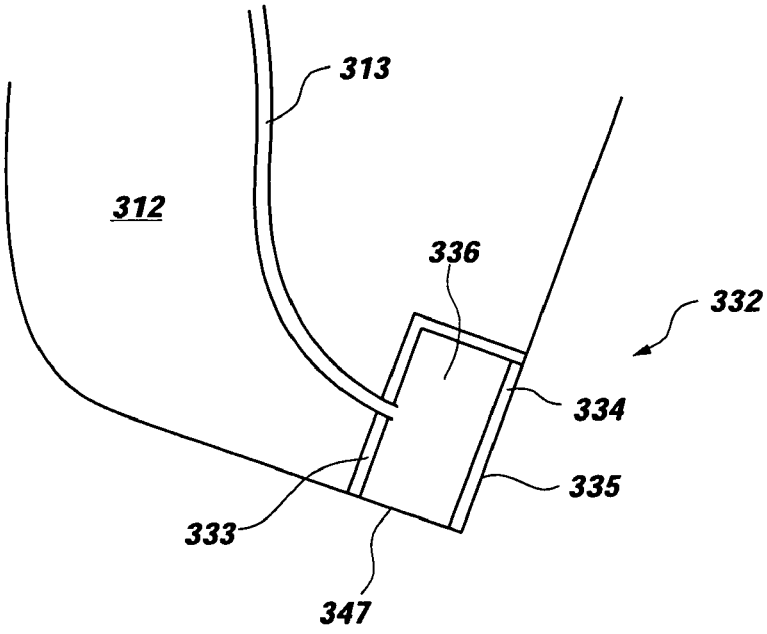
FIG. 22B shows an enlarged partial cross-sectional view of a cutting element configuration including an insulated conductor extending to the cutting element for causing electric current to flow across the electrically disbonding material.

More particularly, an electric current may flow across the electrically disbonding material by applying a voltage between the casing bit and a cutting element. For instance, FIGS. 22A and 22B illustrate configurations for causing a current to flow between the casing bit and a cutting element. FIG. 22A shows a partial cross-sectional view of cutting element 332 disposed within and affixed to a pocket formed in casing bit 312 by way of electrically disbanding material 333. As seen in FIG. 22A, diamond table 334 may contact formation 309 at cutting surface 335. Accordingly, a voltage may be selectively applied or generated between the casing bit 312 and the formation 309 that causes current to flow through electrically disbonding material 333. For instance, a positive voltage may be applied to the casing bit 312 and the formation may act as a ground (as exhibiting a lower voltage) in relation thereto, so that current passes through the casing bit 312, through the electrically disbonding material 333, and into the formation 309. Such a current may cause the cutting element 332 to become separated from the casing bit 312. Separating the cutting elements 332 from the casing bit 312 may facilitate drilling therethrough, or may facilitate removing the cutting elements 332 from the borehole by drilling fluid propelling the cutting elements 332 upwardly within the borehole. Conductive element 307 is optional, is shown in a merely schematic representation, and may be electrically charged or configured to facilitate causing current to flow through electrically disbanding material 333. Further, conductive element 307 may be positioned within the formation at the surface of the borehole or otherwise.

The present invention also contemplates that drilling fluid sleeves or nozzles may also be affixed to and selectively released from a casing bit by way of electrically disbonding material. More generally, materials that may be difficult to drill through may be affixed to and selectively released from a casing bit.

Alternatively, FIG. 22B illustrates that a conductor 313, which may be insulated from the casing bit 312, may be electrically connected to the substrate 336 of a cutting element 332. Thus, a voltage difference generated or applied between the casing bit 312 and the conductor 313 may cause current to flow through electrically disbonding material 333. Further, conductor 313 may be abutted against substrate 336 or may be affixed to substrate 336 but configured to break away therefrom. Accordingly, cutting element 332 may be separated from casing bit 312. Separating cutting element 332 from the casing bit 312 may facilitate drilling therethrough, or may facilitate removing the cutting element 332 from the borehole by drilling fluid propelling the cutting element 332 upwardly within the borehole. Of course, in the case of many cutting elements 332, associated conductors 313 may be disposed in electrical communication with each cutting element 332 and may be, preferably, electrically connected to one another.

Figure 22C:
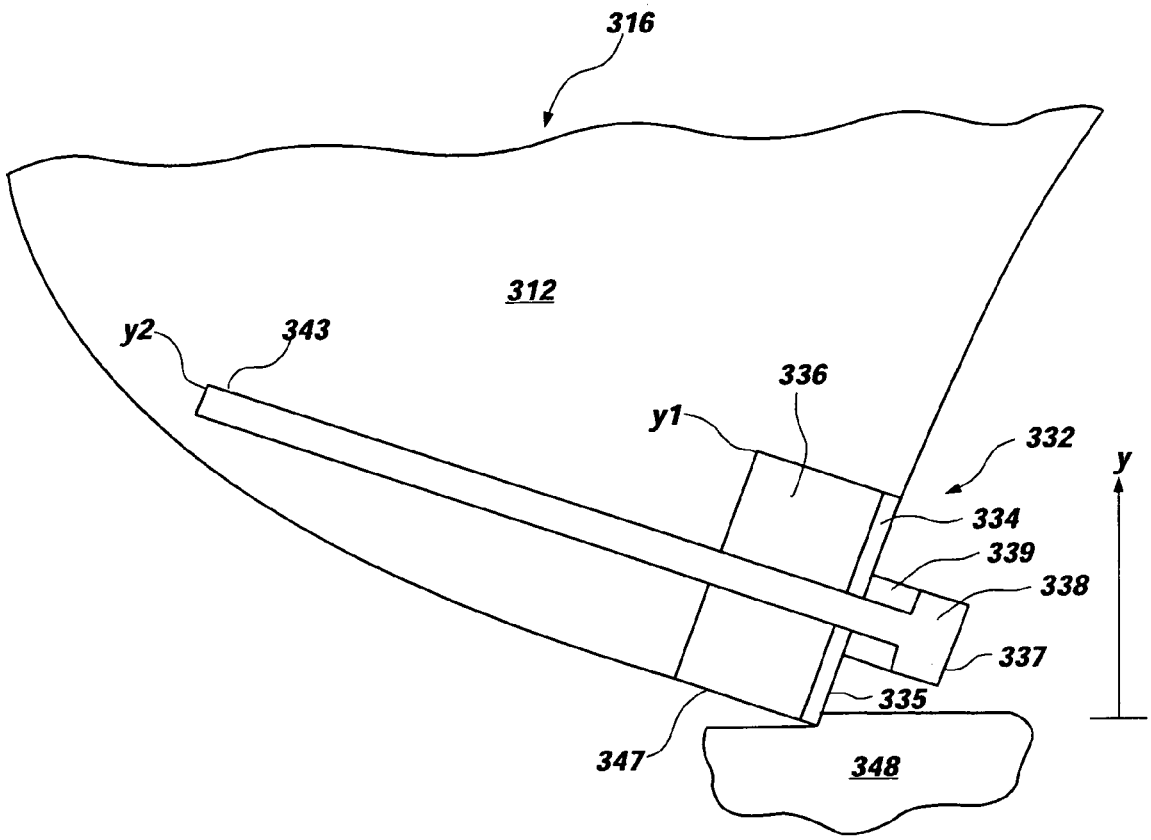
FIG. 22C shows an enlarged partial cross-sectional view of a cutting element affixed to a casing bit by way of a fastening element.

In yet another aspect of the present invention, referring to FIG. 10A, at least one of cutting elements 332 within region x1 may be affixed to the casing bit 312 by way of fastening elements that are locked, tightened, or affixed in place along the inner profile 316 of casing bit 312. For example, at least one cutting element 332 in region x1 may be affixed to casing bit 312 by a fastening element 338 (FIG. 22C) extending therethrough. As shown in FIG. 22C, an enlarged partial cross-sectional view of a cutting element 332 disposed in casing bit 312 is shown, oriented for drilling formation 348. As may be seen, cutting element 332 may comprise diamond table 334 bonded to substrate 336 and may be oriented so that the cutting surface 335 thereof is disposed at a back rake angle, as known in the art. Fastening element 338 extends through cutting element 332 so as to affix the cutting element 332 to casing bit 312. Washer 339 may be disposed between the head portion 337 of fastening element 338 and the cutting surface 335 of cutting element 332 so as to prevent damage to the diamond table 334 by the forces of affixing, tightening, or locking fastening element 338 into place. Fastening element 338 includes end region 343 which is configured for affixing the fastening element 338 to the casing bit 312. For instance, the end region 343 of fastening element 338 may be threaded, welded, pinned, deformed, or otherwise configured to affix the fastening element 338 to the casing bit 312. For instance, an internally threaded member (not shown), such as a nut, may be disposed onto the end region 343 of the fastening element 338.

During drilling, the cutting element 332 may proceed into a formation 348 to remove cuttings therefrom. As may be appreciated, head portion 337 of fastening element 338 may be sized to allow the cutting surface 335 to engage the formation at a desired depth-of-cut without contacting the formation 348 itself. However, the head portion 337 may be configured to contact the formation 348 in response to wear exhibited by the cutting element 332, in response to a depth-of-cut that causes such contact, or by design. After drilling, a drilling tool (not shown) may be disposed to drill into the inner profile 316 of casing bit 312. The drilling tool (not shown) may proceed generally oppositely to the direction of axis y. Axis y is shown on FIG. 22C as being generally vertical in orientation and extending away from an origin that is located at the lowermost point of the cutting surface 335. Therefore, it may be advantageous to configure fastening element 338 with a length sufficient to position end region 343 to a position y2 that exceeds the uppermost position y1 exhibited by the substrate 336 of cutting element 332. Such a configuration may allow for a drilling tool to remove the end region 343 of fastening element 338 while reducing or preventing contact between the drilling tool (not shown) and the substrate 336, which, in turn, may reduce or prevent damage to the drilling tool. Of course, the length and configuration of fastening element 338 may be selected and configured in relation to the back rake angle of the cutting element 332 as well as the geometry of the inner profile 316 of casing bit 312. Further, alternatively, the present invention contemplates that the fastening element 338 may be oriented in other configurations, such as, for instance, fastening element 338 may extend into the side surface 347 of cutting element 332 through the substrate 336 and into casing bit 312.

Figure 22D:
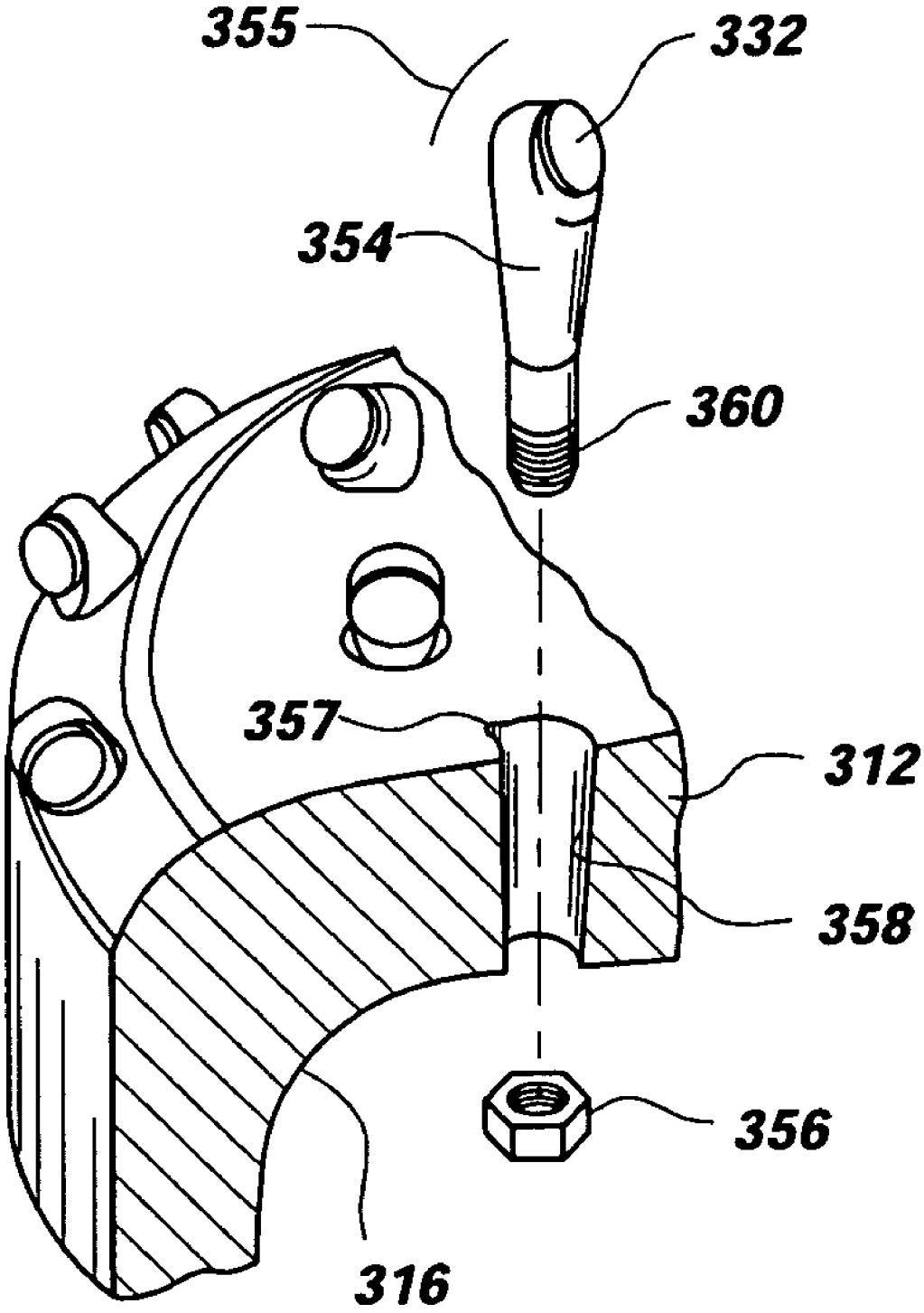
FIG. 22D shows a partial, sectioned, exploded view of a cutting element having a threaded stud-type body for affixation to a casing bit.

In another embodiment wherein a cutting element may be configured to become separated from a casing bit 312, a cutting element 332 may be configured with "stud-type" body 354 as shown in FIG. 22D and disclosed, in relation to drill bits, in U.S. Pat. No. 4,782,903 to Strange, the disclosure of which is incorporated in its entirety by reference herein. FIG. 22D shows cutting element 332 disposed on upper portion 355 of stud-type body 354, wherein stud-type body 354 includes lower portion 360, which is depicted as being threaded. Stud-type body 354 may be disposed within recess 358 having orientation notch 357, as known in the art, formed in casing bit 312 so that lower portion 360 extends therein. As shown in FIG. 22D, internally threaded element 356 may be disposed onto lower portion 360 and may abut inner profile 316 so as to affix stud-type body 354 within recess 358 and to casing bit 312. Lower portion 360 may preferably comprise steel, aluminum, or brass so that a drilling tool may drill relatively easily through the threaded lower portion 360. On the other hand, upper portion 355 of stud-type body 354 may preferably comprise cemented tungsten carbide for stiffness in supporting cutting element 332. Alternatively, the entire stud-type body 354 may comprise a single material, which may be any of steel, aluminum, brass, and tungsten carbide. Accordingly, after drilling, a drilling tool (not shown) may be disposed to drill into the inner profile 316 of casing bit 312, removing internally threaded element 356. Such a configuration may allow for the stud-type body 354 to be removed from recess 358 without drilling through the cutting element 332, upper portion 355 of stud-type body 354, or both, which, in turn, may reduce or prevent damage to the drilling tool. Although stud-type body 354 is shown as being threaded, other affixation structures may be used. For instance, the lower portion 360 of stud-type body 354 may be pinned, welded, brazed, or otherwise affixed to the casing bit 312. Affixing a portion of stud-type body 354 to casing bit 312 proximate to the lower portion 360 of stud-type body 354 may be advantageous in allowing a drilling tool to drill therethrough and thus release or separate the stud-type body 354 from the casing bit 312 prior to drilling tool drilling through the upper end thereof.

As yet another alternative, at least one of the cutting elements 332 generally within region x1 may be affixed to the casing bit 312 by way of a braze material that may be weakened by increasing the temperature thereof. Explaining further, the strength of the braze material, in comparison to its strength at the temperatures normally experienced during drilling, may be substantially reduced, after drilling to a desired depth, to a level wherein at least one cutting element 332 may be separated from the casing bit 312. The temperature of the braze material and associated cutting element 332 may be increased by reducing or ending drilling fluid flow while rotating and contacting the formation therewith. Preferably, but not necessarily, the melting temperature of the braze material may be less than the melting temperature of the casing section to which a casing bit of the present invention is affixed, to prevent damage thereto. For example, a braze material conforming to specification AWS Bag-24 may be used, which may have a liquidus temperature of about 1305° Fahrenheit, although it may not be necessary to actually reach the liquidus temperature, but only to substantially reduce the strength of the braze material sufficiently to separate the cutting element 332 from the casing bit 312. During drilling, as cutting elements 332 may be affixed to cutting pockets (not shown) formed within the body of casing bit 312. Upon completion of drilling with casing bit 312, the cutting elements 332 within region x1 of casing bit 312 may be removed therefrom by drilling with a reduced amount of drilling fluid flow or without drilling fluid flow so as to increase the temperature, heating the braze material sufficiently to reduce the strength thereof, and cause the cutting element 332 to disengage or become separated from the casing bit 312. Alternatively, an incendiary device or other heat generating device may be ignited to cause the temperature of the casing bit 312, cutting elements 332, and braze material to be increased. Separating one or more cutting elements 332 from the casing bit 312 may facilitate drilling therethrough, or may facilitate removing the cutting elements 332 from the borehole by drilling fluid propelling the separated cutting elements 332 upwardly within the borehole.

In yet another aspect of the present invention, at least two casing bits of different diameter and having associated casing sections may be assembled to form a drilling assembly for drilling into subterranean formations, wherein radially adjacent casing sections are selectively releasably affixed to one another and wherein the at least two casing bits and casing sections are arranged in a telescoping relationship. Such a configuration may reduce the time needed to dispose the casing sections that are attached to each larger and smaller casing bit into the borehole.

Figure 23A:
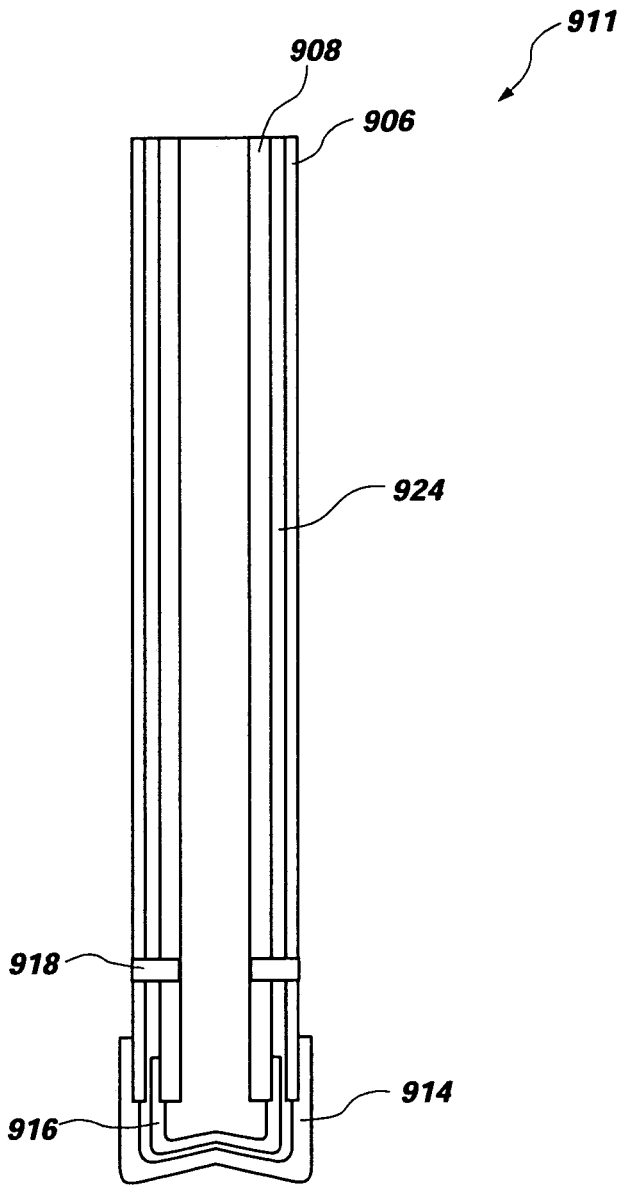
FIG. 23A shows a schematic cross-sectional view of a drilling assembly including three casing bits arranged in a nested telescoping relationship.
Figure 23B:
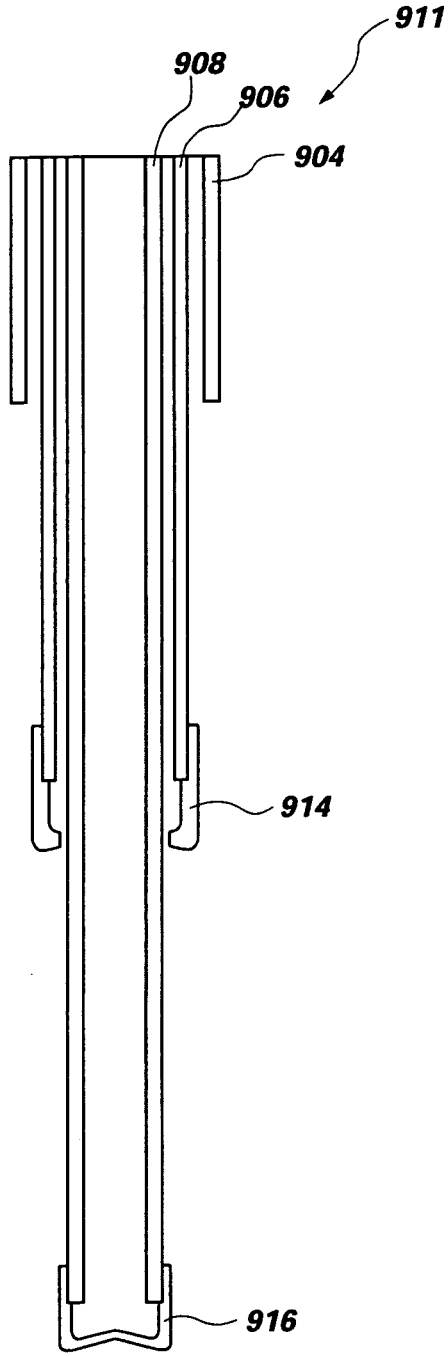
FIG. 23B shows a schematic cross-sectional view of the drilling assembly shown in FIG. 23A in an extended telescoping relationship.

For example, as shown in FIGS. 23A and 23B, drilling assembly 911 may include a first casing bit 916 and a second casing bit 914, wherein the first casing bit 916 is disposed within the second casing bit 914. First casing bit 916 may be affixed to casing section 908 and second casing bit 914 may be affixed to casing section 906. Thus, the casing sections 906 and 908 may be configured in a telescoping relationship, i.e., capable of being extended from or within one another. As shown in FIG. 23A, casing section 908 is affixed to casing section 906 by way of frangible elements 918. Frangible elements 918 may be configured to transmit torque, axial force or weight-on-bit (WOB), or both, between casing sections 906 and 908. Of course, other structures for transmitting forces between the casing sections 906 and 908 may be utilized.

Therefore, during operation, torque and WOB may be applied to casing bit 914 through casing section 906. Alternatively, torque and WOB may be applied to casing bit 914 by way of casing section 908 and through frangible elements 918. As may be appreciated, when the casing bits 914 and 916 are structurally coupled to one another, torque, WOB, or both, may be transmitted therebetween. In addition, the fluid ports or apertures between each of the casing bits 914 and 916 may be coupled so that drilling fluid may be delivered through the interior of casing bit 916 to casing bit 914. Alternatively, drilling fluid may be delivered through annulus 924, while the ports or apertures of casing bit 916 may be plugged or blocked. Thus, many alternatives are possible for delivering drilling fluid to any of casing bits 914 and 916.

As shown in FIG. 23B, a casing section 904 may be disposed at a first depth. Then, casing bit 914 may be caused to drill past casing bit 916 and continue drilling to a second depth. Upon reaching a second depth, torque, WOB, or both, may be applied to cause frangible elements 918 to fail or fracture. Alternatively, a frangible element may be caused to fail by way of selectively detonating a pyrotechnic agent, an explosive agent, or both. Thus, casing bit 916 may be employed to drill through casing bit 914 and to a third depth. Put another way, FIG. 23B shows drilling assembly 911 in an extended telescoping relationship. Of course, the present invention is not limited to any particular number of casing bits configured in a telescoping relationship. Rather, a drilling assembly of the present invention may include one or more casing bits disposed at least partially within one or more other casing bits in a telescoping relationship. It should also be understood that the present invention is not limited to a smaller casing bit or casing section being positioned at least partially within another casing bit to be configured in a telescoping relationship. Rather, more specifically, a casing bit or casing section may be disposed within another casing section, which may be affixed to another, larger casing bit, to be configured in a telescoping relationship.

Figure 23C:
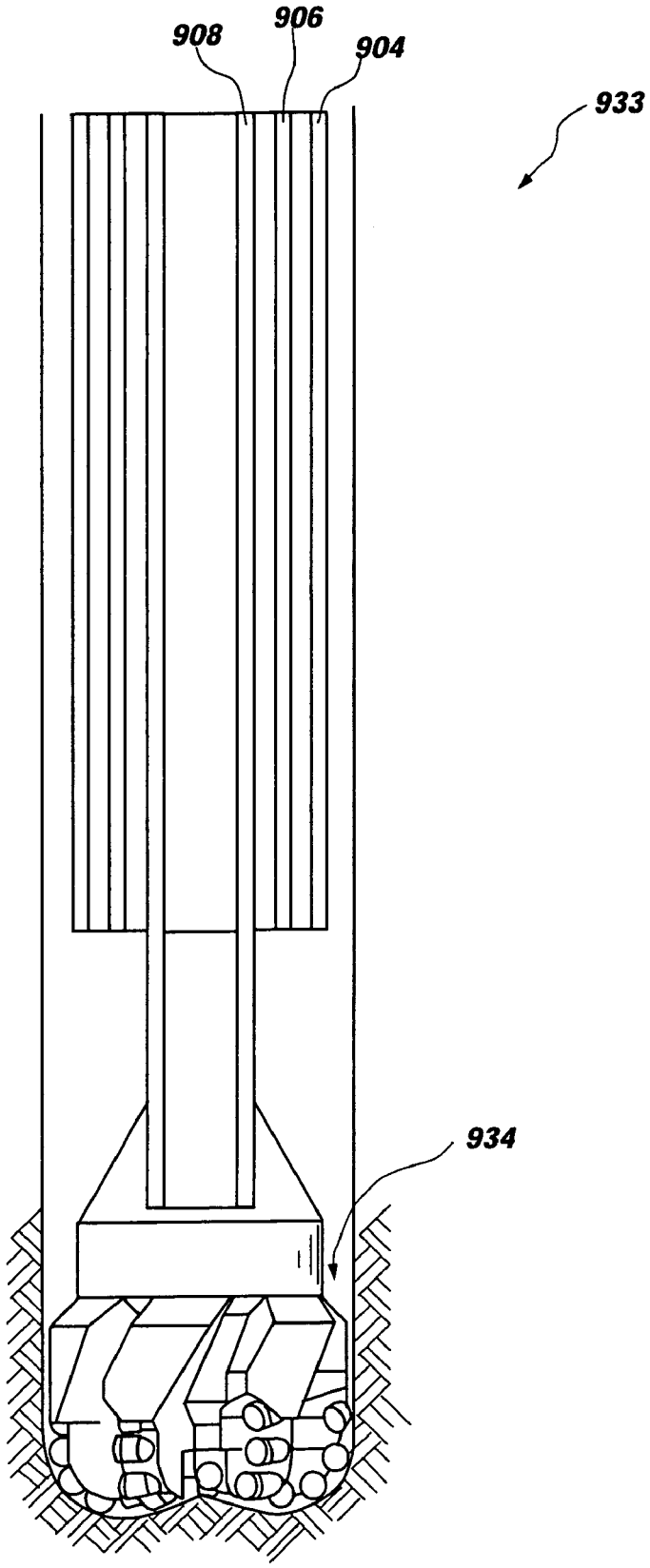
FIG. 23C shows a schematic cross-sectional view of a drilling assembly according to the present invention including three casing sections and a rotary drill bit.

Alternatively, an assembly of two of more casing sections configured in a telescoping relationship may be drilled into a subterranean formation by a drilling tool disposed at the leading end thereof. Specifically, as shown in FIG. 23C, illustrating a drilling assembly 933, casing sections 904, 906, and 908 may be coupled together by way of, for example, latching casing sections 904, 906, and 908 together to form an assembly that may be drilled into a formation by a conventional drilling tool 934 disposed at the leading end, in the direction of drilling, of the drilling assembly 933, the drilling tool 934 having a diameter that exceeds the diameter of the largest casing section 904. Drilling tool 934 may comprise a rotary drill bit, a reamer, a reaming assembly, or a casing bit, without limitation. The drilling tool 934 may precede into the formation by rotation and translation of the casing sections 904, 906, and 908. However, preferably, the drilling tool 934 may be structurally coupled to the innermost casing section 908, so that drilling tool 934 may continue to drill into the formation notwithstanding casing sections 904 or 906 becoming disposed within the borehole. Optionally, a downhole motor may be positioned between the innermost casing section 908 and the drilling tool 934.

As the drilling assembly proceeds into the formation, radially adjacent smaller casing sections may be unlatched from radially adjacent larger casing sections and extended therefrom. Of course, frangible elements (not shown) as described hereinabove (FIG. 23A) may structurally connect casing sections 904, 906, and 908 to one another. Forces may be applied to fail such frangible elements, or incendiary or explosive components may be employed for failing frangible elements. It is noted that a conventional drill bit 934 may not be suited to allow another drilling tool to drill therethrough. However, the telescoping relationship between the casing sections 904, 906, and 908 may provide advantage in reducing the tripping operations for disposing the casing sections 904, 906, and 908 within the borehole.

Figure 23D:
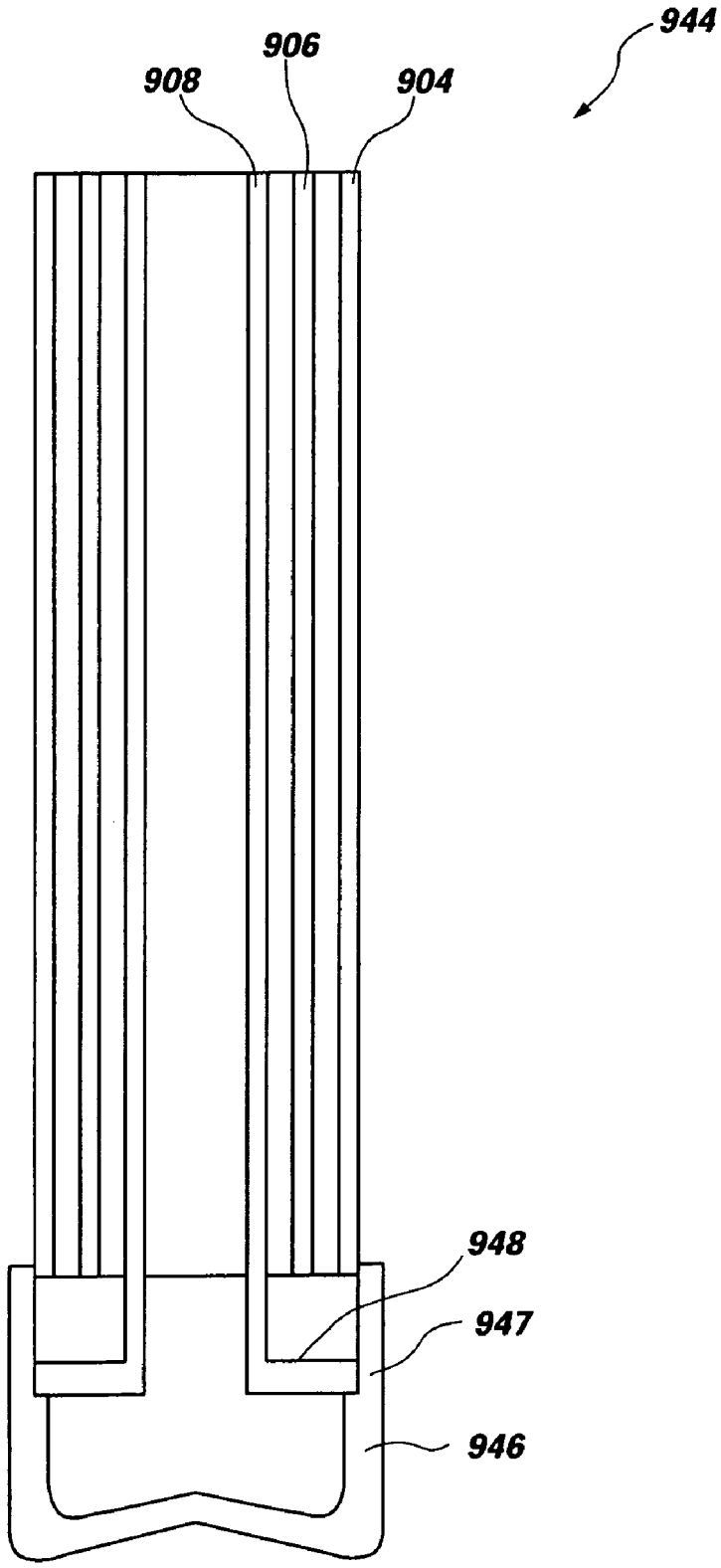
FIG. 23D shows a schematic cross-sectional view of a drilling assembly according to the present invention including a casing bit of the present invention and three casing sections.

Additionally, an assembly of two of more casing sections configured in a telescoping relationship may be drilled into a subterranean formation by a casing bit disposed at the leading end thereof. As shown in FIG. 23D, a drilling assembly 944 including casing sections 904, 906, and 908 may be drilled in to a formation by a casing bit 946 of the present invention. However, the casing bit 946 may be primarily coupled to the innermost casing section 908, as illustrated by radially extending flange 948 and attachment surface 947, so that casing bit 946 may continue to drill into the formation notwithstanding casing sections 904 or 906 becoming disposed within the borehole as well as being separated from casing section 908.

Figure 24:
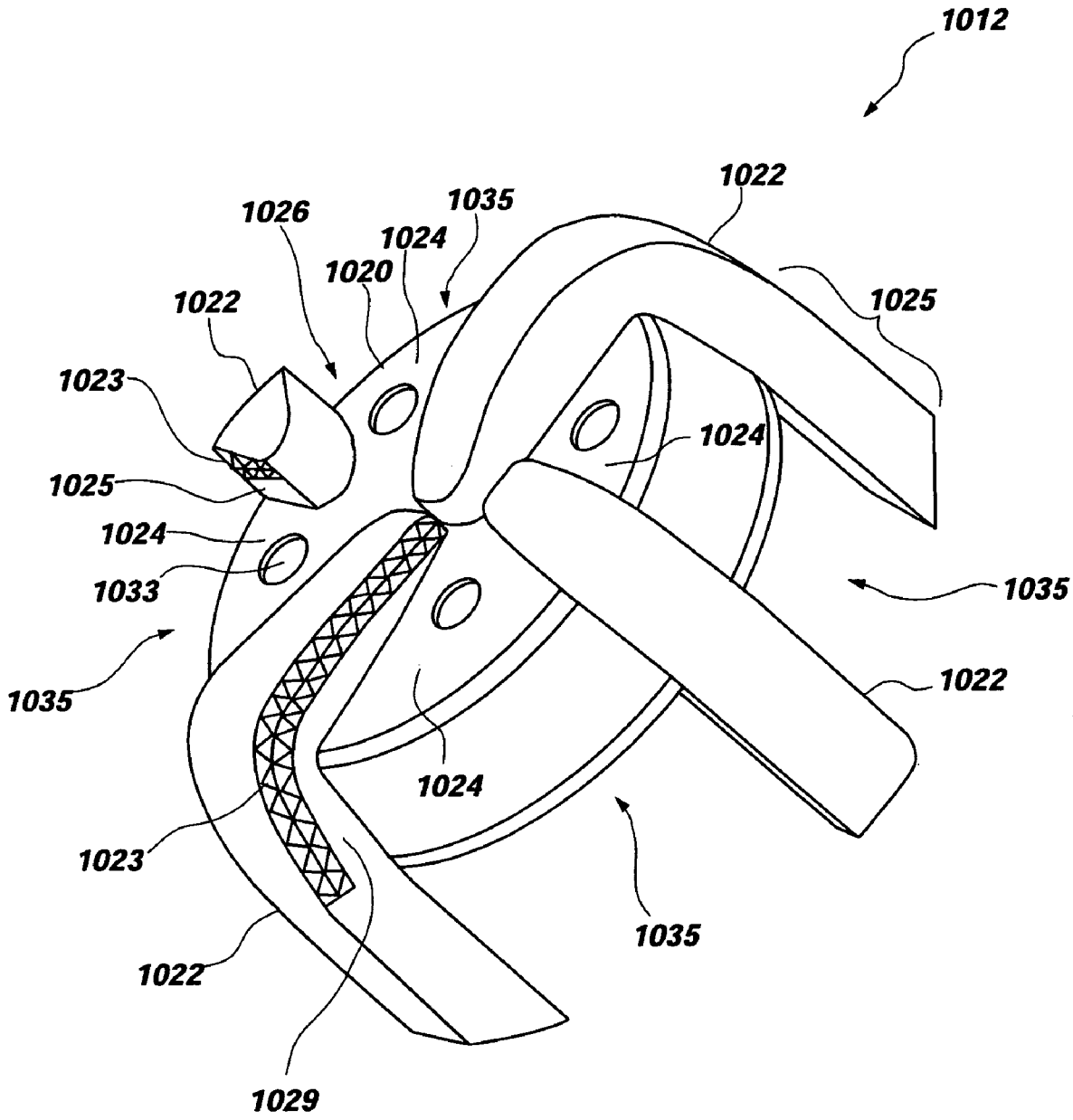
FIG. 24 shows a perspective view of a casing bit of the present invention wherein at least a portion of the leading face of a blade is formed from a superabrasive material.

FIG. 24 illustrates a casing bit 1012 according to the present invention wherein at least a portion of the leading face of a blade is formed from a superabrasive material. More particularly, casing bit 1012 includes a nose portion 1020, apertures 1033, and generally radially extending blades 1022 extending from face 1026 of casing bit 1012, the blades 1022 forming fluid courses 1024 therebetween extending to junk slots 1035 between circumferentially adjacent blades 1022.

At least one of blades 1022 may comprise superabrasive segments 1023, which may be infiltrated or brazed therein or thereon, respectively. Also, as shown in FIG. 24, the superabrasive segments 1023 may form at least a portion of a rotationally leading face 1029 of at least one of blades 1022. Thus, the superabrasive segments 1023 may remove the formation as the leading face 1029 engages the formation. Alternatively, discrete regions of at least one of blades 1022 may be configured with superabrasive segments 1023 to form cutting element regions. Superabrasive segments 1023 may be configured as thermally stable polycrystalline diamond ("TSP") wherein the metal catalyst that the diamond is sintered with is later removed, or wherein the catalyst with which the diamond is sintered does not aid in degradation of the sintered diamond structure, as known in the art. Alternatively, superabrasive segments 1023 may comprise PDC or other superabrasive material. Accordingly at least a portion of the leading face 1029 of at least one of blades 1022 may comprise TSP, PDC, or other superabrasive material. Of course, alternatively, one or more superabrasive segments 1023 may be affixed within pockets as described in relation to FIGS. 1A and 1B. Each of blades 1022 may include a gage region 1025 which is configured to define the outermost radius of the casing bit 1012 and, thus the radius of the wall surface of the borehole. Gage regions 1025 comprise longitudinally upward (as the casing bit 1012 is oriented during use) extensions of blades 1022, extending from nose portion 1020 and may have wear-resistant inserts or coatings, such as cutters, natural or synthetic diamond, or hardfacing material, on radially outer surfaces thereof as known in the art to inhibit excessive wear thereto.

In a further aspect of the present invention, at least one reaming blade or structure of a casing bit reamer, as described above, may be movable or expandable. U.S. application Ser. No. 10/624,952, assigned to the assignee of the present invention and filed Jul. 22, 2003, the disclosure of which is incorporated in its entirety by reference herein, discloses an expandable reamer apparatus for enlarging boreholes while drilling and methods of use that may be actuated by drilling fluid flowing therethrough. Further, U.S. Pat. No. 6,360,831 to Åkesson et al. discloses a conventional borehole opener comprising a body equipped with at least two hole-opening arms having cutting means that may be moved from a position of rest in the body to an active position by way of a face thereof that is directly subjected to the pressure of the drilling fluid flowing through the body.

Figure 25A:
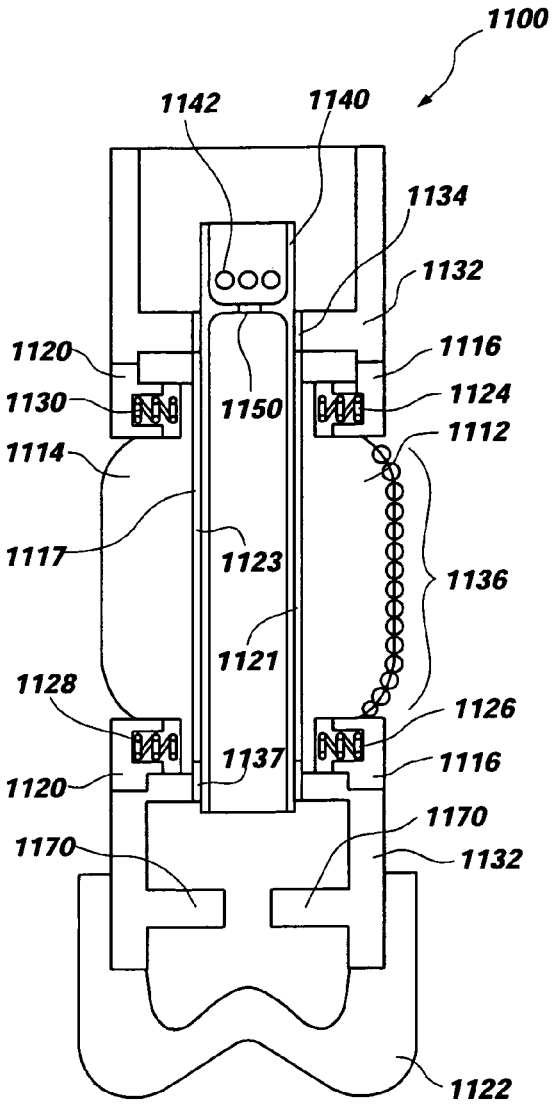
FIGS. 25A and 25B each show schematic side cross-sectional views an expandable casing bit reamer of the present invention in a contracted and expanded state, respectively.

Referring to FIG. 25A of the drawings, a schematic side cross-sectional view of an expandable casing bit reamer 1100 of the present invention is illustrated. Expandable casing bit reamer 1100 includes a casing section 1132 having movable blades 1112 and 1114 outwardly spaced from the centerline or longitudinal axis of the casing section 1132. Movable blades 1112 and 1114 may each carry a plurality of cutting elements 1136. As shown in FIG. 25A, drilling fluid may pass into casing section 1132 through orifice 1150 of sleeve 1140 and into casing bit 1122. However, initially, drilling fluid may be sealed from communication with the inner surfaces 1121 and 1123 of blades 1112 and 1114, respectively by way of sealing element 1134 positioned proximate the upper end of sleeve 1140 and sealing element 1137 positioned proximate the lower end of sleeve 1140, each of which are disposed between the sleeve 1140 and an extending feature of the casing section 1132. In addition, blades 1112 and 1114 may be inwardly biased or disposed by way of biasing elements 1124, 1126, 1128, and 1130 which are disposed within corresponding retention members 1116 and 1120.

Figure 25B:
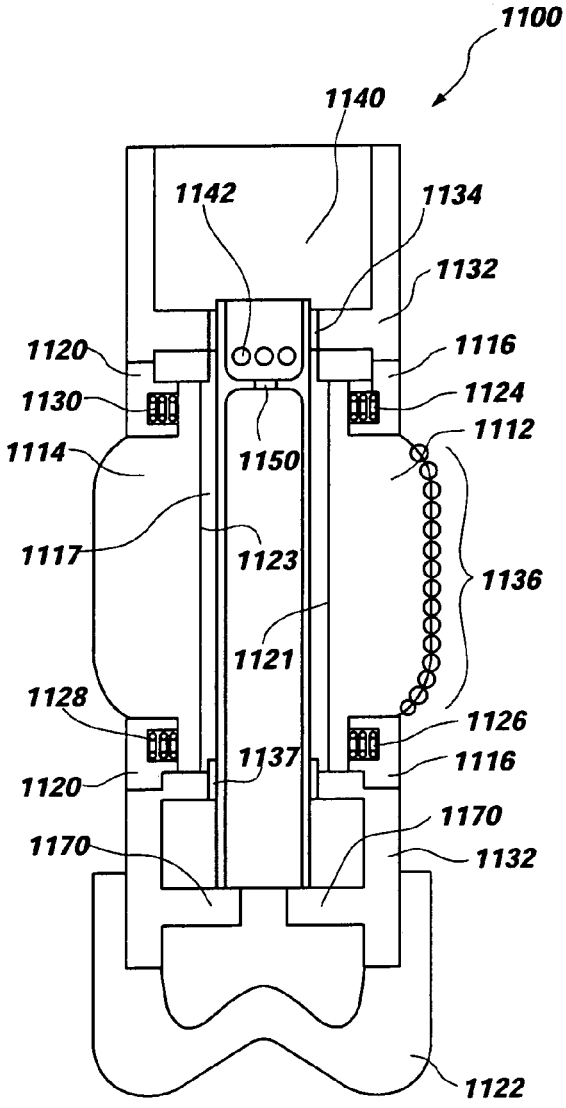

Expandable casing bit reamer 1100 is shown, in a schematic side cross-sectional view, in an expanded state in FIG. 25B wherein blades 1112 and 1114 are forced radially outwardly to their outermost radial position. As drilling fluid passes through sleeve 1140, a pressure differential caused by drilling fluid flow through orifice 1150 causes a downward longitudinal force to be applied to sleeve 1140. A collet, shear pins, or other frangible element (not shown) may be used to resist the downward longitudinal force until the shear point of the releasable member is exceeded. Thus, the downward force generated by the drilling fluid moving through the reduced cross-sectional area orifice 1150 may cause a friable or releasable element to release the sleeve 1140 and allow the sleeve 1140 to move downward and matingly engage flange 1170, as shown in FIG. 25B. In such a position, sleeve 1140 apertures or ports 1142 may allow drilling fluid flowing through expandable casing bit reamer assembly 1100 to pressurize the annulus 1117 between the sleeve 1140 and inner radial surface of blades 1112 and 1114, which may force blade 1112 against biasing elements 1124 and 1126, and may force blade 1114 against biasing elements 1128 and 1130. Blade 1112 may compress biasing elements 1124 and 1126 sufficiently to matingly engage the inner radial surface of retention member 1116, while blade 1114 may compress biasing elements 1128 and 1130 sufficiently to matingly engage the radial inner surface of retention member 1120. It may be preferable to apply adequate pressure to inner surfaces 1121 and 1123 of blades 1112 and 1114 so as to exceed any general opposite forces that may occur during reaming, so that the outer diameter of the reamed borehole will not be affected by a change in the position of either of blades 1112 or 1114. After performing a reaming operation, the drilling fluid pressure may be decreased, which may cause biasing elements 1124, 1126, 1128, and 1130 to exert a radial inward force in excess of the outward radial force generated by the pressure of the drilling fluid acting on the inner surfaces 1121 and 1123 of blades 1112 and 1114, which, in turn, may cause blades 1112 and 1114 to be moved radially inwardly. Further, optionally, a sleeve biasing element (not shown) may be used to return the sleeve to the position shown in FIG. 25A.

Figure 25C:
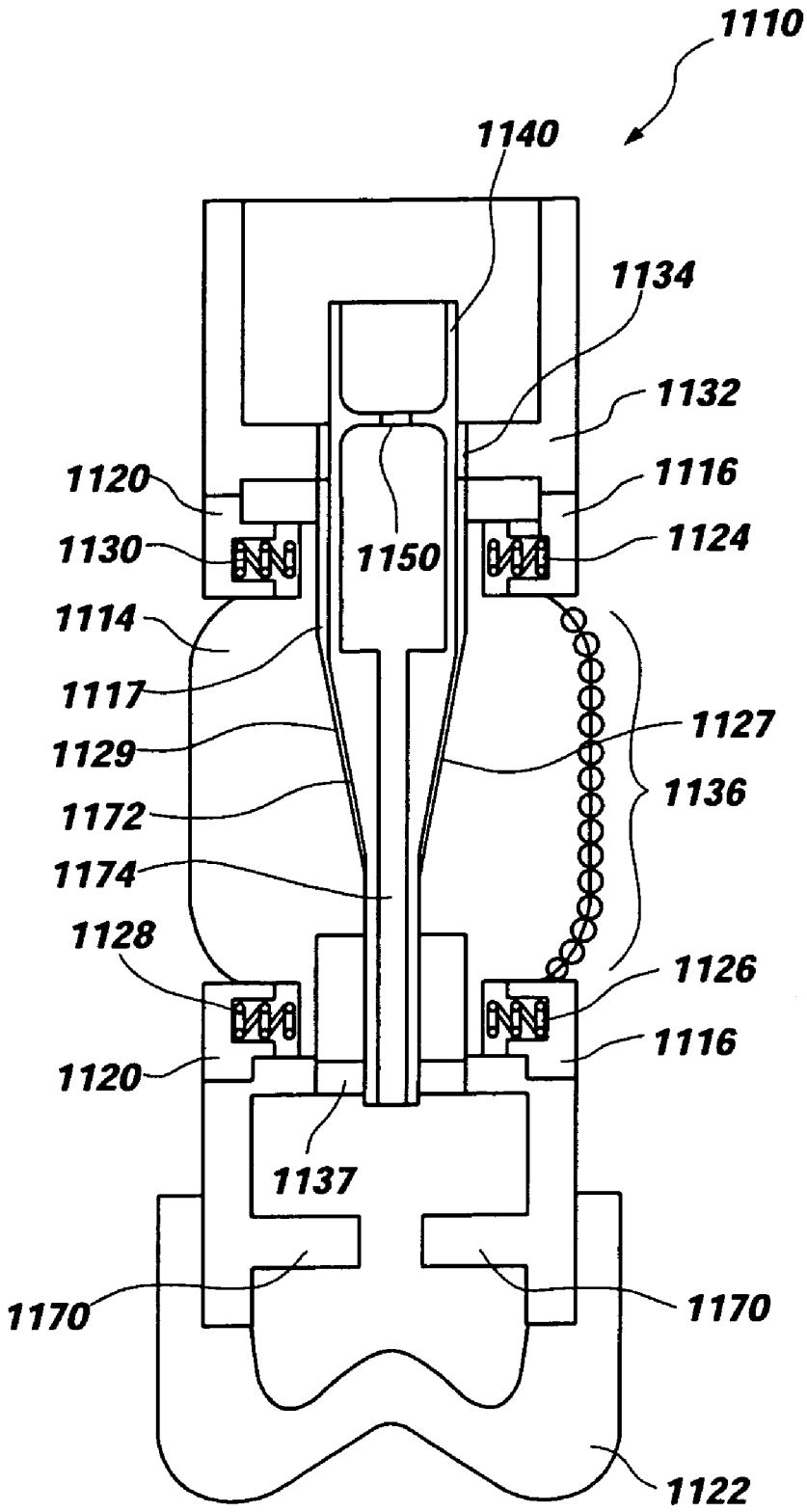
FIG. 25C shows a schematic side cross-sectional view of an expandable casing bit reamer including complementary tapered surfaces.

However, other mechanisms for expanding an expandable casing bit reamer, for instance, tapered surfaces, may be forced against one another to cause the expansion of movable blades. For instance, FIG. 25C shows a schematic side cross-sectional view of an expandable casing bit reamer 1110 including an actuation sleeve 1140 comprising tapered surface 1172 and bore 1174 extending therethrough. The operation of casing bit reamer 1110 is similar to the operation of casing bit reamer 1100 described above.

More specifically, as drilling fluid passes through sleeve 1140, a pressure differential caused by drilling fluid flow through sleeve 1140, specifically orifice 1150 may cause a downward longitudinal force to be applied to sleeve 1140. A collet, shear pins, or other frangible element (not shown) may be used to resist the downward longitudinal force until the shear point of the releasable member is exceeded. Thus, the downward force generated by the drilling fluid moving through the reduced cross-sectional area orifice 1150 may cause a friable or releasable element to release the sleeve 1140 and allow the sleeve 1140 to move downward to cause tapered surface 1172 of sleeve 1140 to matingly engage the tapered surfaces 1127 and 1129 of blades 1112 and 1114, respectively. Such mating engagement may force blade 1112 against biasing elements 1124 and 1126, and may force blade 1114 against biasing elements 1128 and 1130. Blade 1112 may compress biasing elements 1124 and 1126 sufficiently to matingly engage the inner radial surface of retention member

1116, while blade 1114 may compress biasing elements 1128 and 1130 sufficiently to matingly engage the radial inner surface of retention member 1120. Thus, expandable casing bit reamer 1110 may be expanded to ream a borehole. Alternatively, apertures or ports (such as 1142 shown in FIGS. 25A and 25B) may allow drilling fluid flowing through expandable casing bit reamer 1110 to pressurize the annulus 1117 between the sleeve 1140 and inner radial surface of blades 1112 and 1114, which may further aid in expanding same.

In a further aspect of the casing bit of the present invention, at least one sensor configured for measuring a condition of drilling, a condition of the casing bit, or a formation characteristic may be included by the present invention. Particularly, as to measurements concerning the casing bit, revolutions per minute, rate-of-penetration, torque-on-bit, weight-on-bit, strain measurements at one or more surface of the casing bit may be measured, and temperatures at one or more locations within or near the casing bit may be measured. As to the formation being drilled, formation hydrostatic pressure, pore pressure, temperature, azimuth, inclination, resistivity, gamma emissions, caliper, or other formation or borehole characteristics may be measured. Further, a casing bit of the present invention may include a sensor or a sensor may be positioned near the casing bit of the present invention. Further, a measurement obtained via a sensor may be stored, communicated to operators thereof, or both. Such a communication system may include fiber-optic transmission, electromagnetic telemetry, wired pipe, or as otherwise known in the art. U.S. Pat. Nos. 6,626,251, 6,571,886, 6,543,312, and 6,540,033, each assigned to the assignee of the present invention, the disclosure of each of which is incorporated in its entirety by reference herein, each disclose a method and apparatus for monitoring and recording of the operating condition of a conventional downhole drill bit during drilling operations.

In another exemplary embodiment of a casing bit according to the present invention, cutting elements may be arranged and disposed within discrete cutting element retention structures. Put another way, the casing bit of the present invention may include at least one discrete cutting element retention structure for affixing a cutting element within. Accordingly, the casing bit of the present invention may not include generally radially extending blades. Rather, the casing bit of the present invention may be configured to carry cutting elements by way of discrete cutting element retention structures extending from the nose portion thereof.

Figure 26A:
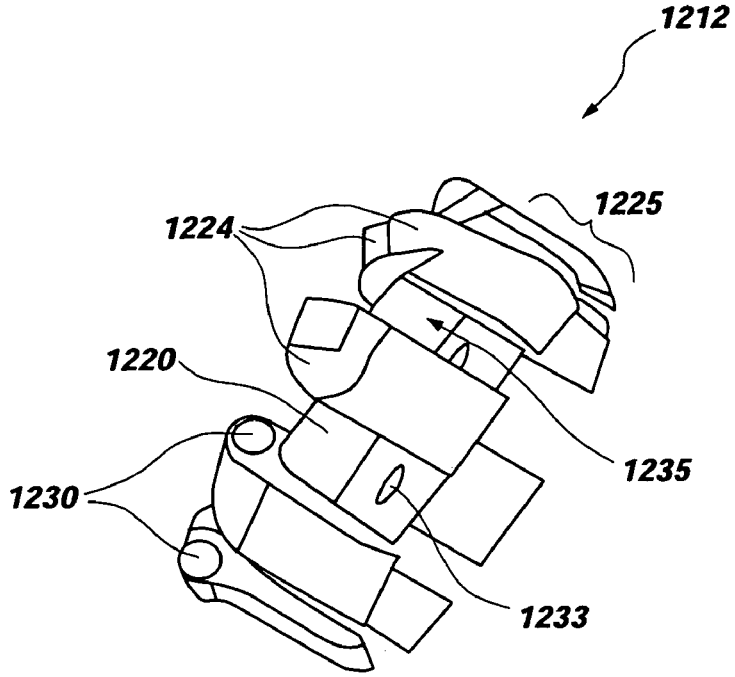
FIG. 26A shows a perspective view of a casing bit of the present invention wherein the cutting elements are supported by discrete cutting element retention structures.
Figure 26B:
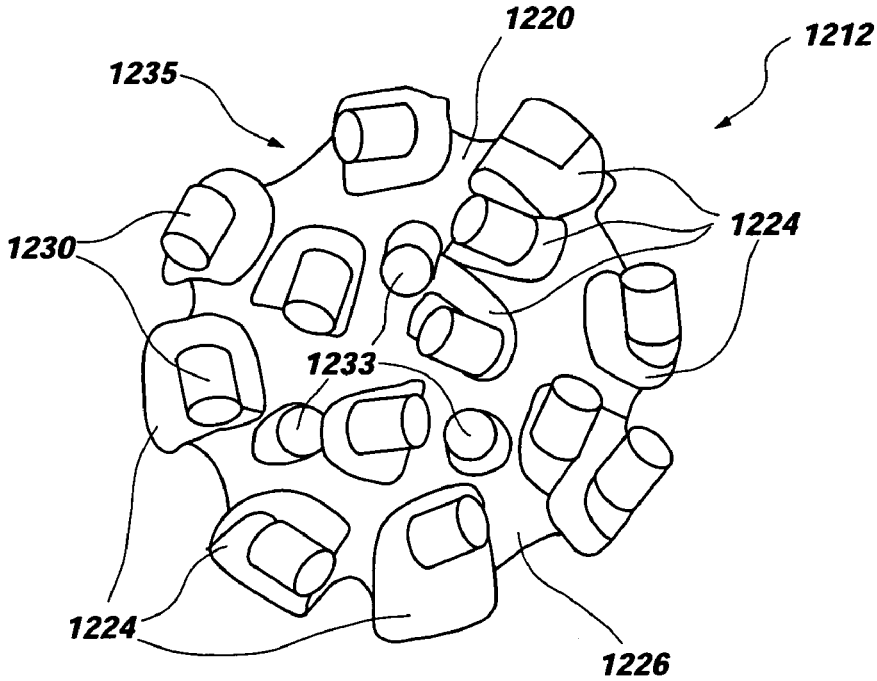
FIG. 26B shows a top elevation of the casing bit shown in FIG. 26A.

As shown in FIGS. 26A and 26B, casing bit 1212 may include discrete cutting element retention structures 1224 for carrying cutting elements 1230. Thus, cutting elements 1230 may be affixed within discrete cutting element retention structures 1224 of casing bit 1212 by way of brazing, welding, or as otherwise known in the art. Also, casing bit 1212 may include gage regions 1225 at circumferential positions thereabout, the gage regions 1225 configured to define the outermost radius of the casing bit 1212 and, thus the radius of the wall surface of the borehole. Gage regions 1225 comprise longitudinally upward (as the casing bit 1212 would be oriented during use) extensions from nose portion 1220, forming junk slots 1235 between circumferentially adjacent gage regions 1225 and may have wear-resistant inserts or coatings, such as cutters, natural or synthetic diamond, or hardfacing material, on radially outer surfaces thereof as known in the art to inhibit excessive wear thereto.

FIG. 26B shows casing bit 1212 from an upwardly looking perspective in relation to its face 1226, which generally refers to the surface of the nose portion 1220 shown in FIG. 26B, as if viewing the casing bit 1212 from the bottom of a borehole. During drilling, drilling fluid may be provided through apertures 1233 that extend between the interior of the casing bit 1212 and the face 1226 thereof. Formation cuttings may be swept away from cutting elements 1230 by drilling fluid emanating from apertures 1233, the fluid moving among discrete cutting element retention structures 1224 and then upwardly through junk slots 1235 to the surface of the formation being drilled.

In another embodiment of a casing bit of the present invention, a casing bit of the present invention may be configured for percussion, "percussion" meaning interrupted contact between the casing bit and the formation. Typically, percussion drilling may be accomplished by varying the longitudinal position of the casing bit as it is rotated. Thus, the casing bit may repeatedly oscillate between contacting and not contacting the formation.

Figure 27B:
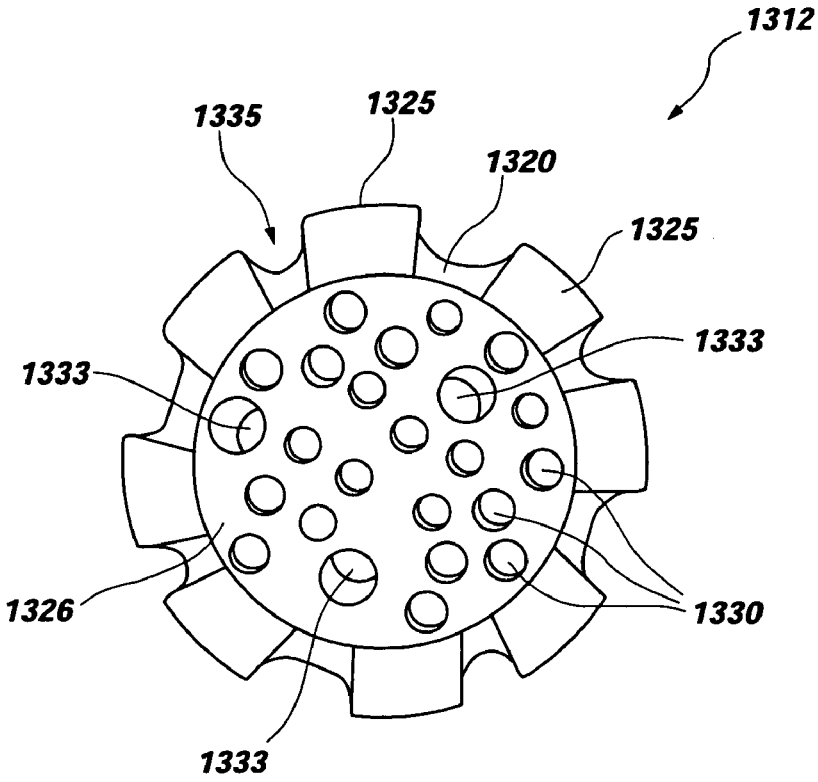
FIG. 27B shows a top elevation of the casing bit shown in FIG. 27A.
Figure 27A:
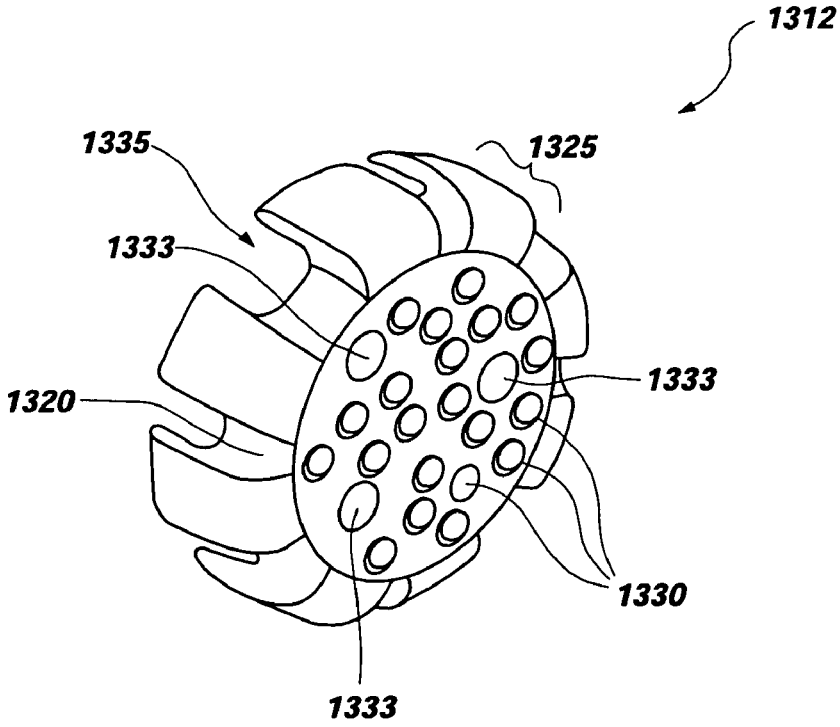
FIG. 27A shows a perspective view of a casing bit of the present invention configured for percussion drilling and including percussion inserts.

More specifically, as shown in FIGS. 27A and 27B, casing bit 1312 may include a plurality of percussion inserts 1330 for causing failure in the formation by contact therewith. In contrast to a shearing action that may be provided by the cutting surface of a PDC cutting element, percussion inserts 1330 may be configured to cause a level of tensile stress, compressive stress, or combination thereof within a formation, by way of contact therewith, sufficient to fail a portion of the formation. Percussion inserts may comprise, for instance, cemented tungsten carbide, diamond, or both and may be generally configured geometrically as a rolling cone insert, which may be generally rounded, chisel shaped, or moderately pointed, or as otherwise known in the art. Percussion inserts 1330 may be affixed within casing bit 1312 by way of brazing, welding, press-fitting, or as otherwise known in the art. Also, casing bit 1312 may include gage regions 1325 at circumferential positions thereabout, the gage regions 1325 configured to define the outermost radius of the casing bit and, thus the radius of the wall surface of the borehole. Gage regions 1325 comprise longitudinally upward (as the casing bit 1312 would be oriented during use) extensions from nose portion 1320, forming junk slots 1335 between circumferentially adjacent gage regions 1325 and may have wear-resistant inserts or coatings, such as cutters, natural or synthetic diamond, or hardfacing material, on radially outer surfaces thereof as known in the art to inhibit excessive wear thereto.

FIG. 27B shows casing bit 1312 from an upwardly looking perspective in relation to its face 1326, which generally refers to the surface of the nose portion 1320 shown in FIG. 27A, as if viewing the casing bit 1312 from the bottom of a borehole. During drilling, drilling fluid may be provided through apertures 1333 that extend between the interior of the casing bit 1312 and the face 1326 thereof. Formation cuttings may be swept away from percussion inserts 1330 by drilling fluid emanating from apertures 1333, the fluid moving among percussion inserts 1330 and then upwardly through junk slots 1335 to the surface of the formation that is drilled.

Figure 27C:
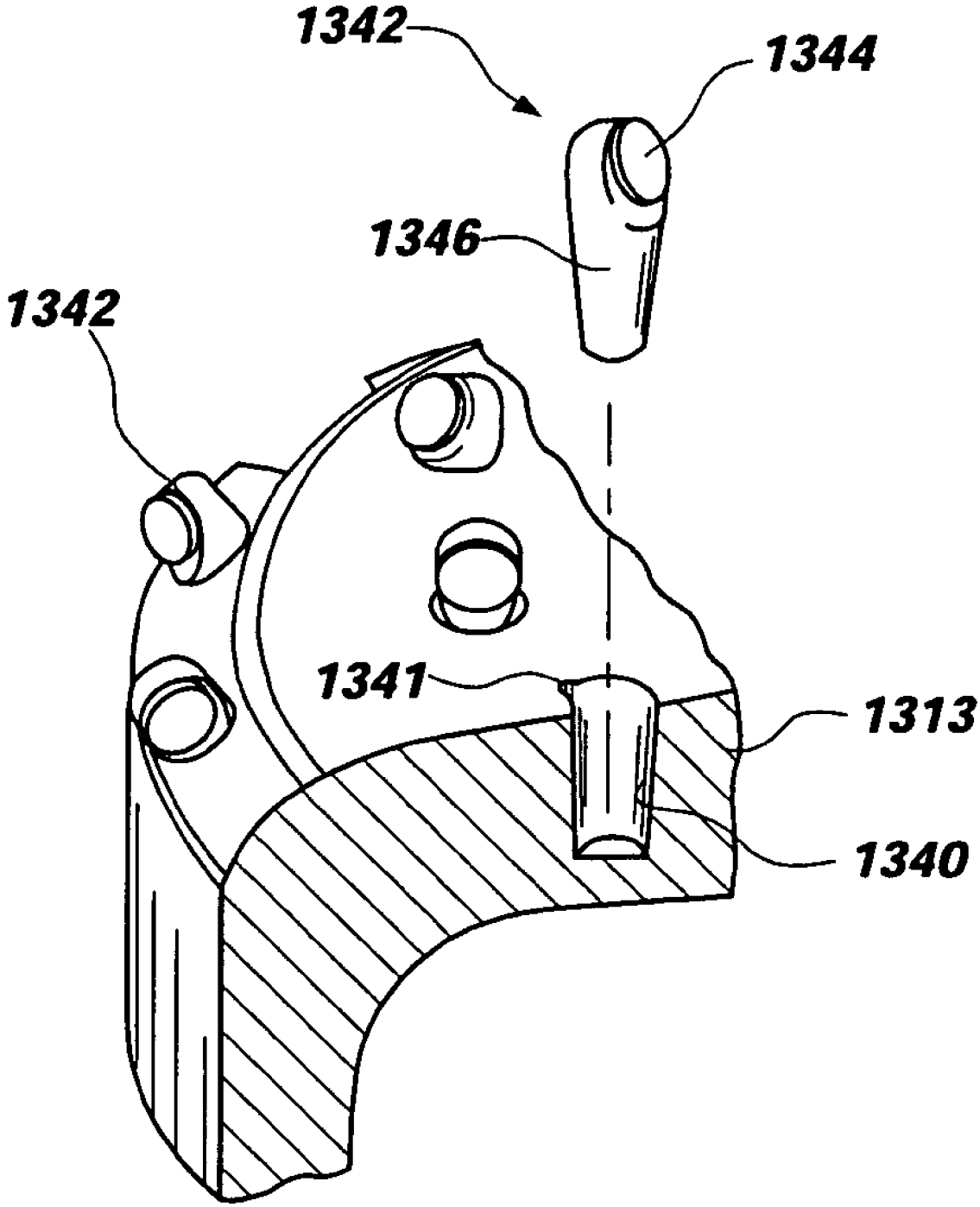
FIG. 27C shows a partial, sectioned, exploded view of a casing bit according to the present invention.

It should, however, be understood that the bit body design of casing bit 1312 is not limited to percussion inserts installed thereon. Put another way, the casing bit of the present invention may comprise a bit body that does not include blades, but rather has a substantially symmetrical profile, with respect to the longitudinal axis thereof, that forms the outer surface of the casing bit and cutting elements may be affixed thereto. For instance, polycrystalline diamond cutting elements may be installed upon a bit body design as shown in FIGS. 27A and 27B. More particularly, FIG. 27C shows a partial cross-sectioned casing bit 1313 including polycrystalline diamond stud-type cutting elements 1342. Stud-type cutting elements 1342 may include a body 1346 to which a superabrasive cutting structure 1344 is affixed. For instance, superabrasive cutting structure 1344 may comprise a polycrystalline diamond cutting element, thermally stable diamond bricks, or other superabrasive material. Such superabrasive material may be brazed or infiltrated to affix the superabrasive cutting structure 1344 to the body 1346.

Further, stud-type cutting elements 1342 may be sized and configured to fit within associated recesses 1340 formed in casing bit 1313. As known in the art, stud-type cutting elements 1342 may be press-fit, brazed, welded, or any combination thereof within associated recesses 1340 of casing bit 1313. Further, alignment groove 1341 may be used to orient each of stud-type cutting elements 1342 within associated recesses 1340, also as known in the art. Of course, alternatively, pockets, (not shown) as shown in FIG. 1A, may be formed into the surface of casing bit 1313 and cutting elements disposed therein, accordingly.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. A casing bit for drilling a casing section into a subterranean formation, comprising:

an inner profile, at least a portion of the inner profile having a geometry configured to substantially match a geometry of at least a portion of a drilling profile of a leading face of another drilling tool for subsequently drilling through a portion of the casing bit;

an outer profile;

a nose portion;

at least one aperture formed in the nose portion and configured for delivering drilling fluid from an interior of the casing bit to an exterior thereof;

a plurality of generally radially extending blades disposed on the nose portion, at least one of the plurality of blades carrying one or more cutting elements affixed thereto; and at least one gage section, the at least one gage section extending longitudinally from adjacent the nose portion.

2. The casing bit of claim 1, wherein the casing bit comprises steel.

3. The casing bit of claim 1, wherein at least a portion of the outer profile of the casing bit exhibits an inverted cone geometry.

4. The casing bit of claim 1, wherein at least one of the one or more cutting elements are selected from the group consisting of a polycrystalline diamond cutting element, a thermally stable diamond cutting element, a natural diamond cutting element, and a tungsten carbide cutting element.

5. The casing bit of claim 1, wherein:

the one or more cutting elements comprise a first plurality of cutting elements and a second plurality of cutting elements;

the first plurality of cutting elements is configured to initially engage and drill through a selected region; and the second plurality of cutting elements is configured to engage and drill through a region to be subsequently encountered by the casing bit, at least one cutting element of the second plurality of cutting elements comprising a polycrystalline diamond cutting element and positioned in rotational alignment with at least one cutting element of the first plurality of cutting elements comprising a tungsten carbide cutting element.

6. The casing bit of claim 5, wherein each of the first plurality of cutting elements comprise a tungsten carbide cutting element and each of the second plurality of cutting elements comprise a polycrystalline diamond cutting element.

7. The casing bit of claim 6, wherein the first plurality of cutting elements exhibits greater exposure than the second plurality of cutting elements.

8. The casing bit of claim 1, further comprising an integral stem section extending longitudinally from the nose portion.

9. The casing bit of claim 8, wherein the integral stem section comprises at least one of a frangible region, a float valve mechanism, a cementing stage tool, a float collar mechanism, or a landing collar structure.

10. The casing bit of claim 1, wherein at least a portion of the outer profile of the casing bit has a geometry substantially matching the geometry of the drilling profile of the leading face of the another drilling tool.

11. The casing bit of claim 1, wherein at least a portion of the casing bit is configured to fail in response to pressure acting on an interior surface thereof.

12. The casing bit of claim 11, wherein the at least a portion of the casing bit configured to fail is sized and configured to transmit cement therethrough.

13. The casing bit of claim 1, wherein the average distance between the inner profile and the outer profile of the casing bit is selected in relation to a maximum predicted stress, the maximum predicted stress predicted in relation to expected forces of operating the casing bit to drill the casing section into the subterranean formation.

14. The casing bit of claim 13, wherein the casing bit comprises a material having a yield stress that is at least one and one-half times the maximum predicted stress.

15. The casing bit of claim 1, wherein the one or more cutting elements comprise a plurality of cutting elements;

wherein a first portion of the plurality of cutting elements is disposed generally within at least a portion of the casing bit that is configured to be drilled through;

wherein a second portion of the plurality of cutting elements is disposed generally peripheral to the at least a portion of the casing bit that is configured to be drilled through; and wherein a majority of cutting elements of the first portion is configured differently than a majority of cutting elements of the second portion.

16. The casing bit of claim 15, wherein a size of the majority of the first portion of the plurality of cutting elements is smaller than a size of the majority of cutting elements of the second portion.

17. The casing bit of claim 15, wherein each of the plurality of cutting elements contains an amount of abrasive material; and wherein an average amount of the abrasive material contained by each of the plurality of cutting elements of the first portion is less than an average amount of the abrasive material contained by each of the plurality of cutting elements of the second portion.

18. The casing bit of claim 15, wherein a majority of the first portion of the plurality of cutting elements is substantially carbide-free.

19. The casing bit of claim 15, wherein each of the plurality of cutting elements comprises a polycrystalline diamond cutting element.

20. The casing bit of claim 15, wherein at least one of the plurality of cutting elements generally within the at least a portion of the casing bit that is configured to be drilled through comprises a first grade of cutting element relating to at least one inherent quality related to wear characteristics, and at least one of the plurality of cutting elements generally peripheral to the at least a portion of the casing bit that is configured to be drilled through comprises a second grade of cutting element relating to at least one inherent quality related to wear characteristics, wherein the at least one inherent quality of the second grade of cutting element is generally different than the at least one inherent quality of the first grade of cutting element.

21. The casing bit of claim 20, wherein the at least one inherent quality related to wear characteristics of the first grade of cutting element is generally inferior to the at least one inherent quality related to wear characteristics of the second grade of cutting element.

22. The casing bit of claim 15, wherein a majority of the first portion of the plurality of cutting elements comprises an abrasive selected from the group consisting of carbide, natural diamond, and synthetic diamond, wherein an amount of the abrasive on each cutting element of the majority of the first portion of the plurality of cutting elements is selectively tailored to substantially wear away in response to drilling through a selected formation region.

23. The casing bit of claim 1, further comprising one or more wear knots disposed on at least one of the plurality of blades.

24. The casing bit of claim 23, wherein the one or more wear knots are sized and configured to minimize at least one of torque fluctuations while drilling and rate-of-penetration fluctuations while drilling.

25. The casing bit of claim 1, wherein at least one cutting element of the one or more cutting elements exhibits a limited amount of cutter exposure perpendicular to a face of the blade to which the at least one cutting element is affixed, and wherein a total bearing area of the casing bit is configured to limit a maximum depth-of-cut of the at least one cutting element into the formation during drilling.

26. The casing bit of claim 1, wherein at least a portion of the casing bit comprises an abrasive dispersed within a metal binder.

27. The casing bit of claim 26, wherein the abrasive comprises at least one of carbide, natural diamond, and synthetic diamond.

28. The casing bit of claim 1, further comprising a coating disposed on at least a portion of the exterior of the casing bit.

29. The casing bit of claim 28, wherein the coating is formulated to inhibit adhesion between formation cuttings and the casing bit.

30. The casing bit of claim 29, wherein the coating comprises a polymer.

31. The casing bit of claim 28, wherein the coating is formulated to inhibit at least one of erosion, abrasion, and wear to the casing bit.

32. The casing bit of claim 31, wherein the coating comprises diamond.

33. The casing bit of claim 1, wherein each of the plurality of blades extends generally radially outwardly in a generally spiral fashion from a central axis of the casing hit to the radial outer extent thereof.

34. The casing bit of claim 1, wherein each of the at least one gage sections of each blade extend longitudinally from the nose portion in a generally helical fashion.

35. The casing bit of claim 1, further comprising at least one rotationally trailing groove formed in at least one of the plurality of blades rotationally directly behind at least one cutting element affixed thereto.

36. The casing bit of claim 35, wherein the at least one rotationally trailing groove follows at least one of a tangential path and a circumferential path relative to a direction of rotation of the casing bit.

37. The casing bit of claim 35, wherein the at least one rotationally trailing groove exhibits at least one of a substantially constant width along a direction of rotation of the casing bit and a tapered geometry in which the width of the at least one rotationally trailing groove increases along a direction of rotation of the casing bit.

38. The casing bit of claim 1, wherein the at least one aperture comprises a retention structure.

39. The casing bit of claim 38, further comprising at least one of a nozzle and a sleeve disposed within and affixed to the retention structure.

40. The casing bit of claim 39, wherein at least a portion of the at least one of a nozzle and a sleeve is configured to be removed in relation to an expected amount of erosion.

41. The casing bit of claim 39, wherein the at least one of a nozzle and a sleeve is affixed to the retention structure via at least one of welding, brazing, and engagement of threaded surfaces.

42. The casing bit of claim 39, wherein the at least one of the nozzle and the sleeve comprise one or more of tungsten carbide, ceramic, steel, aluminum, bronze, and brass.

43. The casing bit of claim 39, wherein the at least one of a nozzle and a sleeve is replaceable.

44. The casing bit of claim 1, further comprising at least one rolling cone affixed to the nose portion.

45. The casing bit of claim 1, wherein the one or more cutting elements comprise a plurality of cutting elements;

wherein a first portion of the plurality of cutting elements is disposed generally within the at least a portion of the casing bit that is configured to be drilled through;

wherein a second portion of the plurality of cutting elements is disposed generally peripheral to the at least a portion of the casing bit that is configured to be drilled through; and wherein at least a majority of the first portion of the plurality of cutting elements is affixed to the at least one blade of the casing bit differently than at least a majority of the second portion of plurality of the cutting elements.

46. The casing bit of claim 45, wherein the at least a majority of the first portion of the plurality of cutting elements is affixed to the at least one blade of the casing bit by an adhesive.

47. The casing bit of claim 45, wherein the at least a majority of the first portion of the plurality of cutting elements is affixed to the at least one blade of the casing bit by a solder.

48. The casing bit of claim 1, wherein the one or more cutting elements is affixed to the at least one of the plurality of blades of the casing bit by an adhesive.

49. The casing bit of claim 1, wherein the one or more cutting elements is affixed to the at least one of the plurality of blades of the casing bit by a solder.

50. The casing bit of claim 45, wherein the at least a majority of the first portion of the plurality of cutting elements is affixed to the at least one of the plurality of blades of the casing bit by electrically disbonding material.

51. The casing bit of claim 50, further comprising:

a conductor extending to and in electrical communication with each of the at least a majority of the first portion of the plurality of cutting elements affixed to the at least one of the plurality of blades of the casing bit by electrically disbonding material; and wherein each conductor is electrically insulated from the casing bit.

52. The casing bit of claim 1, wherein the one or more cutting elements is affixed to the at least one of the plurality of blades of the casing bit by electrically disbonding material.

53. The casing bit of claim 52, further comprising:

a conductor extending to and in electrical communication with the one or more cutting elements affixed to the at least one of the plurality of blades of the casing bit by the electrically disbonding material;

wherein the conductor is electrically insulated from the casing bit.

54. The casing bit of claim 45, wherein the at least a majority of the first portion of the plurality of cutting elements is affixed to the at least one of the plurality of blades of the casing bit by a fastening element extending therethrough.

55. The casing bit of claim 1, wherein the one or more cutting elements is affixed to the at least one of the plurality of blades of the casing bit by a fastening element extending therethrough.

56. The casing bit of claim 45, wherein each of the at least a majority of the first portion of the plurality of cutting elements comprises an elongated body having an upper end comprising a cutting element and a lower end configured to extend through a recess formed in the at least one of the plurality of blades of the casing bit, the elongated body being affixed to the at least one of the plurality of blades of the casing bit by way of the lower end thereof.

57. The casing bit of claim 56, wherein the lower ends of the elongated bodies of the at least a majority of the first portion of cutting elements are affixed to the at least one of the plurality of blades of the casing bit by at least one of a threaded element, a weld, a braze joint, and a pin.

58. The casing bit of claim 1, wherein the one or more cutting elements comprises an elongated body having an upper end comprising a cutting element and a lower end configured to extend through a recess formed in the at least one of the plurality of blades of the casing bit, the elongated body of the one or more cutting elements being affixed to the at least one of the plurality of blades of the casing bit by way of the lower end thereof.

59. The casing bit of claim 58, wherein the lower end of the elongated body of the one or more cutting elements is affixed to the at least one of the plurality of blades of the casing bit by at least one of a threaded element, a weld, a braze joint, and a pin.

60. The casing bit of claim 45, wherein the at least a majority of the first portion of the plurality of cutting elements is affixed to the at least one of the plurality of blades of the casing bit by a braze material exhibiting a liquidus temperature of, at most, about 1305° Fahrenheit.

61. The casing bit of claim 1, wherein the one or more cutting elements is affixed to the at least one of the plurality of blades of the casing bit by a braze material exhibiting a liquidus temperature of, at most, about 1305° Fahrenheit.

62. The casing bit of claim 1, further comprising at least one groove that is sized and configured to preferentially facilitate separation of at least a portion of the casing bit into sections as the at least a portion of the casing bit is drilled through by the another drilling tool.

63. The casing bit of claim 62, wherein the at least one groove comprises a plurality of grooves sized and configured to preferentially facilitate separation of at least a portion of the casing bit into sections as the at least a portion of the casing bit is drilled through by the another drilling tool.

64. The casing bit of claim 1, wherein the nose portion comprises one or more fibers disposed within a matrix material.

65. The casing bit of claim 64, wherein the one or more fibers is circumferentially oriented.

66. The casing bit of claim 64, wherein the one or more fibers is oriented concentrically or spirally.

67. The casing bit of claim 1, further comprising at least one sensor for measuring a condition of drilling, a condition of the casing bit, or a formation characteristic.

68. The casing bit of claim 1, wherein the casing bit comprises an outer shell and at least one inner core, the outer shell extending over substantially the entire nose portion.

69. The casing bit of claim 68, wherein the outer shell comprises at least one of steel, iron alloys, tungsten carbide powder infiltrated with a copper based binder, and nickel alloys and the at least one inner core comprises at least one of aluminum, brass, bronze, or phenolic.

70. The casing bit of claim 68, wherein the outer shell and the at least one inner core are affixed to one another by at least one of fasteners, welding, and brazing.

71. The casing bit of claim 1, wherein at least a portion of a leading face of a blade of the plurality of blades of the casing bit is formed from a superabrasive material.

72. The casing bit of claim 1, further comprising:

at least one of an incendiary agent, an explosive agent, and a reactive chemical;

wherein the at least one of an incendiary agent, an explosive agent, and a reactive chemical is configured to render the casing bit more drillable.

73. The casing bit of claim 1, further comprising an integral stem section including at least one of a float valve mechanism, a frangible region, a cementing stage tool, a float collar mechanism, and a landing collar structure.

74. A casing bit for drilling a casing section into a subterranean formation, comprising:

an inner profile, at least a portion of the inner profile having a geometry configured to substantially match a geometry of at least a portion of a drilling profile of a leading face of another drilling tool for subsequently drilling through a portion of the casing bit;

an outer profile;

a nose portion;

at least one aperture formed in the nose portion and configured for delivering drilling fluid from an interior of the casing bit to an exterior thereof;

a plurality of discrete cutting element retention structures extending from the nose portion, each discrete cutting element retention structure being configured to carry a sole cutting element; and at least one gage section, the at least one gage section extending longitudinally from adjacent the nose portion.

75. A casing bit for drilling a casing section into a subterranean formation, comprising:

an inner profile;

an outer profile;

a nose portion;

at least one thread for securing the casing bit to a separate casing section of a casing string;

at least one aperture formed in the nose portion and configured for delivering drilling fluid from an interior of the casing bit to an exterior thereof;

a plurality of cutting elements affixed to the nose portion, the plurality of cutting elements configured for causing failure in the formation by contact therewith; and at least one gage section configured to define an outermost radius of the casing bit, the at least one gage section extending longitudinally from adjacent the nose portion, the at least one gage section configured to extend longitudinally adjacent at least a portion of the separate casing section of the casing string when the separate casing section is secured to the casing bit.

76. The casing bit of claim 75, further comprising an integral stem section extending longitudinally from the nose portion.

77. The casing bit of claim 76, wherein the integral stem section comprises at least one of a frangible region, a float valve mechanism, a cementing stage tool, a float collar mechanism, or a landing collar structure.

78. The casing bit of claim 75, wherein the outer profile comprises a substantially symmetrical profile, with respect to a longitudinal axis of the casing bit.

79. The casing bit of claim 75, wherein the plurality of cutting elements comprises polycrystalline diamond stud-type cutting elements.

80. The casing bit of claim 75, wherein the plurality of cutting elements comprises percussion inserts.

81. The casing bit of claim 80, wherein the percussion inserts comprise at least one of cemented tungsten carbide and diamond.

82. A casing bit for drilling a casing section into a subterranean formation, comprising:

an inner profile;

an outer profile;

a nose portion;

at least one aperture formed in the nose portion and configured for delivering drilling fluid from an interior of the casing bit to an exterior thereof;

at least one gage section, the at least one gage section extending longitudinally from adjacent the nose portion;

a plurality of generally radially extending blades disposed on the nose portion, at least one of the plurality of blades carrying a plurality of cutting elements affixed thereto, the plurality of cutting elements comprising:

a first plurality of cutting elements configured to initially engage and drill through a first region and to substantially wear away while drilling through the first region; and a second plurality of cutting elements configured to engage and drill through a second region to be subsequently encountered by the casing bit, at least one cutting element of the second plurality of cutting elements comprising a polycrystalline diamond cutting element and positioned in rotational alignment with at least one cutting element of the first plurality of cutting elements comprising a tungsten carbide cutting element, the at least one cutting element of the second plurality of cutting elements positioned to rotationally follow the at least one cutting element of the first plurality of cutting elements in a groove formed by the at least one cutting element of the first plurality of cutting elements when the casing bit is rotated during a drilling operation.

83. A casing bit for drilling a casing section into a subterranean formation, comprising:

an inner profile;

an outer profile;

a nose portion;

at least one aperture formed in the nose portion and configured for delivering drilling fluid from an interior of the casing bit to an exterior thereof;

at least one gage section, the at least one gage section extending longitudinally from adjacent the nose portion; and a plurality of generally radially extending blades disposed on the nose portion, at least one of the plurality of blades carrying one or more cutting elements affixed thereto, at least one of the one or more cutting elements being affixed to the at least one of the plurality of blades by electrically disbonding material.

84. A casing bit for drilling a casing section into a subterranean formation, comprising:

an inner profile;

an outer profile;

a nose portion;

at least one aperture formed in the nose portion and configured for delivering drilling fluid from an interior of the casing bit to an exterior thereof;

at least one gage section, the at least one gage section extending longitudinally from adjacent the nose portion; and a plurality of generally radially extending blades disposed on the nose portion, at least one blade of the plurality of blades carrying one or more cutting elements affixed thereto; and at least one groove formed in the at least one blade of the plurality of blades, the at least one groove configured to cause the at least one blade to separate into two or more smaller sections when another drilling tool is used to drill through the casing bit, the at least one groove comprising an end surface extending longitudinally into the at least one blade at a location rotationally behind the one or more cutting elements to a floor, the at least one groove extending through the at least one blade to a rotationally trailing longitudinally extending surface of the at least one blade.

85. A casing bit for drilling a casing section into a subterranean formation, comprising:

an inner profile;

an outer profile;

a nose portion, at least a portion of the nose portion comprising one or more fibers disposed within a matrix material;

at least one aperture formed in the nose portion and configured for delivering drilling fluid from an interior of the casing bit to an exterior thereof;

at least one gage section, the at least one gage section extending longitudinally from adjacent the nose portion; and a plurality of generally radially extending blades disposed on the nose portion, at least one of the plurality of blades carrying one or more cutting elements affixed thereto.

86. A drilling assembly for drilling a casing section into a subterranean formation, comprising:

a casing section of a casing string;

a casing bit secured to an end of the casing section, the casing bit having an inner profile, an outer profile, and a nose portion;

at least one aperture formed in the nose portion and configured for delivering drilling fluid from an interior of the casing bit to an exterior thereof;

at least one gage section, the at least one gage section extending longitudinally from adjacent the nose portion;

a plurality of generally radially extending blades disposed on the nose portion, at least one of the plurality of blades carrying one or more cutting elements affixed thereto; and at least one of an incendiary agent, an explosive agent, and a reactive chemical in a container affixed to at least one of the casing section and the casing bit, the at least one of an incendiary agent, an explosive agent, and a reactive chemical being configured to render the casing bit more drillable.

* * * * *